US009359924B2

(12) United States Patent
Kalayci et al.

(10) Patent No.: US 9,359,924 B2
(45) Date of Patent: Jun. 7, 2016

(54) ENGINE CRANKCASE VENTILATION FILTER ASSEMBLY; COMPONENTS; FEATURE; AND METHODS

(75) Inventors: Veli Kalayci, Farmington, MN (US); Manpreet Phull, Eagan, MN (US); Thomas Lundgren, Bloomington, MN (US); Daniel Adamek, Bloomington, MN (US)

(73) Assignee: Donaldson Company, Inc., Minneapolis, MN (US)

( * ) Notice: Subject to any disclaimer, the term of this patent is extended or adjusted under 35 U.S.C. 154(b) by 320 days.

(21) Appl. No.: 13/640,206

(22) PCT Filed: May 12, 2011

(86) PCT No.: PCT/US2011/036305

§ 371 (c)(1), (2), (4) Date: May 14, 2013

(87) PCT Pub. No.: WO2011/143464

PCT Pub. Date: Nov. 17, 2011

(65) Prior Publication Data

US 2014/0109885 A1 Apr. 24, 2014

Related U.S. Application Data

(60) Provisional application No. 61/334,423, filed on May 13, 2010.

(51) Int. Cl.

| | |
|---|---|
| ***B01D 46/46*** | (2006.01) |
| ***F01M 13/04*** | (2006.01) |
| ***F01M 13/00*** | (2006.01) |

(52) U.S. Cl.

CPC ..... *F01M 13/04* (2013.01); *F01M 13/0011* (2013.01); *F01M 2013/0044* (2013.01); *F01M 2013/0072* (2013.01)

(58) Field of Classification Search

CPC ..... B01D 46/0087; B01D 46/2414; F01M 13/0011; F01M 13/04; F01M 2013/0016; F01M 2013/0438; F01M 137/7879

USPC ..... 55/312, 417, 420; 137/843; 123/572–574

See application file for complete search history.

(56) References Cited

U.S. PATENT DOCUMENTS 5,716,197 A * 2/1998 Paul et al. ..... 417/228
6,354,283 B1 3/2002 Hawkins et al.

(Continued)

FOREIGN PATENT DOCUMENTS

DE 201 22 494 U1 1/2006
DE 10 2004 061938 6/2006

(Continued)

OTHER PUBLICATIONS

International Search Report for International Application No. PCT/US2011/036305 mailed Jan. 18, 2012.

*Primary Examiner* — Duane Smith
*Assistant Examiner* — Minh-Chau Pham
(74) *Attorney, Agent, or Firm* — Merchant Gould, P.C.

(57) ABSTRACT

Crankcase ventilation filter systems are described, along with components and selected features thereof. Example features include preferred use of a backpressure limiting valve regulation (regulator) arrangement; and, a vacuum limiting valve regulation (regulator) arrangement. An example embodiment is provided which use two filter cartridges and two drain arrangements. Another example is provided which uses a single cartridge. Example filter cartridges are depicted and described.

20 Claims, 34 Drawing Sheets

(56) References Cited

U.S. PATENT DOCUMENTS

| | | | | |
|---|---|---|---|---|
| 7,017,563 | B2 | 3/2006 | Dworatzek et al. | |
| 8,460,424 | B2 | 6/2013 | Rogers et al. | |
| 8,499,749 | B2 | 8/2013 | Mosset et al. | |
| 8,617,277 | B2 * | 12/2013 | De Paepe et al. | 55/312 |
| 2002/0033009 | A1 | 3/2002 | Gieseke et al. | |
| 2003/0051455 | A1 | 3/2003 | Gieseke et al. | |
| 2004/0139734 | A1 | 7/2004 | Schmeichel et al. | |
| 2005/0193694 | A1 | 9/2005 | Gieseke et al. | |
| 2005/0211232 | A1 | 9/2005 | Dushek et al. | |
| 2005/0263122 | A1 * | 12/2005 | Saito | 123/179.18 |
| 2008/0035103 | A1 | 2/2008 | Barris et al. | |
| 2008/0142091 | A1 | 6/2008 | Meinig et al. | |
| 2009/0071111 | A1 | 3/2009 | Lundgren et al. | |
| 2009/0139503 | A1 | 6/2009 | Park | |
| 2010/0031940 | A1 | 2/2010 | Mosset et al. | |
| 2010/0077972 | A1 | 4/2010 | Doers | |
| 2011/0017155 | A1 * | 1/2011 | Jacob | 123/41.86 |
| 2011/0036242 | A1 | 2/2011 | Enderich et al. | |
| 2011/0258975 | A1 * | 10/2011 | Lundgren et al. | 55/357 |
| 2014/0076283 | A1 * | 3/2014 | Pursifull, Ross | 123/458 |
| 2015/0020785 | A1 * | 1/2015 | An et al. | 123/572 |

FOREIGN PATENT DOCUMENTS

| | | |
|---|---|---|
| DE | 20 2005 012 403 | 2/2007 |
| DE | 10 2007 062098 | 6/2009 |
| EP | 1 144 079 | 11/2004 |
| EP | 1 933 009 | 6/2008 |
| WO | 2004/045743 | 6/2004 |
| WO | 2008/147585 | 3/2009 |

* cited by examiner 50
51
54
55
60
61
64
65
70
71
76
77
95
100
104
105
105p
106
106x
110
115
121
126
127
127l
127u
128
130
131
132
133
133r
133x
134
135
138
139
140
144
150
152
155
156
157
158
159
160
160x
165
180
210
211
212
240
241
370
371

ENGINE CRANKCASE VENTILATION FILTER ASSEMBLY; COMPONENTS; FEATURE; AND METHODS

This application is being filed on 9 Oct. 2012, as a US National Stage of PCT International Patent application No. PCT/US2011/036305, filed 12 May 2011 in the name of Donaldson Company, Inc., a U.S. national corporation, applicant for the designation of all countries except the US, and Veli Kalayci, a citizen of Turkey, Manpreet Phull, a citizen of India, and Thomas Lundgren and Daniel Adamek, both citizens of the U.S., applicants for the designation of the US only. The present application includes the disclosure of, with edits and additions, U.S. provisional application 61/334,423 filed May 13, 2010. The PCT/US2011/036305 and 61/334,423 applications are incorporated herein by reference. To the extent appropriate, a claim of priority is made to each of the above disclosed applications.

FIELD OF THE DISCLOSURE

This disclosure relates to systems and methods for separating hydrophobic fluids (such as oils) which are entrained as aerosols in gas streams, for example in crankcase ventilation filter gases. Further, the arrangements also provide for filtration of other contaminants such as carbon soot material from the gas streams. The arrangements are typically to used filter crankcase ventilation gases, from engine systems. Methods for conducting the separations are also provided.

BACKGROUND

Certain gas streams, such as engine blow-by gases (i.e., crankcase ventilation gases, from the crankcases of the diesel engines) carry substantial amounts of entrained oils (liquid) therein, as aerosol. The majority of the oil (liquid) droplets within the aerosol are often within the size of 0.1-5.0 microns. In addition, such gas streams also carry substantial amounts of fine particulate contaminant, such as carbon contaminant (soot).

In some systems, it is desirable to vent such gases to the atmosphere. In general it is preferred that before the gases are vented to the atmosphere, they be cleaned of a substantial portion of aerosol and/or organic particulate contaminate therein.

In other instances, it is desirable to direct the air or gas stream into equipment. Such systems are sometimes references as "closed" crankcase ventilation systems. With such closed systems, it may be desirable to separate aerosolized liquids and/or particulates from the gas stream during circulation, in order to provide such benefits as: reduced negative effects in the downstream equipment; improved efficiencies; recapture of otherwise lost oil; and/or, to address environmental concerns.

Improvements in crankcase ventilation filter systems (i.e., blow-by gas filtration systems) constructed for application with a variety of engine or equipment systems, are generally sought.

SUMMARY

According to the present disclosure, crankcase ventilation filter assemblies are described. In addition, components, features and techniques for use in the crankcase ventilation filter assemblies are described. Also methods of assembly and use are described. There is no specific requirement that an assembly, component, feature, technique or method include all of the details described herein, in order to obtain some benefit according to the present disclosure.

According to an aspect of the present disclosure, a crankcase ventilation filter assembly is provided which includes a housing arrangement having a gas flow inlet arrangement, a gas flow outlet arrangement, and a liquid drain outlet arrangement. The system includes, mounted on the housing: a backpressure limiting valve regulation (regulator) arrangement oriented to regulate pressure transfer to, and gas flow through, the housing from, the gas flow inlet arrangement; and, a vacuum limiting regulator valve arrangement also mounted on housing and positioned in a gas flow path downstream of backpressure limiting valve regulator arrangement and upstream of the gas flow outlet arrangement to regulate transfer of vacuum through the housing arrangement via the gas flow outlet arrangement. Two embodiments are depicted with such arrangements. In one, a single cartridge so positioned in the housing; and, in a second, two filter cartridges are depicted in the housing.

Also, according to an aspect of the present disclosure, crankcase ventilation filter assembly is provided comprising a housing arrangement including a gas flow inlet arrangement, a gas flow outlet arrangement, and a liquid drain outlet arrangement. In inertial impaction arrangement is positioned across the gas flow inlet arrangement to advantage. In the example depicted, the gas flow inlet arrangement comprises a flow tube with a closed end positioned inside of the housing, the flow tube including a side gas flow passageway arrangement therethrough (or a open support arrangement) adjacent the closed end. The assembly further includes a filter cartridge comprising media positioned around an open filter interior. The filter cartridge is removably positioned in the housing with a flow tube, having a closed end and the side gas flow passageway arrangement (or open support arrangement) projecting into the open filter interior, i.e. to a location surrounded by media. In examples depicted, the flow tube with closed end projects upwardly into the filter cartridge, although alternatives are possible, including direction downwardly into the filter cartridge.

In one embodiment depicted, a crankcase ventilation filter assembly is characterized, useable for example in a closed crankcase ventilation system to filter crankcase ventilation gases (engine blow-by gases) that includes two serviceable filter cartridges organized in series with respect to gas flow. A first, most upstream, serviceable filter cartridge is configured to coalesce oil and direct the liquid to a first drain arrangement. The second serviceable filter cartridge is configured to also coalesce oil, but to direct it to a second drain arrangement, with a sealing arrangement (and having features) inhibiting liquid flow between the two drain arrangements, within a housing of the assembly. The serviceable filter cartridges are preferably different form one another, with respect to overall media pack content, with the first providing for a substantial amount of soot load or collection, and the second acting more as a polishing or finishing filter. It is expected that with such an arrangement the two serviceable filter cartridges may be provided as separately serviceable because in some applications, the first filter will typically need to be serviced more often than the second in a typical application.

An arrangement in described in which a breather or coalescer, pack is provided upstream of the first serviceable filter cartridge, for an initial collection of oil material in the crankcase ventilation gases.

Regulator valve arrangements are described appropriately placed for desirable effect. A first, referred to as a backpressure limiting regulation valve assembly or by similar terms, is positioned to protect the engine against a under pressure condition being transferred therein. A second, referenced herein as a vacuum limiting regulator valve assembly or by similar terms, is positioned to manage inhibition of an excess vacuum condition being transferred from a gas flow outlet of the assembly through the assembly.

Also, example crankcase ventilation filter cartridges are depicted and described.

Again, there is no specific requirement that a system, arrangement component, assembly or method include all of the features characterized herein, in order to obtain some benefit according to the present disclosure.

DETAILED DESCRIPTION

I. General

A. Typical Engine and Crankcase Ventilation Filter System Arrangement, FIG. 1

Figure 1:
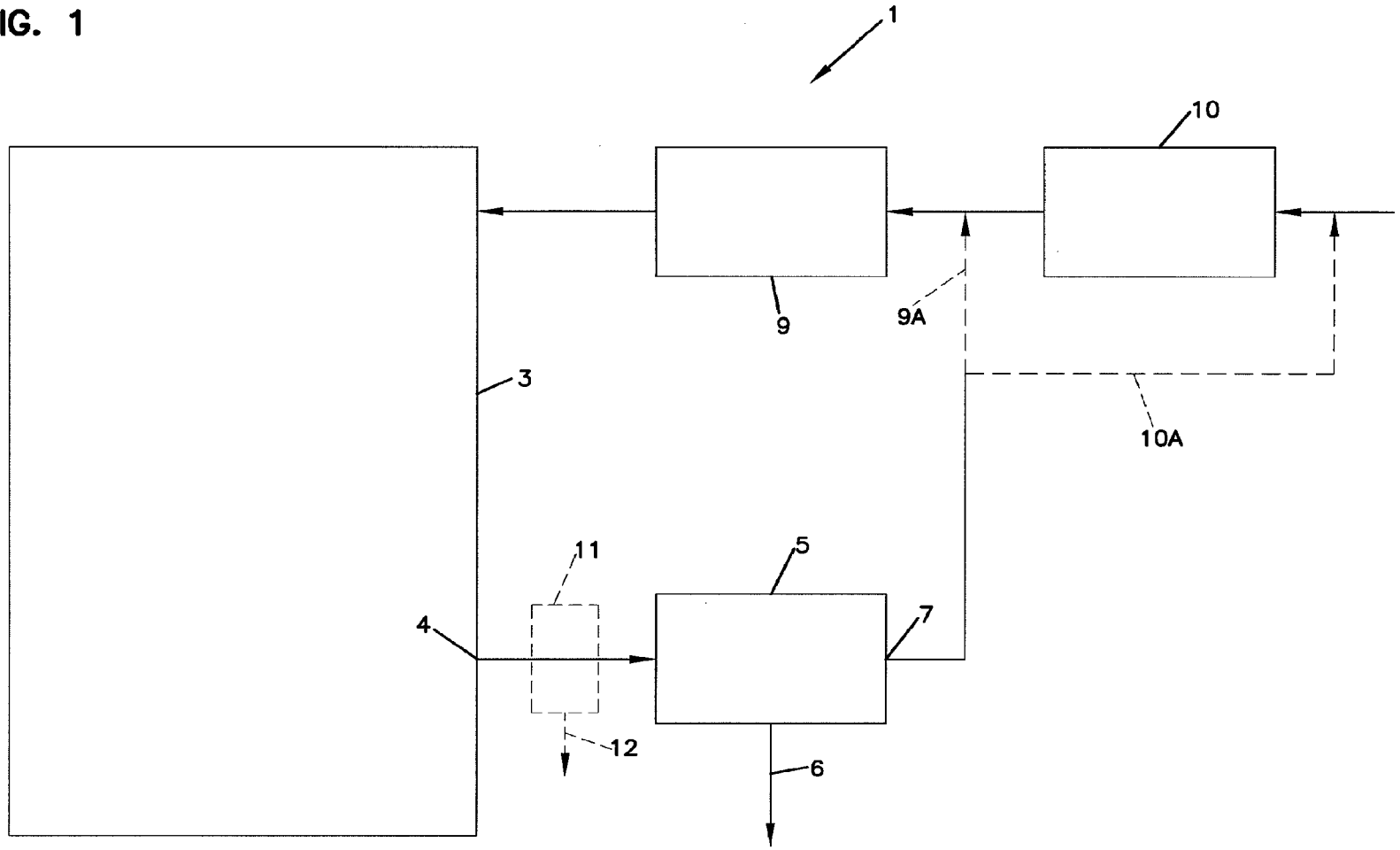
FIG. 1 is a schematic depiction of a crankcase ventilation system.

In FIG. 1, an example engine system using a crankcase ventilation filter assembly, is depicted generally at 1. Referring to FIG. 1, schematically depicted is an engine 3. The engine 3 includes a vent or outlet 4 for crankcase ventilation. That is, through outlet 4 engine 3 will vent a gas stream comprising crankcase ventilation gases, or engine blow-by gases, that include, entrained therein, oil particles and other materials such as soot, combustion by-products etc. The outlet 4 is generally directed to an engine (breather) crankcase ventilation filter assembly 5. Within the assembly 5, oil is coalesced and drained as indicated generally at oil outlet 6. In addition, other materials contained within the crankcase ventilation gases are generally trapped within an internally received filter arrangement, and collected. The resulting filtered gases are shown directed from the crankcase ventilation assembly 5, at gas flow outlet 7.

The particular crankcase ventilation assembly 5 depicted, is a closed crankcase ventilation assembly. Thus, the gas outlet 7 directs the gases back into the engine system 3, for example into a turbo system indicated at 9, via line 9A, or an engine in-take air cleaner assembly indicated at 10, via line 10A, or elsewhere as desired.

It is noted that, in some instances, before entering the crankcase ventilation filter assembly 5, the gases are passed through a "breather" typically comprising a media pack such as a metal foil pack or similar pack, for the oil separation. Such an optional breather assembly is indicated in FIG. 1 at 11, with oil drainage therefrom indicated at 12.

A number of issues are presented to the manufacturers of diesel engines.

For example, it is desirable to protect the engine from transfer therein of a vacuum condition, from crankcase ventilation filter assembly 5. It is also desirable to protect the crankcase ventilation filter assembly 5 from transfer from vacuum condition therethrough via the gas flow outlet 7.

Also, there is an increasing need to maintain controls on emissions. To facilitate this, relatively high efficiency of collection and separation within the crankcase ventilation assembly 5 is desired. However, obtaining such efficiency is generally exacerbated by increasing soot levels in the crankcase ventilation system, for example provided in the crankcase ventilation gases of EGR engines (exhaust gas recirculation engines) in which engine exhaust gases are directed into engine components. Relatively high soot levels provide cleaning or filtration issues in the absence of high efficiency separation and can provide undesirable clogging of engine components.

In accord with the present disclosure systems, features, and techniques are provided to enhance crankcase ventilation filter assembly operation.

B. A Schematic Example of a First Improved Crankcase Ventilation Filter Assembly and Method, FIG. 2.

Figure 2:
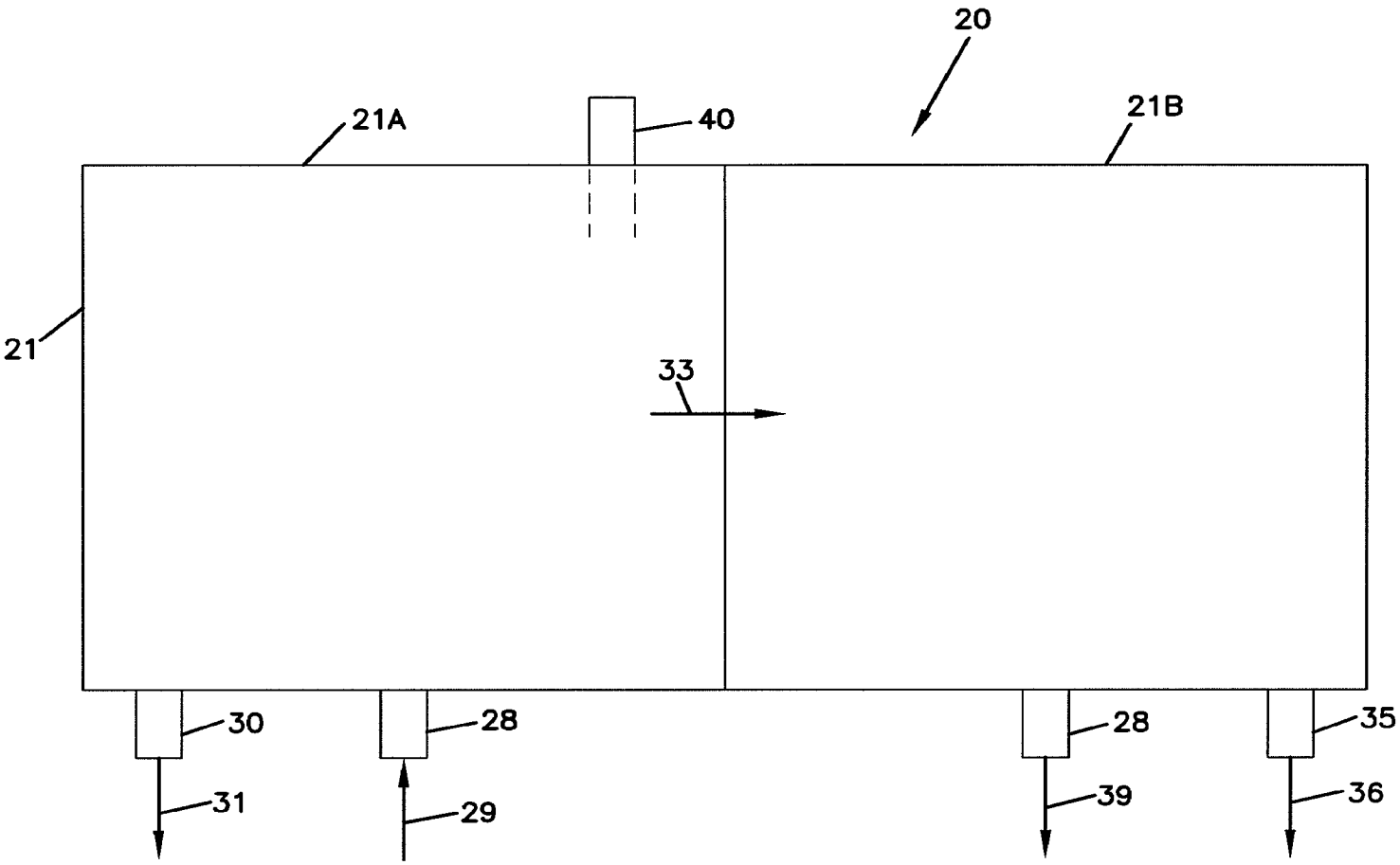
FIG. 2 is a schematic representation of a multi-separation phase filter assembly according to the present disclosure.

In FIG. 2, a schematic depiction of an example crankcase ventilation assembly 20 in accord with certain of the general principles described herein is presented. It can be used as assembly 5, FIG. 1. Referring to FIG. 2, crankcase ventilation filter assembly 20 comprises an example of multi-phase separation system. The particular assembly 20 depicted, comprises, in a single housing 21, two oil separation phases or regions 21A, 21B, although selected principles described herein can be applied in systems having additional oil separation phases or regions or only one.

Still referring to FIG. 2, assembly 20 comprises housing 21, which contains the two phases 21A, 21B. For the particular schematic system depicted in FIG. 2, the phases 21A, 21B are depicted positioned laterally, horizontally, adjacent one another, although alternatives are possible.

Referring to FIG. 2, crankcase ventilation filter gas flow, from an engine crankcase vent, is indicated entering assembly 20 through gas flow inlet arrangement 28, at arrow 29. Within housing 21, and phase 21A, the gases will be passed through a filter arrangement assembly configured to: coalesce at least a portion of oil contained within the gases; selectively reduce soot and other contaminant levels contained within the gases; and, to provide for filtered gases to be directed into the second phase or region 21B. At 30, a coalesced oil (liquid) drain from phase 21A is shown, with liquid oil drained as shown at arrow 31. The collected oil 31, for example, can be drained and be directed to an engine crankcase or oil sump.

At arrow 33, filtered gas flow from phase 21A to phase 21B is shown. Typically, within phase 21A would be positioned a removable and replaceable filtration cartridge, which serves to collect soot and other material, and which also serves to facilitate coalescing of the oil.

Within phase 21B is positioned a second filter stage. Typically, the second filter stage also comprises a serviceable filter cartridge, comprising material appropriate for further filtration of the gas and includes media appropriate for further coalescing and drainage of oil. At 35, an oil (liquid) drain outlet from a second phase 21B is shown; the oil drainage being indicated by arrow 36. This oil, too, can be directed to an engine sump or crankcase as desired. At 28 a filtered gas flow outlet from phase 21B (and assembly 20) is shown; the filtered gases being indicated leaving the assembly 20 at arrow 39. This would correspond to the gas flow outlet 7, FIG. 1.

A typical crankcase ventilation assembly such as assembly 21 may include therein a vent or bypass valve assembly. Such an assembly provides for rapid release of internal pressure within housing 21, should it exceed some desired level. An optional vent or bypass valve arrangement is indicated generally at 40.

Within housing 21, the assembly 20 may include a variety of regulator valves for management of internal operations. For example a backpressure regulation valve assembly can be included in the first phase 21A, to inhibit crankcase pressure from dropping below a selected pressure level. Further, a vacuum limiting regulation valve arrangement may be included in phase 12B, to inhibit equipment to which gas in line 29 is directed, from drawing too rapidly, and causing an undesirable under pressure or vacuum condition within housing 21, which can cause issues with drain height requirements and/or filter life. Regulator valves of this type are described in general terms, in connection with embodiments depicted herein below. As will be apparent from the embodiment described in FIGS. 21-31 below, a vacuum limiting regulation valve arrangement and a backpressure regulation valve arrangement can also be used to advantage in accord with principles of the present disclosure, in systems in which multiple filters or filter phases are not necessarily used.

II. An Example Assembly, FIGS. 3-19

In FIGS. 3-19, a first embodiment of a crankcase ventilation filter assembly which can be used with an engine in general accord with FIG. 1, as a crankcase ventilation filter 5, and which operates in accord with the general schematic description of system 20, FIG. 2, is depicted.

Figure 3:
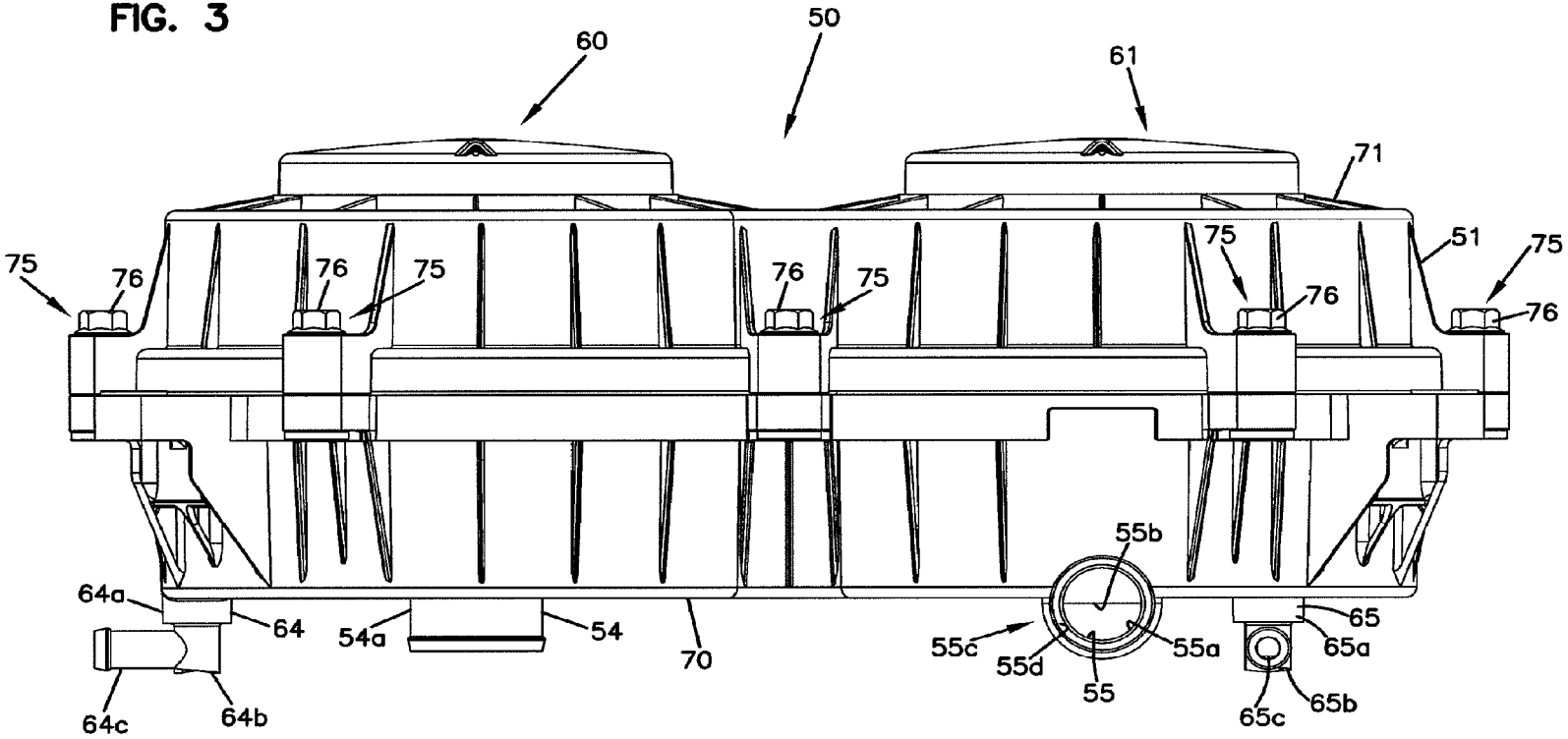
FIG. 3 is a schematic side elevational view of an example multi-separation phase crankcase ventilation filter assembly according to the present disclosure.

Referring first to FIG. 3, at 50 the example crankcase ventilation filter assembly is shown. Crankcase ventilation filter assembly 50 comprises housing 51. The housing 51 includes: a crankcase ventilation gas flow inlet arrangement 54 and a filtered gas flow outlet arrangement 55. Via the inlet arrangement 54, gases from an engine crankcase vent (i.e. blow by gases) are directed into the assembly 50 for filtering. Via outlet 55, filtered gas leaves the assembly 50 and is directed as appropriate, for example into a turbo system or air cleaner system, or elsewhere into an engine system as referred above in connection with FIG. 1.

For the particular example assembly 50 depicted, inlet arrangement 54 is an upwardly directed tube 54*a* that passes into the housing 51 from underneath. Further, outlet arrangement 55 comprises tube 55*a* with a section 55*b* that receives gas flow downwardly out of housing 51, and which includes an elbow 55*c* which turns the gases and directs them laterally through section 55*d*. With respect to these features of outlet arrangement 55, attention is directed, for example to FIGS. 6 and 11.

Referring again to FIG. 3, the particular crankcase ventilation filter assembly 50 depicted, is a multi-separation phase system that includes two oil collection/separation phases indicated generally at 60, 61. Gas flow direction into assembly 50 is first into the first phase 60, via inlet 54. At 64, a first oil drain outlet from housing 51 (i.e. from system 50) is shown. This would be a coalesced oil drain outlet from the first phase 60. At 65, a second oil drain outlet arrangement is shown, allowing for oil drainage from the second phase 61 (i.e. from housing 51 in system 50). Each of the outlets 64, 65, in the example depicted, comprises a corresponding tap 64*a*, 65*a* respectively, directed upwardly into a lower portion of housing 51.

In the example depicted, each of the oil drains 64, 65, includes a turn or elbow 64*b*, 65*b*, respectively, underneath regions 64*a*, 65*a*, with a lateral extension 64*c*, 65*c*. In this manner, the total dimension of the assembly 50, extending downwardly underneath housing 51 is limited. This will typically be preferred, when the assembly 50 is used and positioned as described herein below.

Still referring to FIG. 3, the housing 51 comprises two housing sections: a first, lower, bottom, or base section 70; and, a second, upper, access cover section 71. For the particular assembly depicted, the base section 70 comprises a single piece, although alternatives are possible. For the particular assembly 50 depicted, the access cover section 71 comprises a single piece, although alternatives are possible.

Referring to FIG. 3, for the example depicted, the access cover 71 is secured in place on the base arrangement 70 by fasteners 75, and in the example depicted comprising perimeter bolts 76.

It is anticipated that in some systems, a gasket may be provided between the base section arrangement 70 and the access cover arrangement 71, to inhibit undesirable leaking at a joint or seam between these components, in assembly and use. In the cross-sectional view of FIG. 19, such a gasket arrangement is shown at 77.

Figure 6:
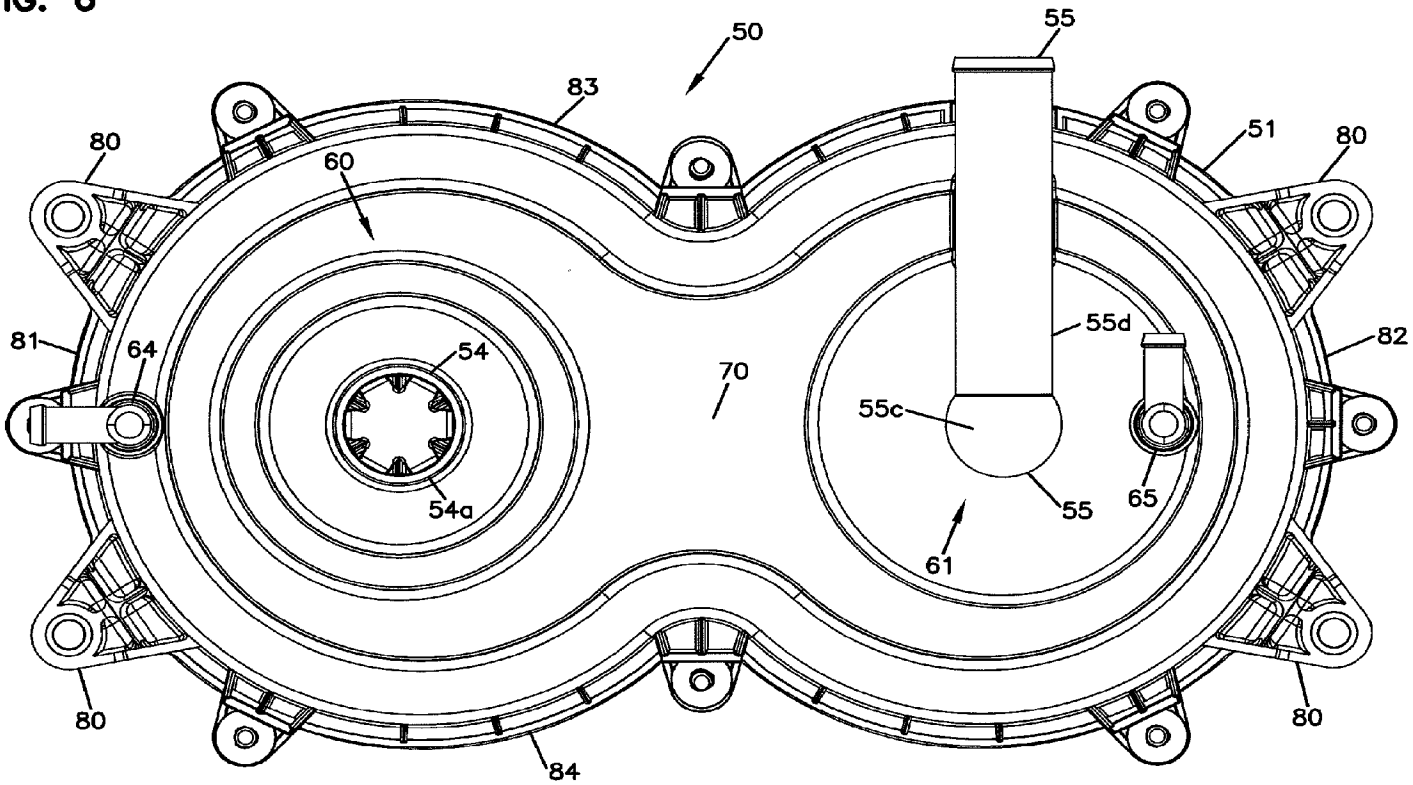
FIG. 6 is a schematic bottom plan view of the assembly of FIGS. 3-5.

In FIG. 6, a bottom plan view of the assembly 50 is depicted. At 80, as part of base section 70, perimeter mounting pads are depicted by which assembly 50 can be mounted on equipment and secured in position for use. Other features viewable in FIG. 4, discussed above, and are indicated by the same reference numerals. It is noted that the housing 51 can be characterized as housing opposite ends 81, 82 with opposite sides 83, 84 extending therebetween.

Figure 5:
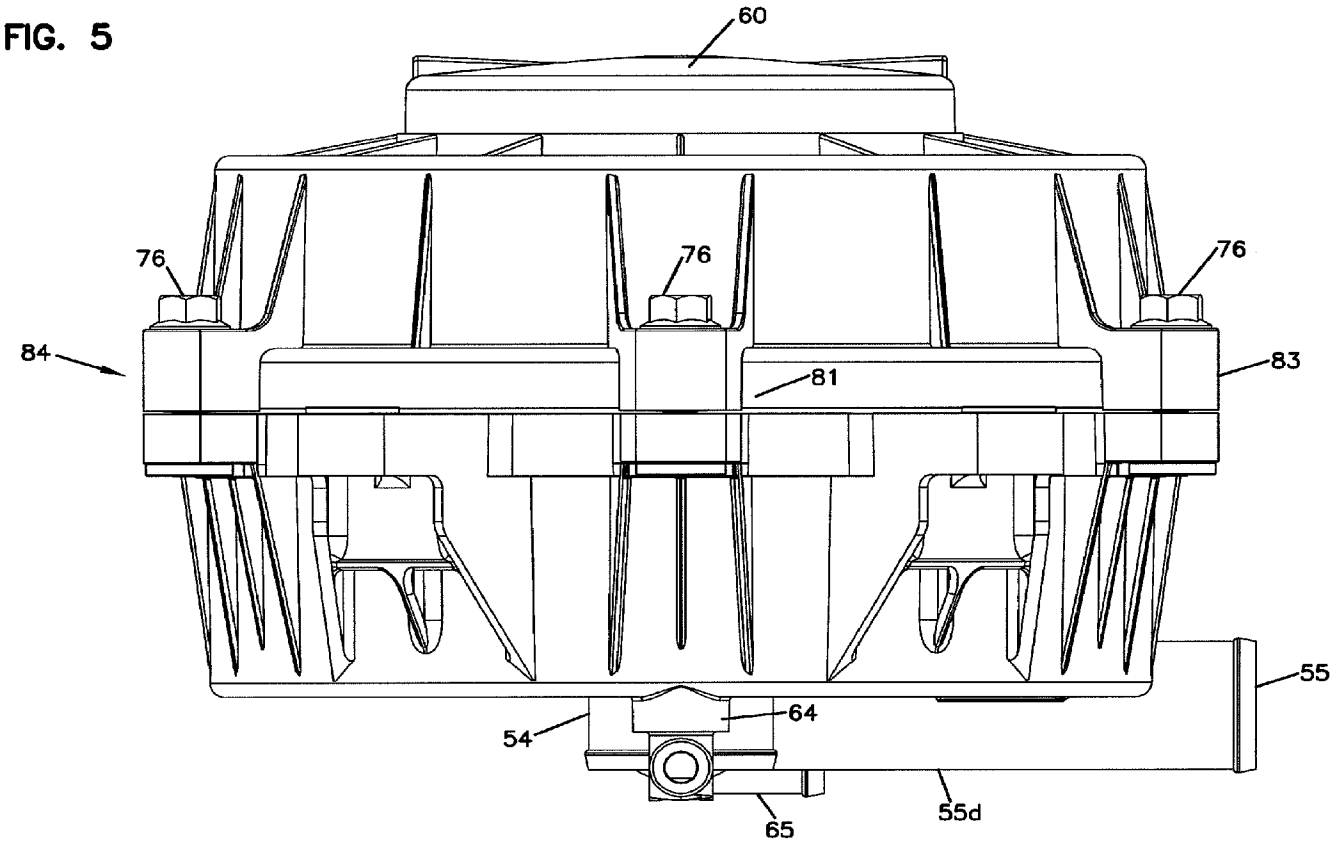
FIG. 5 is a schematic end elevational view of the assembly of FIGS. 3 and 4.

In FIG. 5, an end elevational view of assembly 50, taken generally toward first oil (liquid drain) outlet 64 and end 81, is shown. Features previously identified are numbered analogously.

Figure 4:
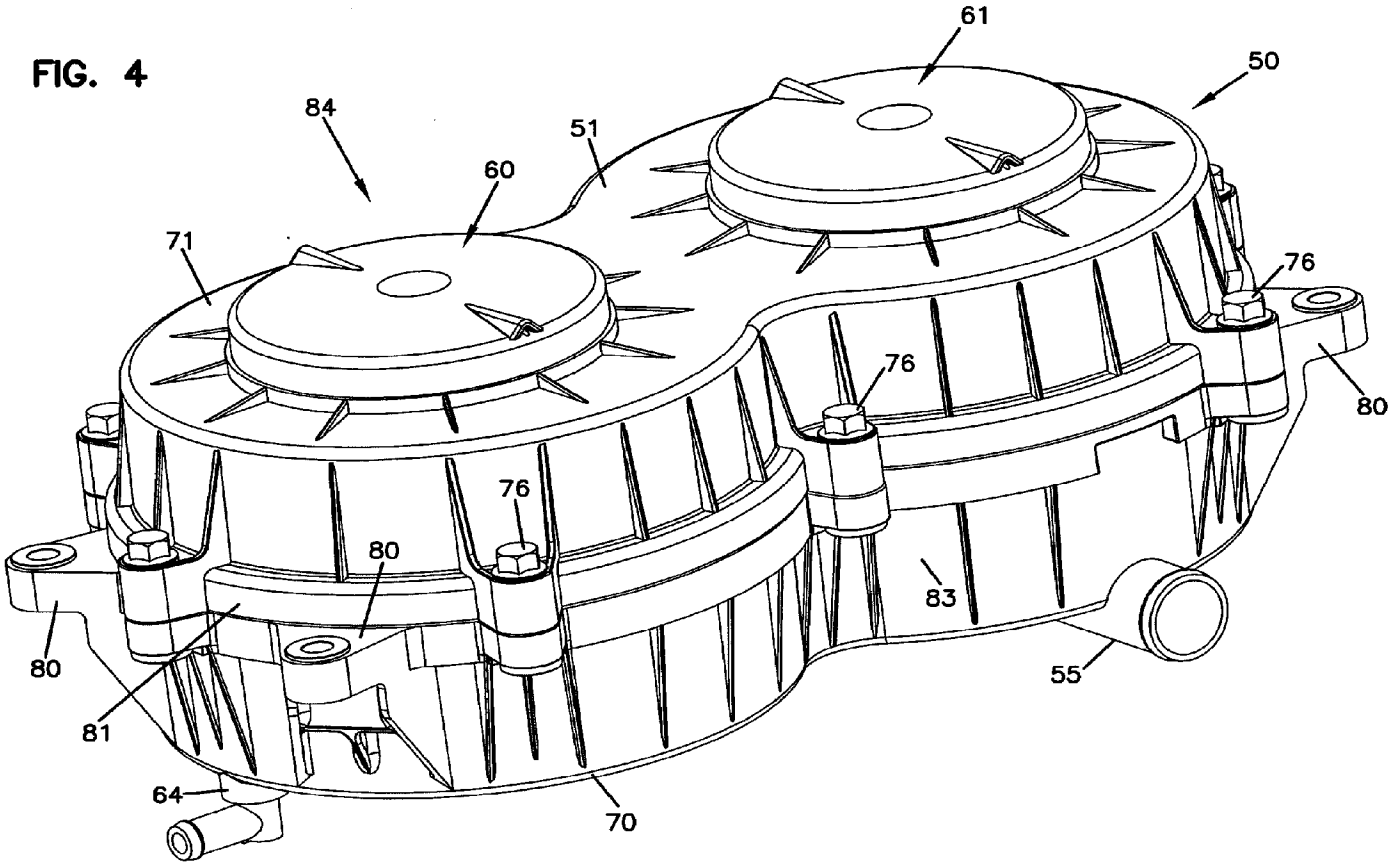
FIG. 4 is a schematic top perspective view of the assembly of FIG. 3.

In FIG. 4, a schematic top perspective view of the assembly 50 is depicted. Selected components and features previously identified are indicated by like reference numerals.

Figure 7:
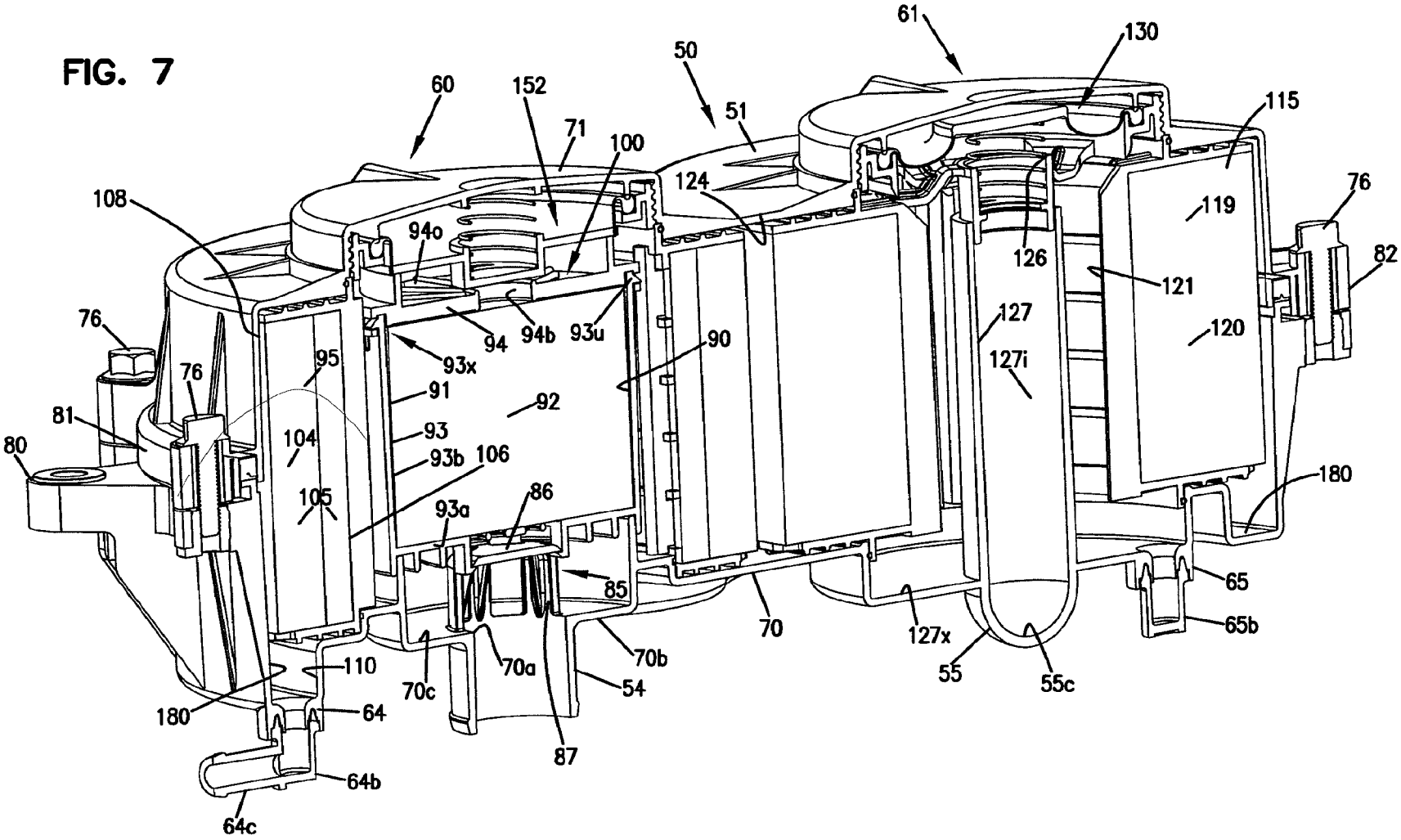
FIG. 7 is a schematic top perspective cross-sectional view of the assembly of FIGS. 3-6.

In FIG. 7, a schematic perspective cross-sectional view of the assembly 50 is provided. The view is generally a central cross-section, taken centrally in a direction between opposite ends 81, 82 of the assembly 50. In some instances, internal features are shown, to facilitate understanding and interpretation of the system.

Referring to FIG. 7, gases from the crankcase will be directed into a housing 51 through gas flow inlet arrangement 54. This direction, for the example depicted, is upwardly, through an inlet aperture 70*a* in bottom 70*b* of the housing 51. Positioned above inlet arrangement 70*a*, is oriented an inertial impaction arrangement 85. The inertial impaction arrangement 85 includes an upper inertial impaction plate 86, supported by a frame or support arrangement 87. Typically, the upper plate 86 is impermeable, whereas support arrangement 87 is porous, i.e. open, allowing gas flow therethrough. That is, the open support arrangement is a side gas flow (or gas flow aperture arrangement). Thus, as gases are directly upwardly through aperture 70*a*, the gases are tending to turn to pass through support arrangement 87. As material within the gas flow impacts plate 86, some of it will be collected and re-drained downwardly, for example through inlet 54.

In a typical arrangement, the plate 86 would be spaced from a portion 70*c* of bottom 70*b* (immediately adjacent aperture 70*a*) by support arrangement 87, a distance within the range of 15 mm-30 mm, inclusive, although alternatives are possible. In a typical assembly 50, in which the bottom portion 70 of the housing comprises a molded plastic component, support 85 and plate 86 can be formed integral with the a remainder of the bottom section 70. Also, typically the plate 86 will often have a dimension thereacross (diameter when plate 86 is circular) within the range of 20-50 mm, inclusive, typically 25-40 mm, although alternatives are possible.

The gases are then directed upwardly into a breather or breather chamber 90. The breather or breather chamber 90 is generally a housing 91 containing a high surface area packing 92. Within the chamber 90, a portion of material obtained within the gas flow will collect on the surfaces of the packing and drain downwardly. A typical packing would comprise a mesh of aluminum foil strips, although alternative materials can be used. Typically, the packing within chamber 90 will not ever be removed or replaced, in a normal lifetime of operation.

It is noted that when breather 90 is used, the optional breather 11, FIG. 1, which is separate from the crankcase ventilation filter assembly 5, FIG. 1, can be avoided. On the other hand, assembly 50 can be used with such a breather 11 upstream of it.

For the particular assembly 50 depicted, breather 90 comprises a cup 93 having a permeable bottom 93*a* and impermeable sidewall 93*b*. Cup 93 is a snap-fit to support 85, typically so that is cannot readily be removed. The housing 91 further includes a cover 94 snap-fit to an upper portion 93*u* of the sidewall 93*b*, as indicated generally at 93*x*. The cover 94 is generally open and in the example depicted comprises a plurality of ribs 94*a* surrounding a center aperture ring 94*b*. Generally, gases can flow upwardly through cover 94 in any region other than occupied by the ribs 94*a*, and the surfaces of ring 94*b*.

The cross-sectional size of chamber 90, relative to the plate 86 is typically a ratio of at least 1.8:1 and usually at least 2:1 and often within the range of 2.2:1 to 2.8:1, inclusive, although alternatives are possible. The vertical dimension of packing 92 is generally at least 45 mm, typically at least 50 mm and often within the range of 55-85 mm, inclusive, although alternatives are possible. A ratio of a vertical height of packing 92, to a horizontal dimension of packing 92, when sidewall 93*b* is generally cylindrical, would typically be at least 0.5, usually at least 0.8 and sometimes greater than 0.9, for example 1.0 or larger.

Still referring to FIG. 7, from the stage one chamber 90, gases are, in due course, directed to a filter cartridge, indicated generally at 95. Preferably, cartridge 95 is serviceable. By the term "serviceable" used herein, in connection with a filter cartridge such as filter cartridge 95, it is meant that the cartridge 95 can be removed from and be replaced within housing 51. This is generally accomplished after removal of service access cover 71. In some instances, filter cartridge 95 will be referred to as a "first" or "first in gas flow direction" filter cartridge, since, as will be understood from further description below, the system 50 includes two serviceable filter cartridges, and cartridge 95 is the first in the gas flow series or direction, from gas flow inlet 54 to gas flow outlet 55.

In passing to the (first) filter cartridge 95, the gases are generally regulated by a backpressure limiting regulation (regulator) valve arrangement 100, discussed in further detail below. In general, the backpressure limiting regulator valve arrangement 100 is configured to regulate a pressure condition so that a desirable range of pressures is maintained at inlet 54 (and the further upstream engine crankcase). In general, the backpressure limiting regulator valve arrangement is positioned downstream from the gas flow inlet 54 and upstream of the gas flow outlet 28 and a downstream vacuum limiting valve regulation (regulator) arrangement discussed below.

In FIG. 7, the backpressure limiting regulation (regulator) valve arrangement 100 is shown in a closed orientation; an orientation typically reached either when: the engine system is shut-off; or, a vacuum condition in a housing 51, downstream from regulator valve arrangement 100 is sufficiently low that it could potentially generate an undesirable, for example negative, vacuum condition at inlet 54, but for closing of the valve arrangement 100.

Still referring to FIG. 7, the particular filter cartridge 95 depicted comprises a media pack 104 including media 105 surrounding and defining an open filter interior 106. The media 105 is generally configured to provide for both filtration of material within the gas flow and coalescing and drainage of liquid, as the gases flow from the open interior 106 through the media 105 to annulus 108 around an outside of the media 105. Liquid coalesced and drained from the media 105, will generally flow downwardly into liquid collection region 110, whereby the collected oil can drain to the first oil (liquid) drain outlet 64.

The gases from annulus 108 are then directed from the first phase or region 60 into the second phase or region 61.

Still referring to FIG. 7, within the interior of the second or region phase 61, is positioned a second, typically serviceable, filter cartridge 115. Serviceable filter cartridge 115 is sometimes referred to as a "second" or "second gas flow direction" serviceable filter cartridge because it is positioned downstream with respect to gas flow, from inlet 54 to outlet 55, relative to cartridge 95. The cartridge 115 would generally comprise a media pack 119 including media 120 surrounding an open filter interior 121.

In a typical operation, gases pass through the media 120 from annulus 124 around the media 120, to the open filter interior 121, with filtering. Oil (liquid) coalesced within the media 120 will drain downwardly into collector 127*x* by which it can drain eventually outwardly through the second oil drain arrangement 65. Of course, some filtration will occur in addition to the coalescing, and material will remain entrained within the media 120 or will drain with the oil downward. Gases at the open filter interior 121 are generally directed into inlet end 126 of central flow tube 127. The central flow tube 127 is typically impermeable, except for opening at end 126 and at an opposite outlet end. The gases are then directed from the interior 127*i* of central flow tube 127 to outlet arrangement 55.

Still referring to FIG. 7, the assembly 50 depicted includes a vacuum limiting regulation (regulator) valve arrangement 130 therein, which regulates flow from central filter interior 121 into inlet 126. The regulator valve arrangement, 130, discussed in greater detail below, will generally manage pressure conditions such that an excess vacuum draw at gas flow outlet arrangement 55 will not be transferred further into assembly 50. Thus, the regulator valve arrangement 130 will open wider, or close down, an air flow passageway from open filter interior 121 to inlet 126, in response to vacuum conditions at outlet 55.

In more general terms, the vacuum limiting regulation (regulator) valve arrangement 130 is positioned upstream in a gas flow path of the gas flow outlet arrangement 55 and downstream of the gas flow inlet arrangement 54 (and downstream from backpressure limiting valve regulator arrangement 100) to inhibit an undesirable vacuum from being transferred via outlet 55 through the housing to the backpressure limiting valve arrangement 100. This is discussed further below.

Typically, the cartridge 95 and the cartridge 115 are separately serviceable components, i.e. each is removed and replaced within assembly 50 independently of the other, to advantage. In some applications of the selected ones of the principles according to the present disclosure, the assembly could be configured with a single serviceable component; i.e. with cartridges 95, 115 secured together.

Figures 8, 8A, 8B, 8C, 8D:
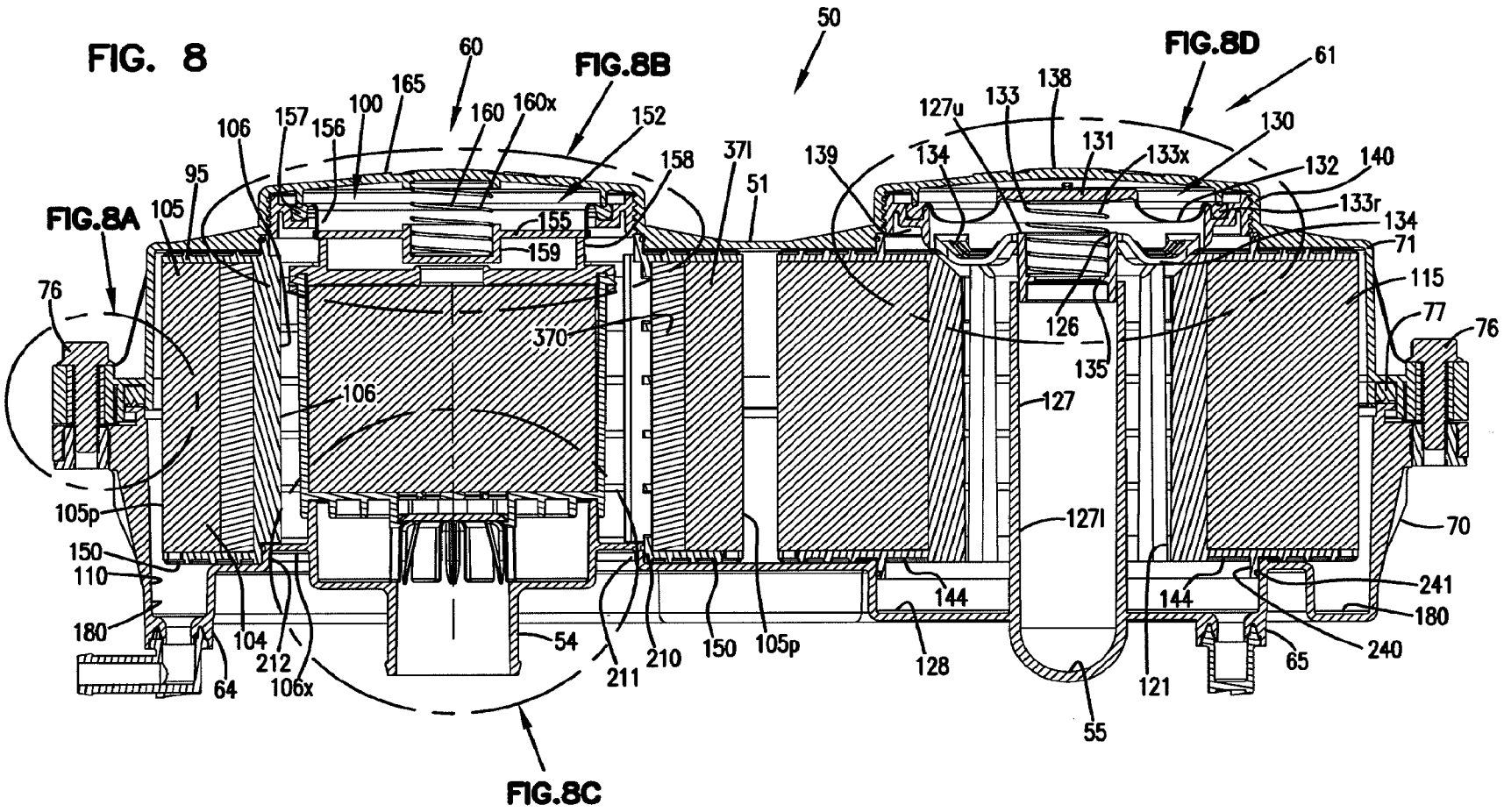
FIG. 8 is a schematic side elevational, cross-sectional, view of the assembly of FIGS. 3-6.
FIG. 8A is an enlarged, schematic, fragmentary view of a first selected identified portion of FIG. 8.
FIG. 8B is an enlarged, schematic, fragmentary view of a second identified portion of FIG. 8.
FIG. 8C is an enlarged, schematic, fragmentary schematic view of a third portion of FIG. 8.
FIG. 8D is an enlarged, schematic, fragmentary view of a fourth portion of FIG. 8.
Figure 8A:
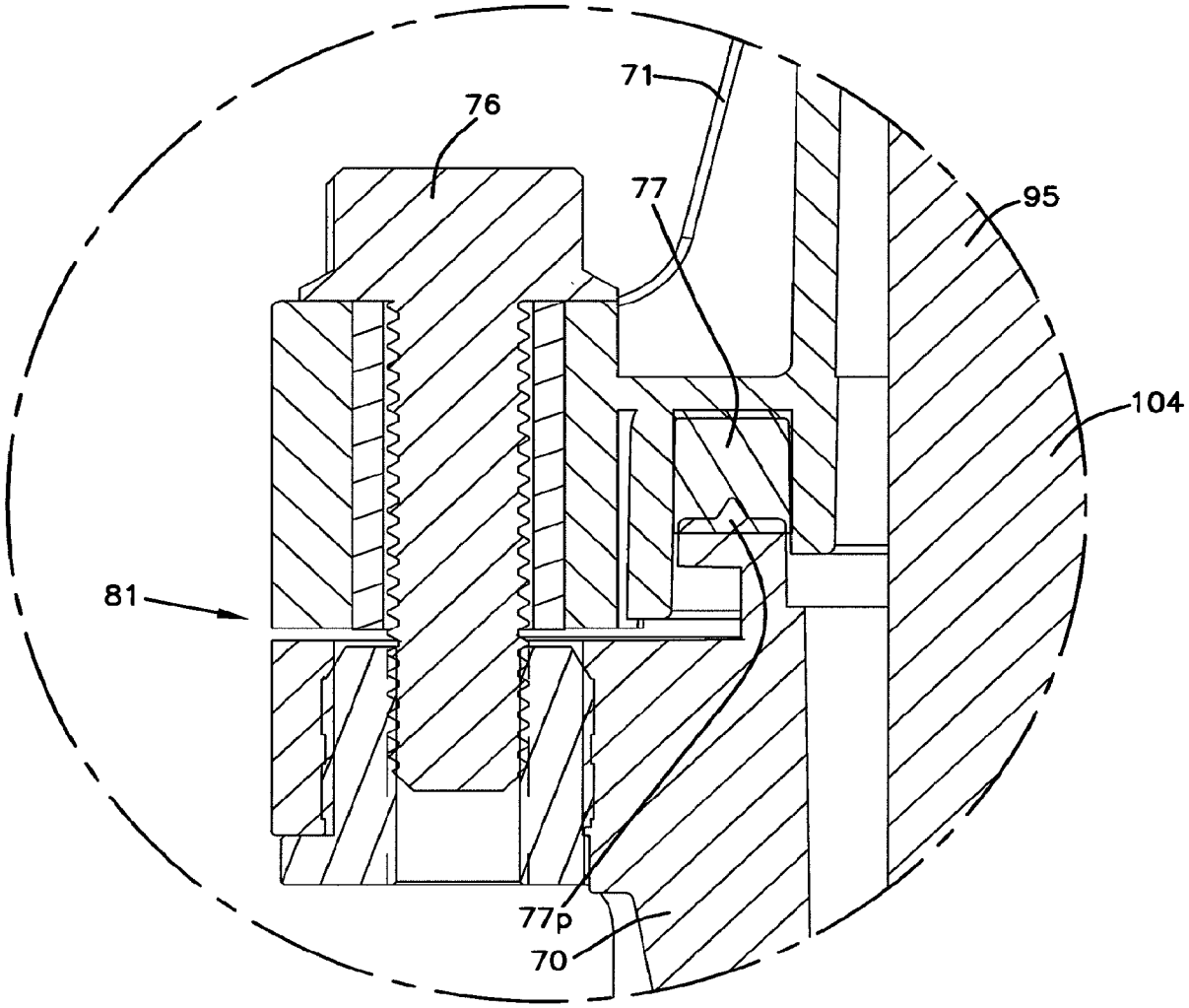
Figure 8B:
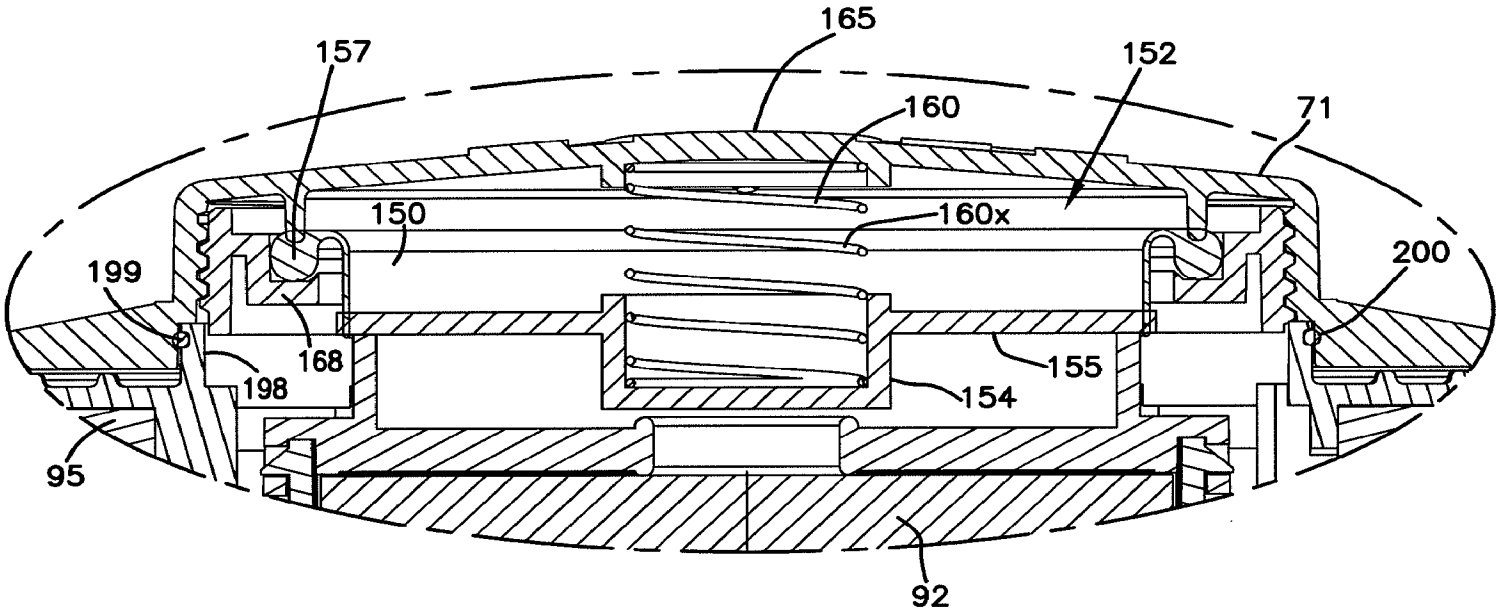
Figure 8C:
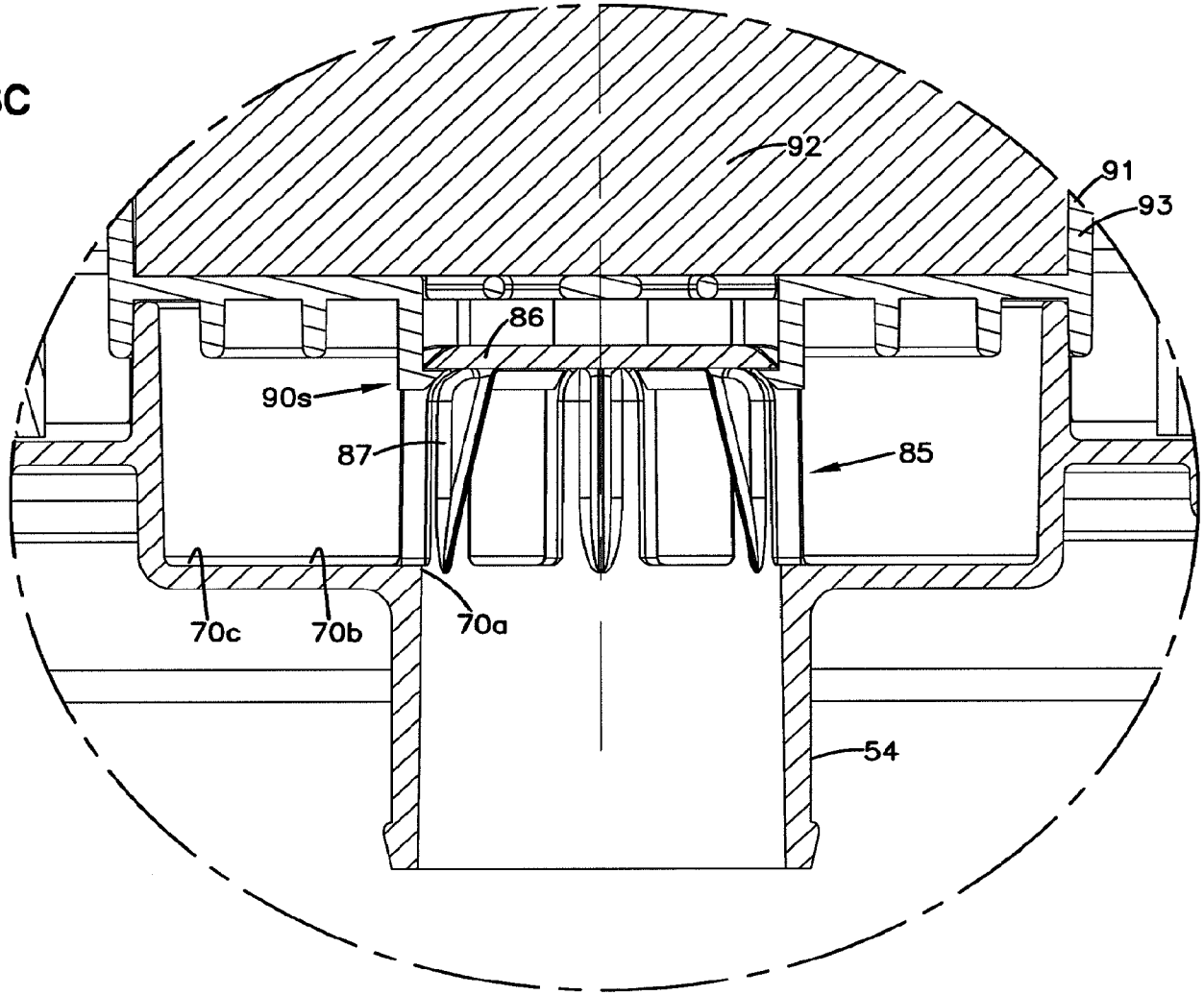
Figure 8D:
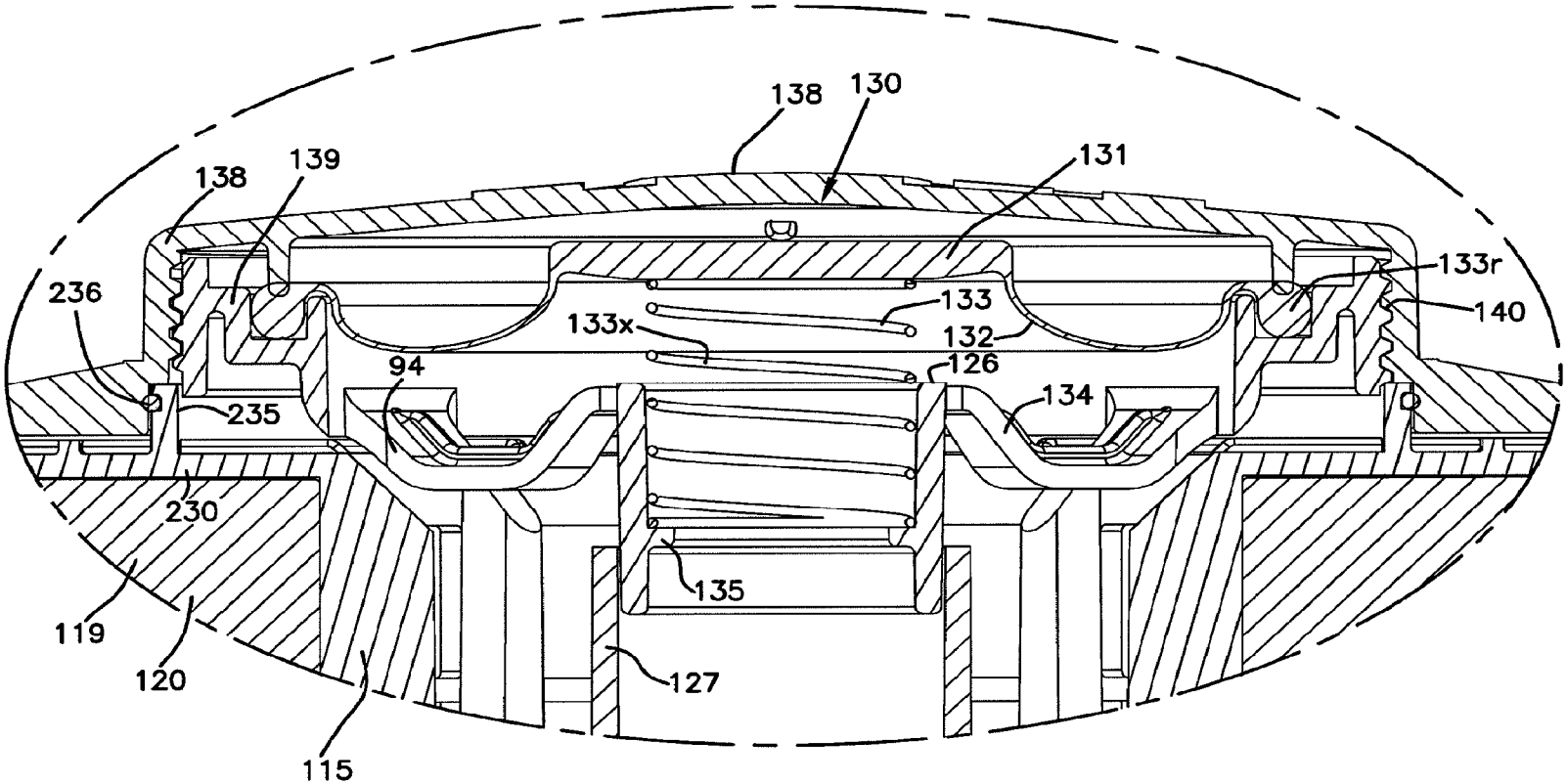

Attention is now directed to FIG. 8, a planar cross-sectional view otherwise generally analogous to FIG. 7. Selected detail not previously referenced in connection with FIG. 7 can be understood by reference to FIG. 8. Attention is first directed in FIG. 8 to vacuum limiting regulation (regulator) valve arrangement 130. The valve arrangement 130 comprises a central valve member 131 supported by a flexible rolling valve mount 132, secured in place by rim 133*r*. The valve member 131 is positioned over inlet 126 to central flow tube 127. Control of the positioning of central member 131 is provided by biasing arrangement 133, in this example instance comprising coiled spring 133*x*. In the example assembly depicted, the spring 133*x* is positioned over upper portion 127*u* of central flow tube 127. The coiled spring 133*x* extends between shelf 135, in tube 127 and central valve portion 131. The spring 133*x* is chosen so that it will tend to hold the valve 130 open, to gas flow over end 127*u* of tube 127, a selected amount. However a vacuum draw on tube 127, through outlet 55, FIG. 7, will tend to draw the central valve member 131 against the biasing arrangement 133, closing the amount of open space for gas flow over end 126. Should the vacuum draw at outlet 55 reach a sufficient level, valve member 131 can, in some applications, completely bias against end 126 closing the tube 127. It can be seen then that regulation will thus occur to gas flow into tube 127, in spite of fluctuation at gas flow at outlet 55. This will help inhibit transfer of undesirable levels of vacuum through the housing 15 to the crankcase.

Still referring to FIG. 8, spaced radial struts, or support members, 134 are shown supporting end portion of tube 127. Further, it can be seen that end portion 126 comprises a piece separately formed from a lower portion 1271 of tube 127.

Also referring to FIG. 8, it can be seen that the access cover 71 includes, as part of vacuum limiting regulation (regulator) valve assembly 130, a cover section 138, and inner piece 139, separable from one another, by threaded engagement 140, with cover section 138 being part of cover 70. The rim 133*r* of the valve rolling valve member 132, is captured between selected portions of cover 138 and inner portion 139, secured in place. It is noted that radial supports 134 and end portion 126 of tube 127 can comprise portions of inner piece 139.

It is noted that in FIG. 8D an identified portion of FIG. 8, including vacuum limiting regulation (regulator) valve arrangement 130, is depicted in enlarged fragmentary view with portions previously described indicated by similar reference numerals.

It is also noted that the vacuum limiting regulation (regulator) valve arrangement 130 is generally configured to have a "normal" open position; i.e. biasing member 133 biases the valve open, when the system is shut-off.

Referring again to FIG. 8, attention is directed to liquid collection region 128 in phase or region 61. With gas flow through media 120 going outside to inside, generally coalesced liquid will be moved along with the gas flow. It is desirable to provide for a drainage of the liquid as rapidly as possible from the media 120 and into collection region 128. To facilitate this, generally the cartridge 115 is provided with a bottom drain arrangement in region 144, discussed below in connection with FIGS. 15 and 16. Such a bottom drain arrangement would generally comprise an outlet flow path for liquid directly downwardly from a portion of the media pack 119, i.e. the media 120 therein, at regions adjacent the open interior 121.

Referring still to FIG. 8, attention is now directed to the first phase or region 60 and in particular to filter cartridge 95. Here, it will be recalled, gas flow is generally from interior to exterior with filtering. Thus, at 150 a drain flow arrangement is provided, allowing for direct oil drainage downwardly from media 105 of the cartridge 95, at a location generally adjacent, and extending inwardly from, an outer perimeter 105*p* of the media 105. This allows direct oil drainage into region 110. Analogously to drainage arrangement 144, drainage 150 arrangement can be constructed in accord with principles generally described in WO 2007/053411. It is discussed further below, in connection with FIG. 13.

Attention is still directed to FIG. 8 and in particular to backpressure limiting regulation (regulator) arrangement 100. The backpressure limiting regulation valve arrangement 100 comprises an assembly 152 including a valve member 155 with a peripheral rolling support 156 having a peripheral rim 157. The roiling support 156 allows the valve member 155 to be raised and lowered relative to upper ring or valve seat 158. The upper ring or valve seat 158 generally comprises a ring projecting from housing 91 upwardly and in particular from top 100 upwardly. In FIG. 8, the valve member 155 is shown maximally lowered. The valve member 155 is depicted having a central cup 159, providing a receiver for biasing arrangement 160, in the example arrangement depicted comprising spring 160*x*. The spring 160*x* is shown in extension between cup 159 and cover 165.

The example biasing member 160 is configured to provide the regulator valve arrangement 100, with a "normal closed" orientation, as shown in FIG. 8. By this it is meant that when the engine system is shut-off, the biasing member 160 is positioned to bias valve member 155 to the closed orientation depicted. When the engine is run, and gases are directed into inlet 54, gas pressure will push member 155 away from seat 158 allowing gas flow over seat 158 and into the open interior 106 of cartridge 95. This gas can then pass through the media pack 104. Backpressure limiting valve arrangement 100, however, will close, protecting the engine against an undesirable pressure condition, should the engine pressure not be sufficiently large to keep the valve arrangement 100 open. This will, for example, inhibit transfer of vacuum within housing 50 through inlet 54 to the engine crankcase. It is noted that the in FIG. 8B, an enlarged fragmentary view of an identified portion of FIG. 8, is shown, with various ones of the features discussed above identified. It is also noted that rim 157 is secured between cover 165 and threaded inner member 169. Assembly can be provided by molding cover 71 with cover portion 165 therein, and threading in place inner member 169 with rim 157 (and thus valve member 155) and biasing member 160 appropriately positioned).

Attention is now directed to FIG. 8A, an enlarged fragmentary view of a selected portion of FIG. 8. Here at 77, a gasket or around a perimeter of housing 50, between housing pieces 70, 71 is shown. Upward rim projection or fin 77*p*, facilitates sealing by passing into gasket 77.

Attention is also directed to FIG. 8C, an enlarged fragmentary view of the selected portion of FIG. 8. Here features previously described are shown. The snap-fit between cap 91 and support 87 is shown at 90*s*.

Referring back to FIG. 8, as previously discussed in some instances, it may be desirable to provide a vent valve, to allow rapid release of pressure developing within housing 50, for example within phase or region 60. This can be provided by including either: a second opening stage in valve assembly 100; or, a tap, for example communicating with region 106 as shown at 106*x* for communication with such a vent or bypass valve. A specific bypass valve is not depicted, but can generally use conventional principles.

Figure 9:
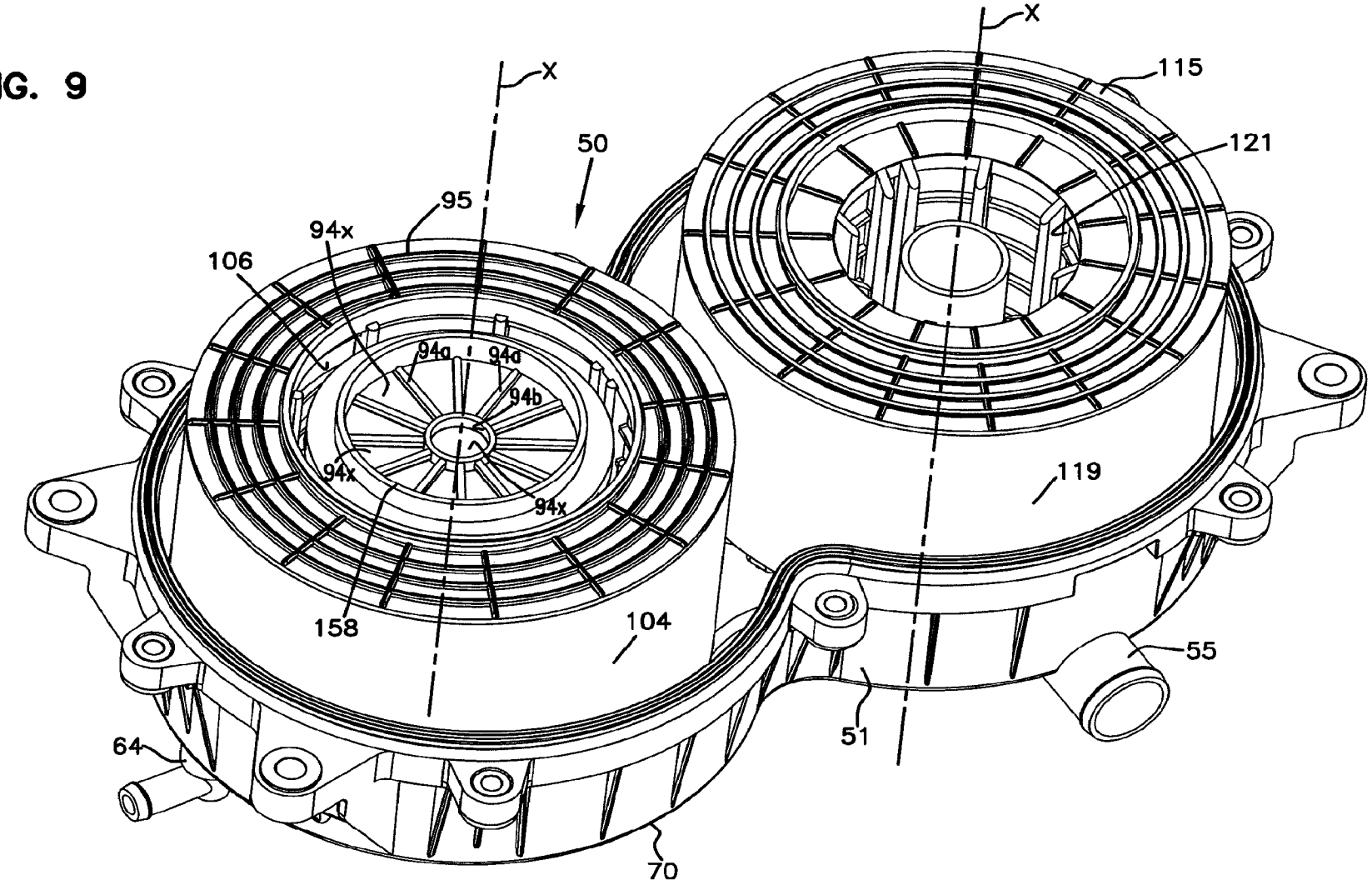
FIG. 9 is a schematic top perspective view of the assembly of FIGS. 1-8, with an access cover removed.

Attention is now directed to FIG. 9. In FIG. 9, assembly 50 is depicted with access cover 71 removed. It is noted that removal of the access cover 71 would have inherently involved removal of the valve arrangement 100 and valve arrangement 130, when the assembly 50 is as described in connection with FIG. 8. In FIG. 9, cartridge 95 and cartridge 115 can be seen. Each generally includes a media pack (104 and 119) respectively, surrounding an open filter interior (106 and 121 respectively). Thus, each can generally be said to have a central axis X. The two axes X, in the example assembly 50, can be characterized as being positioned generally laterally to one another, i.e. not coaxially. Alternately, stated, the two cartridges 95, 115, in the example depicted, are positioned side-by-side and spaced from one another, the side-by-side orientation leaving the media packs 104 and 119 respectively, facing one another. This preferred orientation, which is distinguished, for example, from a coaxial orientation, provides for an advantageous system at least with respect to: height requirements; and, servicing.

In FIG. 9, at 158, the valve seat or ring for valve member 155, FIG. 8, is shown projecting upwardly from housing 91 of breather 90. Also viewable in FIG. 9 is top 94 of breather 90, including central ring 94*b* and spaced radial spokes 94*a*. Regions 94*x* are open to gas flow therethrough.

Figure 10:
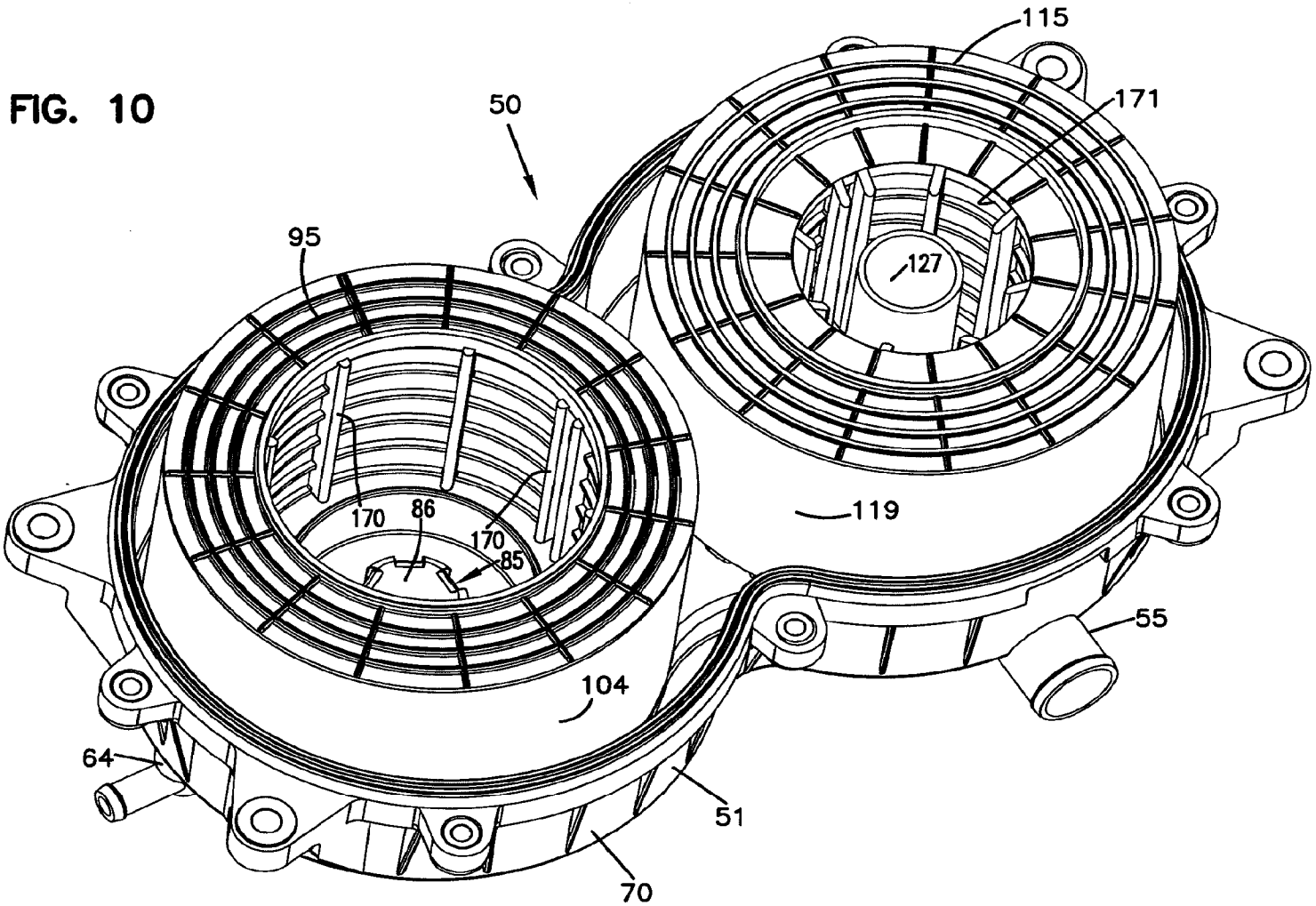
FIG. 10 is a schematic view analogous to FIG. 9, but without a coalescer, breather, pack present.

In FIG. 10, a view analogous to FIG. 9, is provided, but with breather 90, FIG. 9, removed. It s noted that normally the breather 90 would not be removed once installed. The removal with respect to FIG. 10, is to facilitate viewing of internal detail. In particular, referring to FIG. 10, inner liner 170 of the media pack 104 for cartridge 95 is shown. Also viewable is inner liner 171 of the media pack 104 for cartridge 115. Inertial impact plate 86 of inertial impact arrangement 85 is also viewable; and, tube 127 is viewable.

Figure 11:
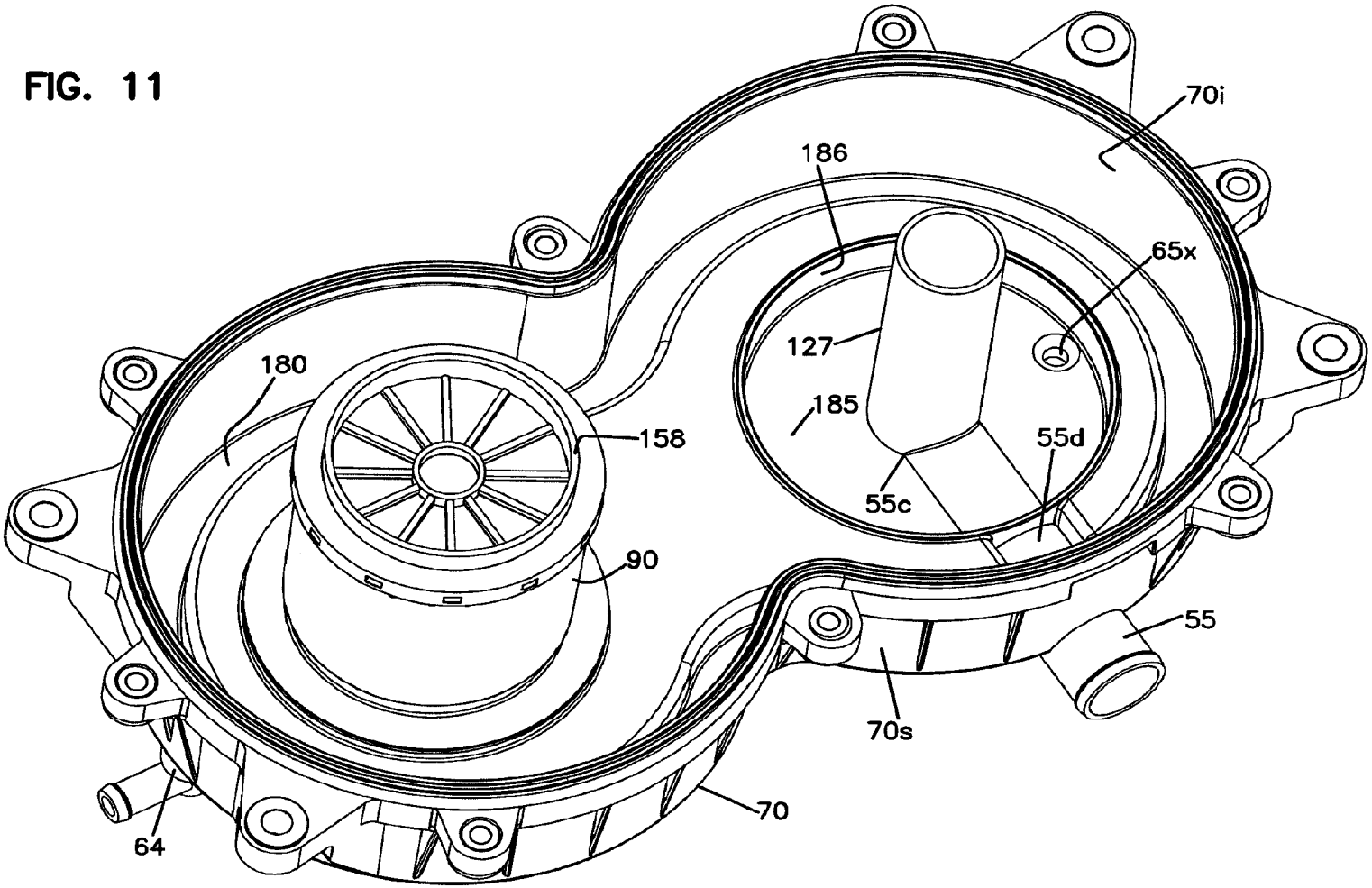
FIG. 11 is a schematic view analogous to FIG. 9, but with two serviceable filter cartridges removed, and with a coalescer, breather, pack no present.

In FIG. 11, housing bottom 70 is depicted with both cartridges 95, 115, removed. The depiction in FIG. 11 is generally how the housing bottom 70, would appear, if indeed both cartridges 95, 115 had been removed for servicing. As discussed below, it is anticipated that in some instances, the two cartridges 95, 115 would not be serviced at the same time. Referring to FIG. 11, breather 90 is depicted. Also, viewable in FIG. 11 are selected features previously discussed, indicated by similar reference numerals. Perimeter trough 180 is viewable in FIG. 11. Perimeter trough 180 generally is positioned in interior 70*i* of bottom 70, along an outer perimeter thereof, just inside of an outer sidewall 70*s*. The trough 180 provides a drain "communication" with first liquid drain outlet 64 (and region 110, FIG. 8). Thus, trough 180 provides a conduit for liquid collected within interior 70*i*, generally downstream from the first cartridge 95 and upstream from the second cartridge 115, to outlet 64.

In FIG. 11, at 65*x* an outlet to drain 65 is depicted, positioned within central depression 185 in housing bottom 70. The depression 185 is rimmed by sidewall 186 which, as discussed below, is a surface against which cartridge 115 seals. Recess 185, then, comprises a collection region for liquid from cartridge 115 to be directed to outlet 65, through aperture 65*x*.

Figure 12:
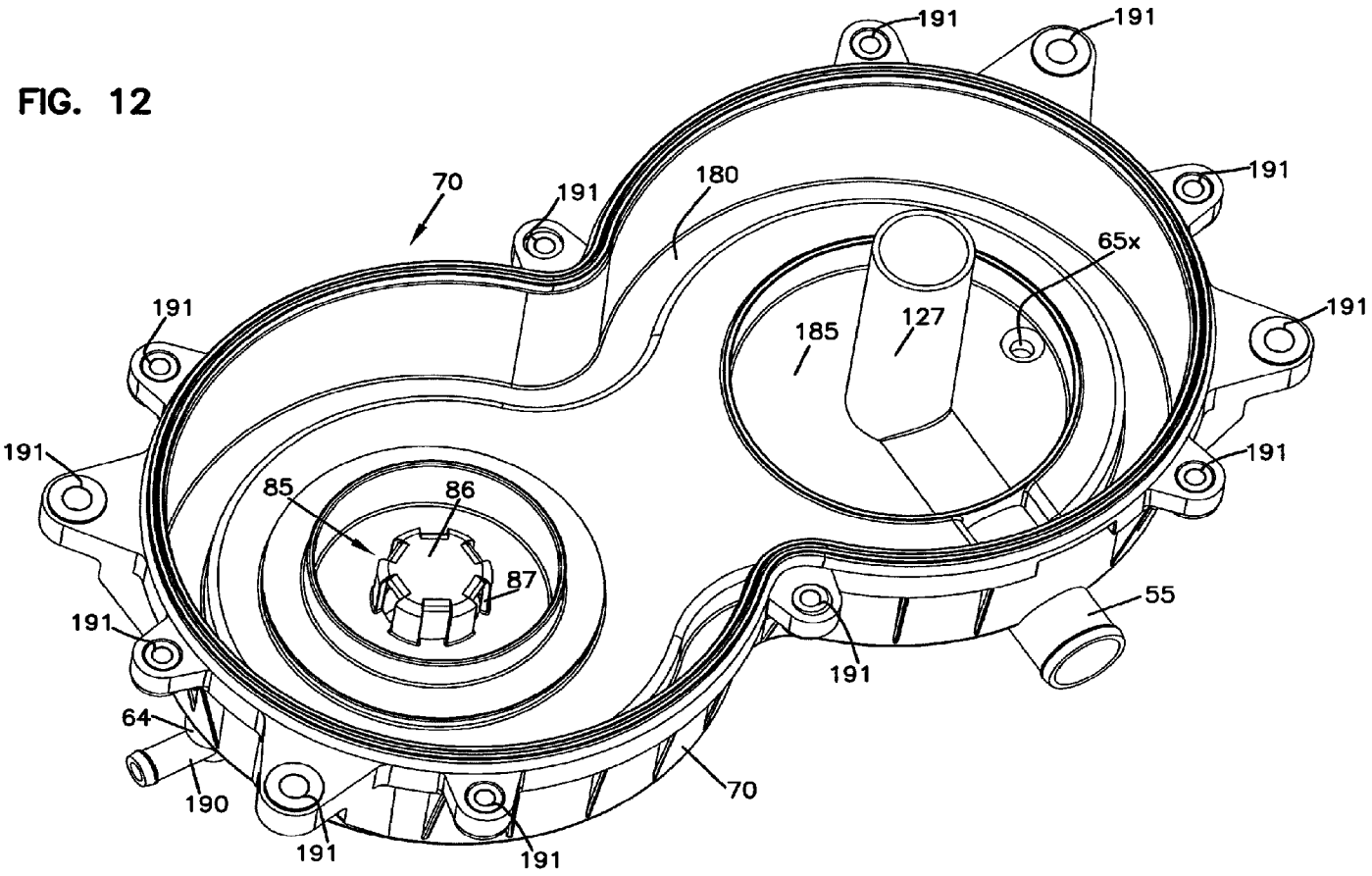
FIG. 12 is a schematic view analogous to FIG. 11, but with a coalescer, breather, pack removed.

In FIG. 12, housing bottom 70 is viewable, with even breather 90 removed. Normally breather 90 would not be removed, once installed. Thus, in FIG. 12, bottom 70 generally appears, except for various fittings, as it would look when molded. Of course fittings are provided, as shown at 190 for drains, and fittings are provided at 191 for either securing the assembly to equipment when mounted, or to facilitate closure of cover 71.

Figure 13:
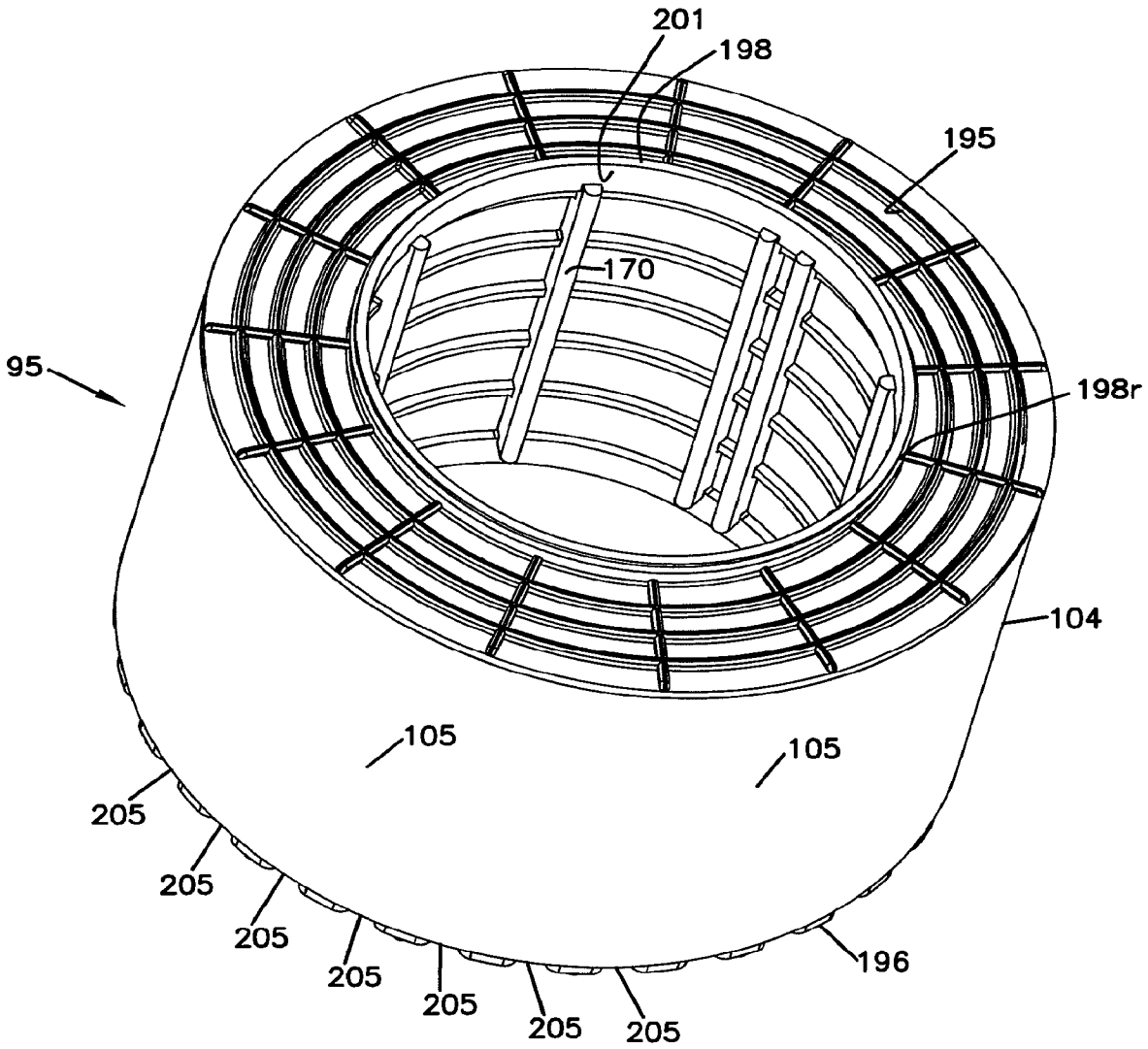
FIG. 13 is a schematic top perspective view of a first, serviceable, filter cartridge useable in the assembly of FIG. 3.

In FIG. 13, a top perspective view of cartridge 95 is shown. It can be seen as having media 105 positioned around inner liner or support 170 between first and second end pieces 195 and 196, respectively. End piece 195 forms an upper end piece in the example orientation of use depicted in FIG. 7. At 198 is provided a support for a housing seal member. The housing seal member can be positioned on support 198, for example to form a radially directed seal. The particular support 198 depicted, is configured to support a radially outwardly directed seal member at region 198*r*. Such a seal member is depicted in FIG. 8B, for example, at 199. The seal member 199, depicted as a radially outwardly directed seal, for sealing against region 200 in access cover 71, can, for example, comprise an o-ring, although alternatives are possible.

Referring back to FIG. 13, typically end piece 195 will be impermeable to gas flow therethrough, except through central aperture 201.

Second end piece 196 for a typical orientation, will be a bottom end piece. At 205 are shown spaces in axial overlap with media 105, adjacent outer perimeter 105*p*. These spaces 205 allow for direct drainage downwardly of coalesced oil, from media 105. It is also noted that apertures can be positioned in end piece 106 in direct axial overlap with media 105 to facilitate drainage. Typically, any such apertures would be at a downstream of media stage, discussed above, when used. Typically end piece 196 will include the support for a seal. One is shown, for example in FIG. 8 at 210. Here the seal member is also radially directed, but in this instance the seal member 211 is radially inwardly directed to seal against rim 212 in bottom 70. An o-ring can be used for seal member 211, although alternatives are possible.

Figure 14:
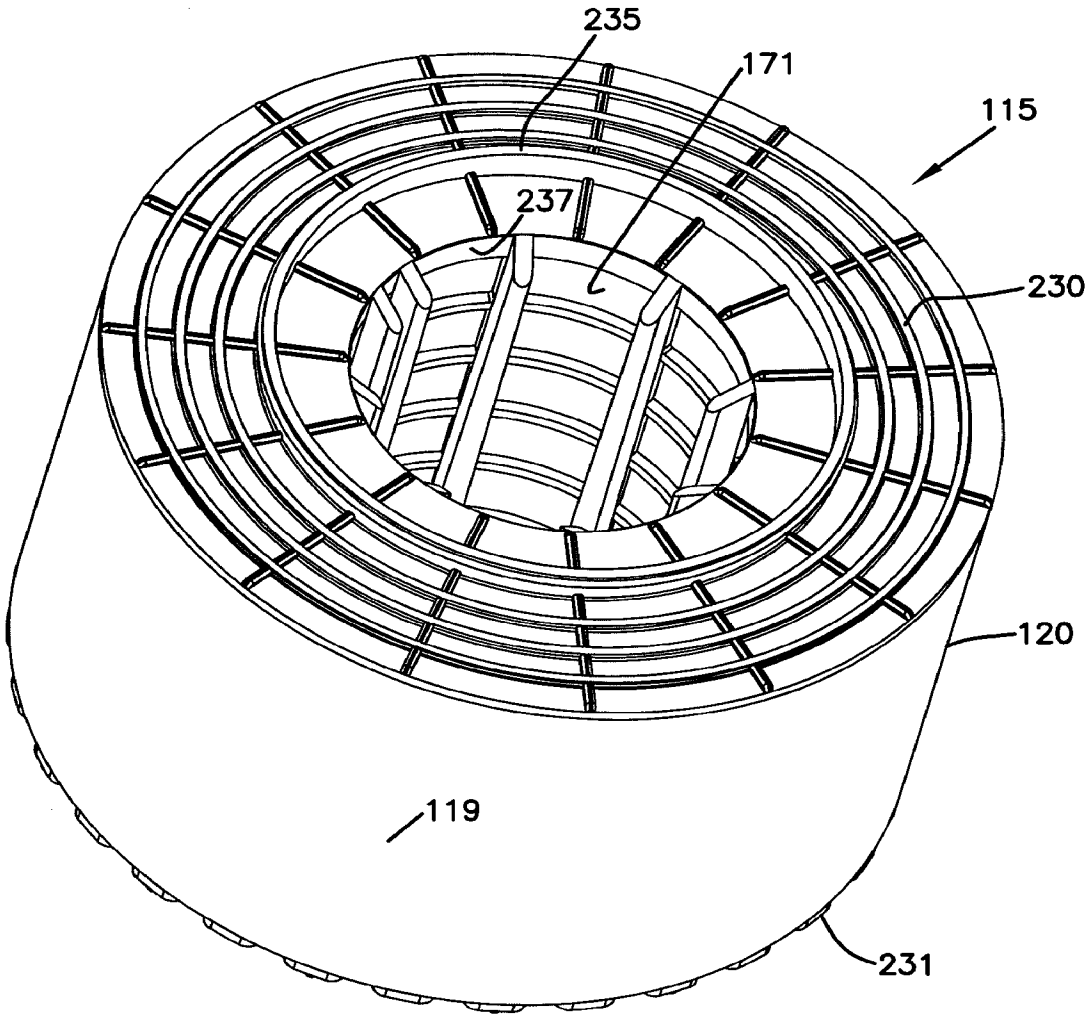
FIG. 14 is a schematic top perspective view of a second serviceable filter cartridge used in the assembly of FIG. 3.

In FIG. 14, a top perspective view of cartridge 115 is provided. In general the cartridge 115 comprises media 120 positioned around central support 171 in extension between first and second end pieces 230 and 231, respectively. End piece 230 for the cartridge 115 depicted, is an upper end piece in the orientation of the view shown in FIG. 8. Included on end piece 230 is a seal support 235, projecting away from media 120 and end piece 231 configured to support a radially directed housing seal member. Here, the seal member is indicated at 236, FIG. 8D, and comprises (in the example depicted) a radially outwardly directed seal member, for example an o-ring. End piece 230 is typically solid and impermeable except for central aperture 237, FIG. 14.

Figure 15:
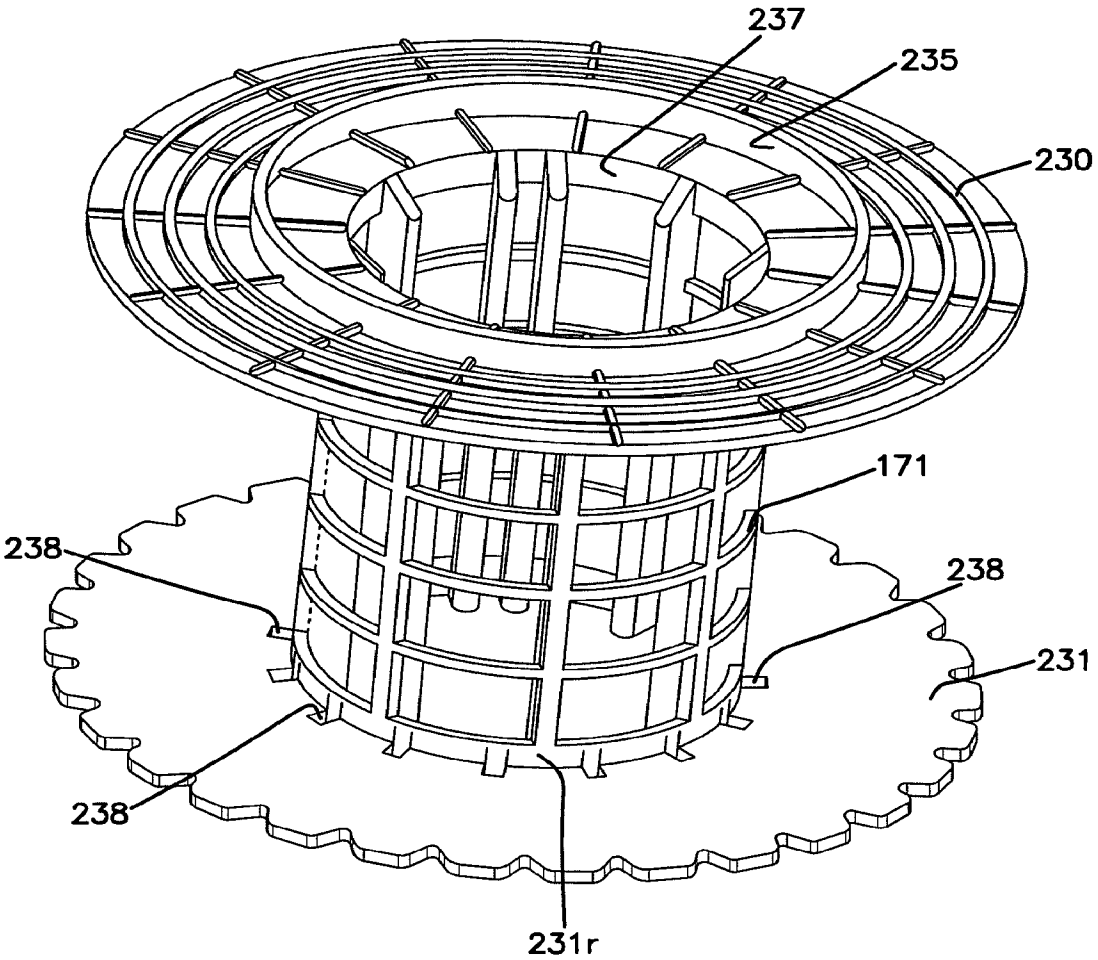
FIG. 15 is a schematic top perspective view of a component of the filter cartridge depicted in FIG. 14.

The second end piece 231 for the particular cartridge 115 depicted, is generally a bottom end piece in use. Referring to FIG. 15, bottom end piece 231 can be seen as having an inner perimeter 231*r* adjacent support 171, having apertures 238 therein, and also adjacent support 171. Apertures 238 are drain apertures, allowing for direct drain flow downwardly from media 120, FIG. 14, adjacent support 171.

Referring to FIG. 15, for the example cartridge depicted, end pieces 230 and 231, and center support 171 can comprise integral portions of a single molded (plastic) piece.

End piece 231 would typically also include a housing seal support thereon, for example as indicated at FIG. 8 at 240. This seal support tube is configured to support a radially directed seal, in this example instance an outwardly directed radial seal member indicated generally at 241 which can comprise for example an o-ring. In general, seal member 241 seals against wall 186, FIG. 11.

Preferably, the two cartridges 95, 115 are configured so that they cannot be interchangeably mounted. That is, each is configured so that it can only be mounted where intended. This can be accommodated for example, by providing different size seals and different direction of seal in at least some instances, on the cartridges. Further, it is noted that support 107 of cartridge 95 generally defines a larger open cross-sectional area, than does support 171 of cartridge 115. Preferably the cross-sectional opening of support 171 is sufficiently large, so that cartridge 115 cannot be slid over breather 90, when present. This too would prevent inadvertent positioning of cartridge 115 other than where intended, during servicing.

It is noted that one or more of the housing seals can be positioned on housing surfaces rather than on cartridges.

Figure 16:
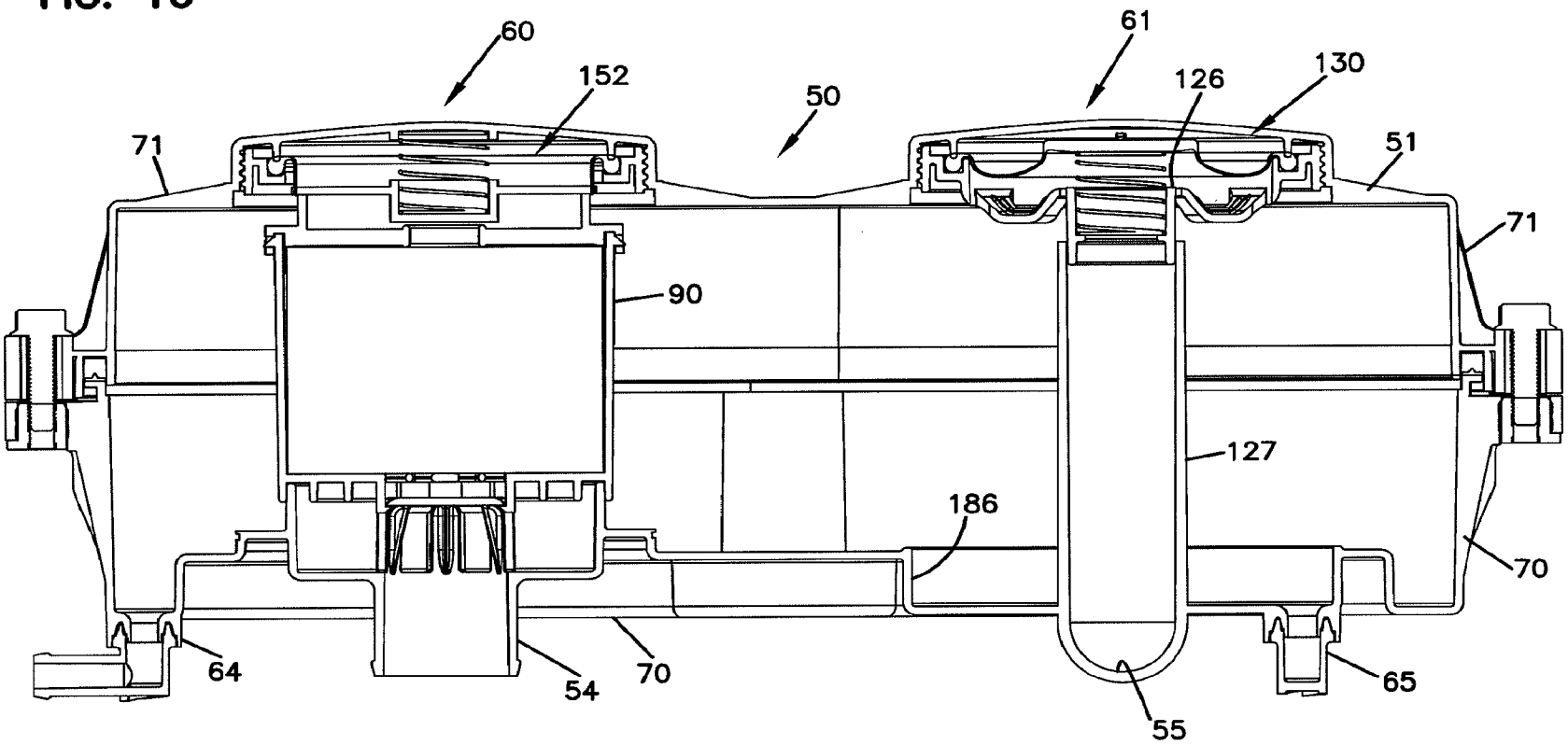
FIG. 16 is a schematic cross-sectional view analogous to FIG. 8, but depicting the assembly with removable, serviceable, first and second cartridges removed.

In FIG. 16, a side cross-sectional view of assembly 50 with cartridges 95, 115 removed, is shown. Selected features previously described are indicated by like reference numerals.

Figure 17:
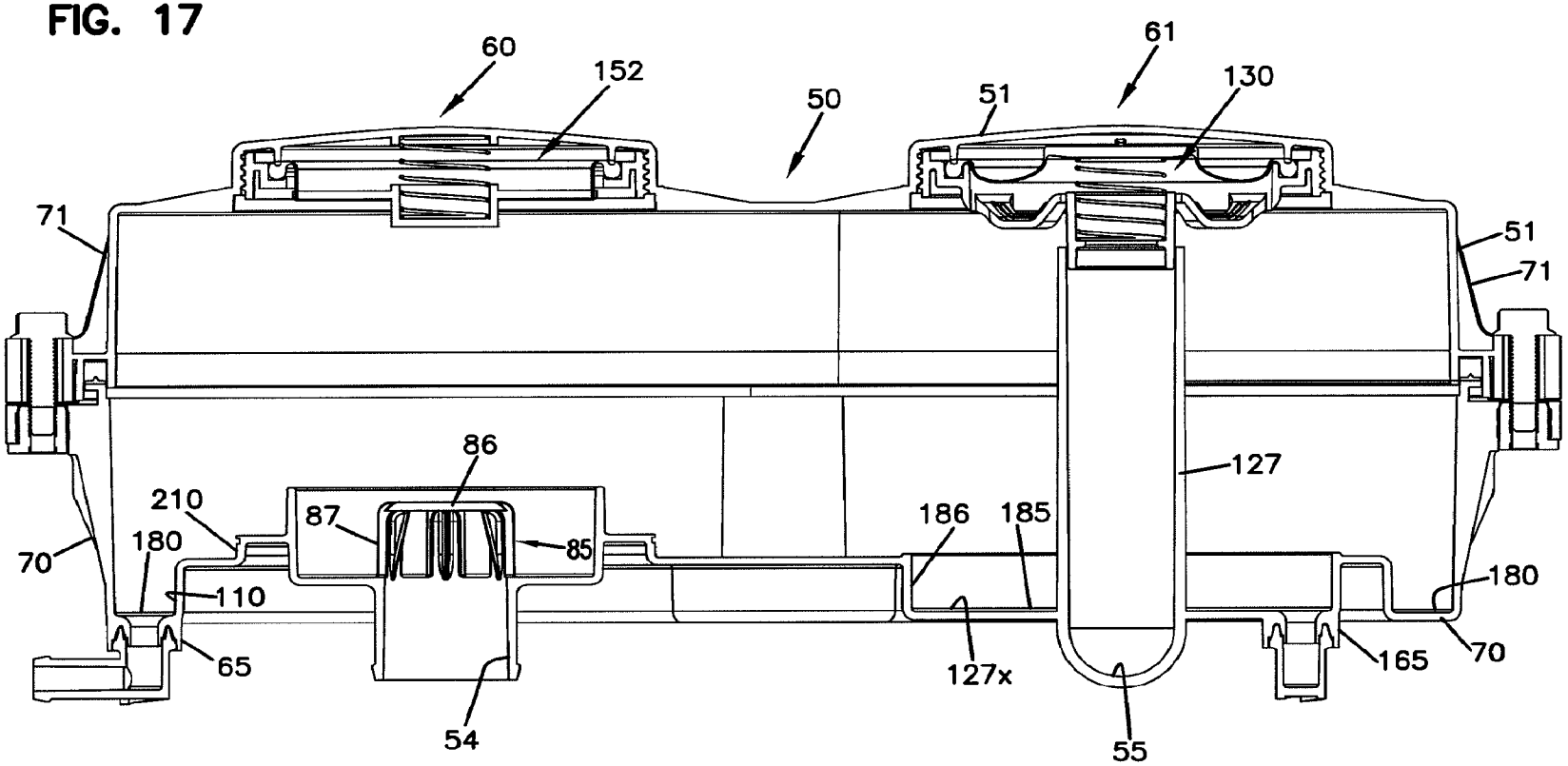
FIG. 17 is a schematic view analogous to FIG. 16, but depicting the assembly also with a coalescer, breather, pack removed.

In FIG. 17, a side elevational view analogous to FIG. 16 is shown except also showing breather 90 removed. Selected features previously characterized are shown by like reference numerals.

Figure 18:
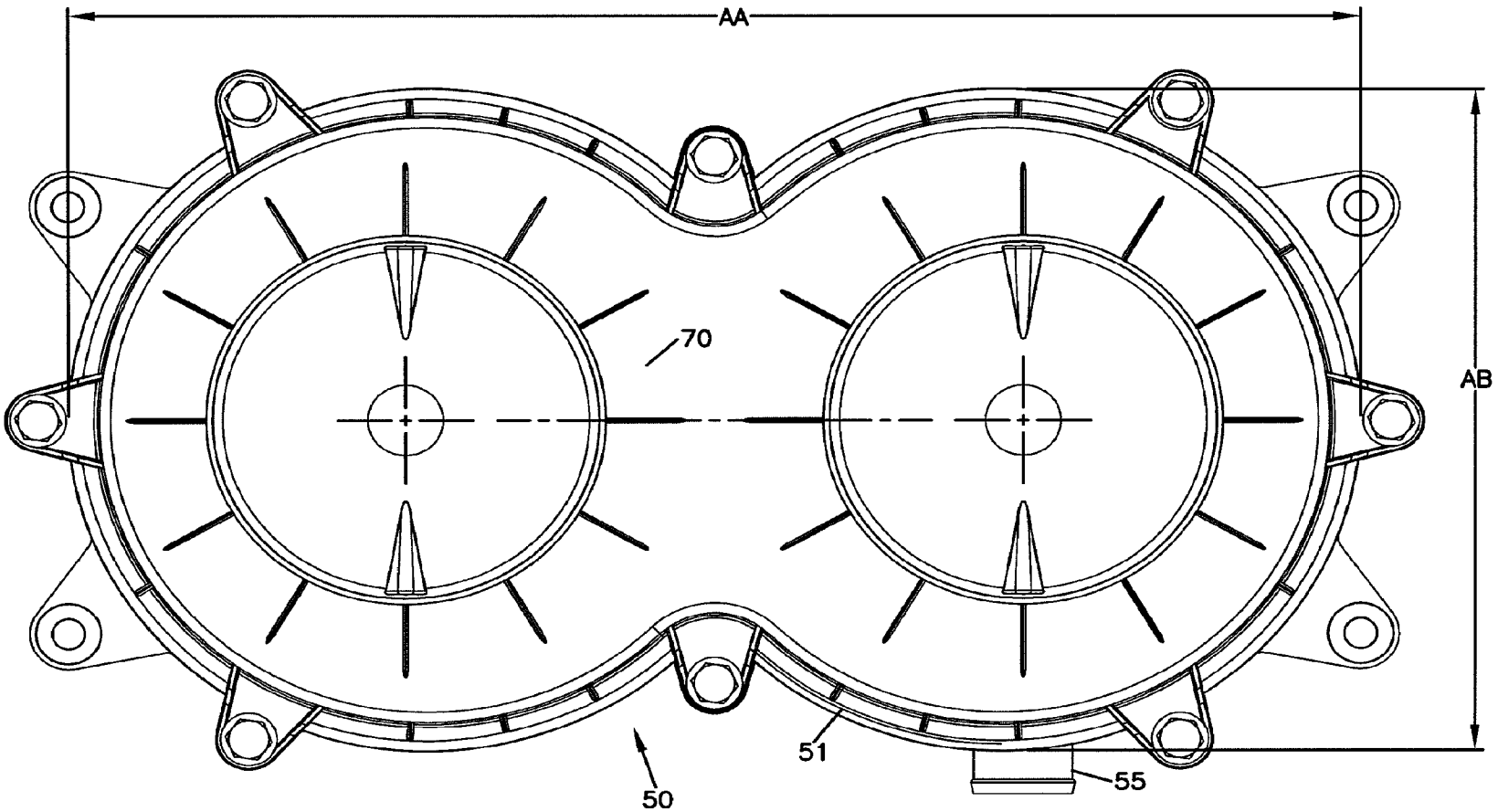
FIG. 18 is a schematic top plan view of the assembly of FIGS. 3-5, with example dimensions indicated.

In FIG. 18, a top plan view of assembly 50 is depicted. Example dimensions are indicated as follows: AA=410 mm; AB=228 mm. Of course alternate dimensions can be used. Other example dimensions can be determined from scale.

Figure 19:
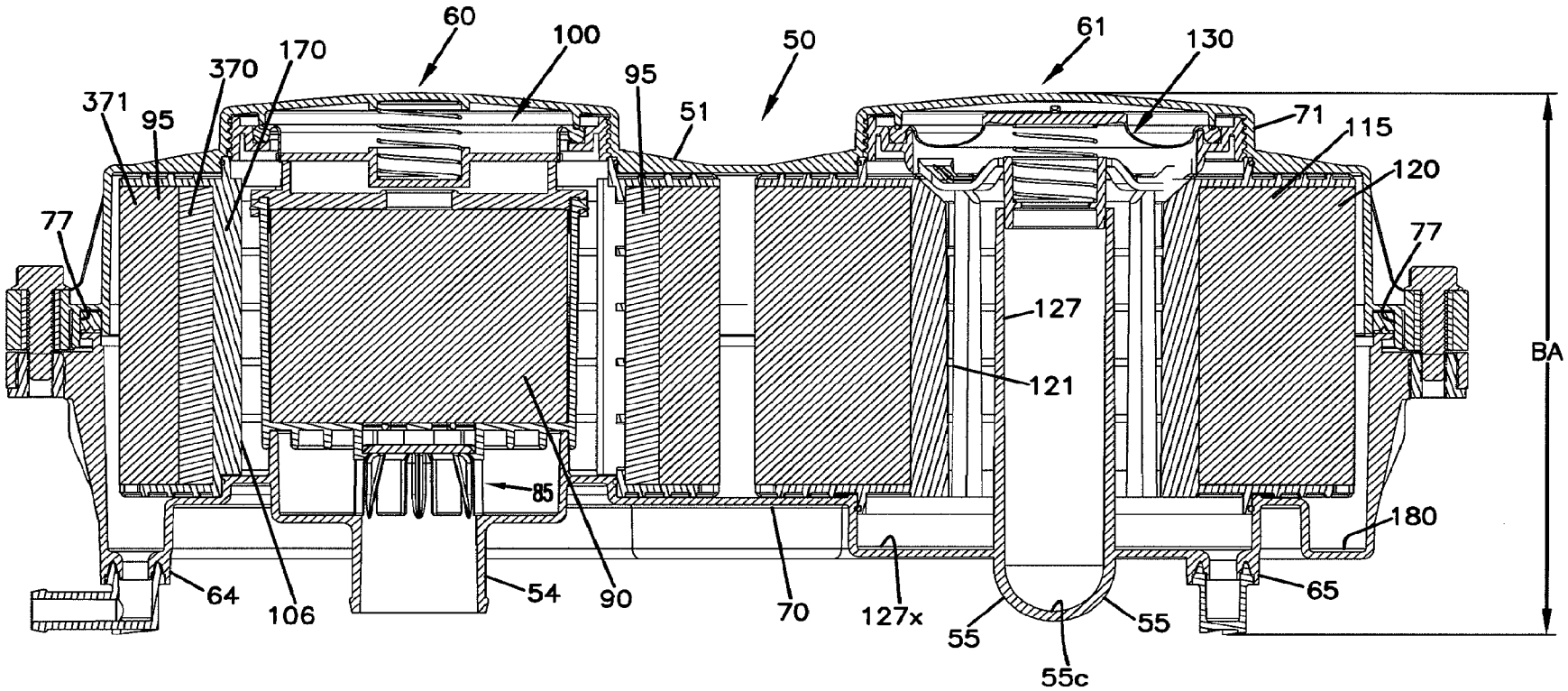
FIG. 19 is a schematic view analogous to FIG. 8, but with an example dimensions indicated.

In FIG. 19, a cross-sectional view analogous to FIG. 8 is depicted, with dimension BA indicated. An example system would have dimension BA=181 mm, with other dimensions being, generally, to scale.

Still referring to FIG. 19, it is noted that typically an overall vertical dimension of the assembly 50, in many instances, will be no more than about 225 mm, and typically 200 mm or less, allowing the assembly 50 to be preferably positioned on top of engine components or above engine components, in a variety of systems. Preferably, each of the outlets 55, 64 and 65, and inlet 54 are secured to a remainder of the housing 51 have a total downward projection of no greater than about 40 mm, typically no greater than about 30 mm, to advantage. Of course alternatives are possible; however, the relatively small downward direction of these components facilitates fitting it in an engine space, above selected engine components.

III. A Selected Engagement of the Crankcase Ventilation Filter Assembly 50 with an Engine Intake System, FIG. 20

Figure 20:
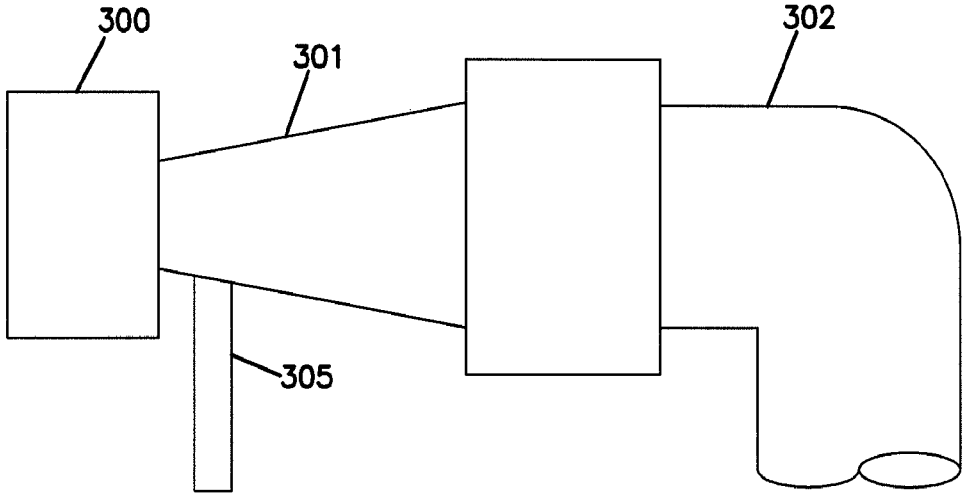
FIG. 20 is a schematic depiction of an air cleaner/turbo in-take venturi system, showing an inlet line to the venturi, from a crankcase ventilation filter system according to the present disclosure.

In some systems, it may be desirable to specifically direct gas outflow from outlet 55, FIG. 19, into an engine intake system comprising a venturi positioned between an air cleaner and a turbo system. Schematically, such an arrangement is shown in FIG. 20. Here, an engine air cleaner is indicated generally at 300, feeding air into venturi 301. The venturi 301 then feeds air into a turbo intake 302. Venturi 301 is depicted with a gas feed or tap 305 which serves as an inlet gas flow for gases drawn from an assembly such as assembly 50 through gas flow outlet 55.

Some engine families will benefit from using a venturi placed between the air intake filter and the turbo charger in order to boost turbo vacuum to maximize the decrease in pressure differential across the crankcase ventilation filtration system 50. This will be particularly important for engine families that allow very low crankcase pressure, and as such the venturi may be useful to ensure that more turbo charger vacuum is felt on the downstream end of the crankcase ventilation filter assembly 50.

Without a venturi system installed between the air intake filter and the turbo charger, the vacuum generated by the turbo charger will stay at fairly low levels and thus its impact to lower the pressure at the downstream end (outlet end) with the crankcase ventilation filter assembly would be very small. In such instances, the crankcase ventilation filter system may not adequately deliver a desired service interval.

Of course a vacuum limiting regulation (regulator) valve arrangement as previously discussed can be used to inhibit excess vacuum from being transferred to the cartridges 95, 115 during operation. Further, a backpressure limiting regulation (regulator) valve arrangement as previously described can be used to inhibit undesirable transfer of vacuum from outlet 54 to the engine crankcase.

It is noted that the assembly 401 described in communication with FIGS. 21-29 can also be used with the system of FIG. 20, with gas flow from assembly 401 directed as described at feed 305.

IV. A Single Phase Crankcase Ventilation Filter Assembly Having One Filter Cartridge and Using Selected Principles According to the Present Disclosure—FIGS. 21-29

Certain principles applied described herein can be applied in a crankcase ventilation filter system in which there is a provided a single filter cartridge as opposed to multiple cartridges. An example of such an application of principles will be understood by reference to FIGS. 21-30.

In particular, in connection with FIGS. 21-30, a crankcase ventilation filter assembly is depicted in which a backpressure limiting regulation (regulator) valve arrangement and a vacuum limiting regulation (regulator) valve arrangement are positioned advantageously and operationally, in a gas flow path of system in which a single service part, i.e. one replacement filter cartridge, is present.

Figure 21:
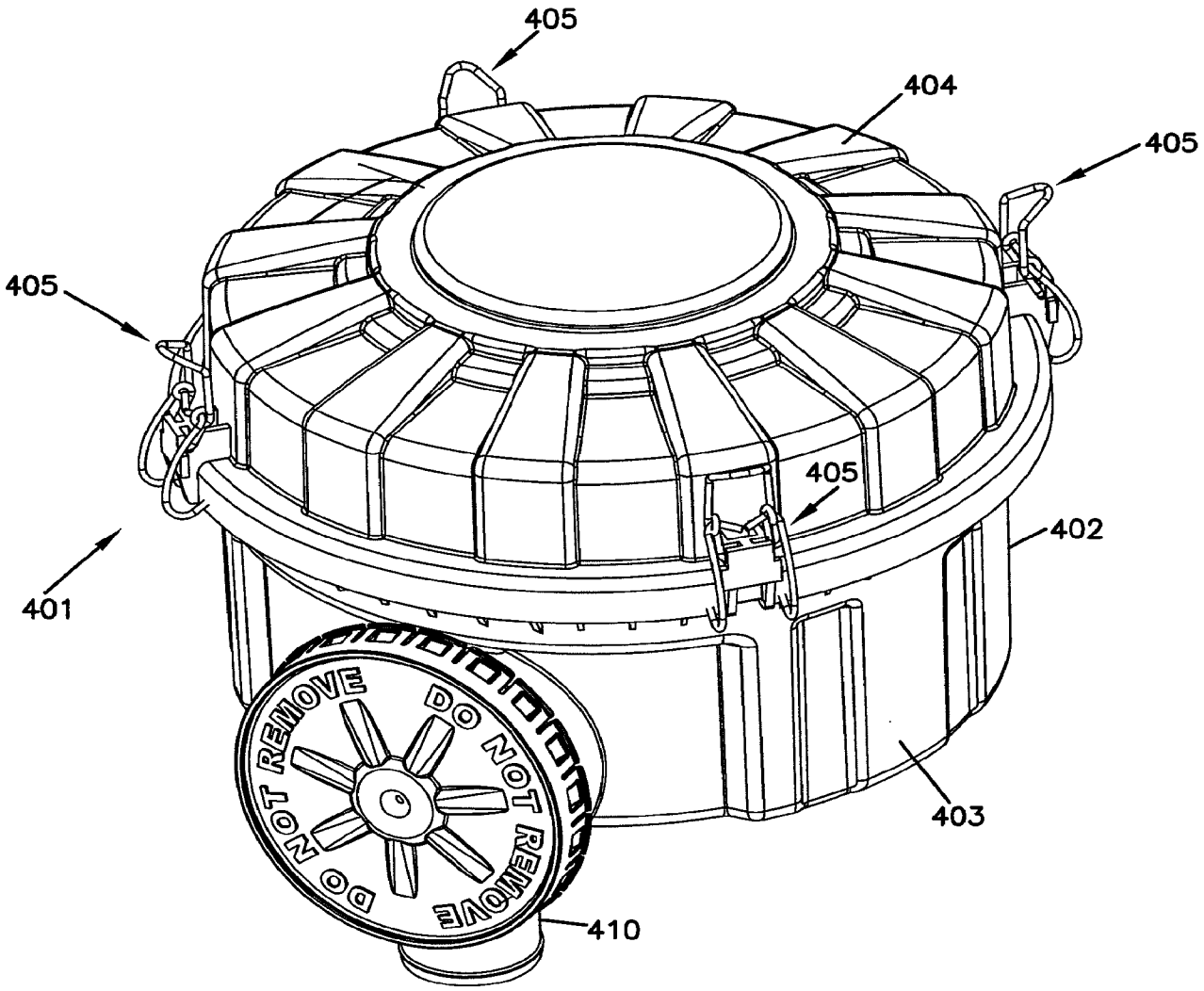
FIG. 21 is a schematic top perspective view of a crankcase ventilation filter system according to a second embodiment involving application of certain selected principles of the present disclosure.
Figure 27:
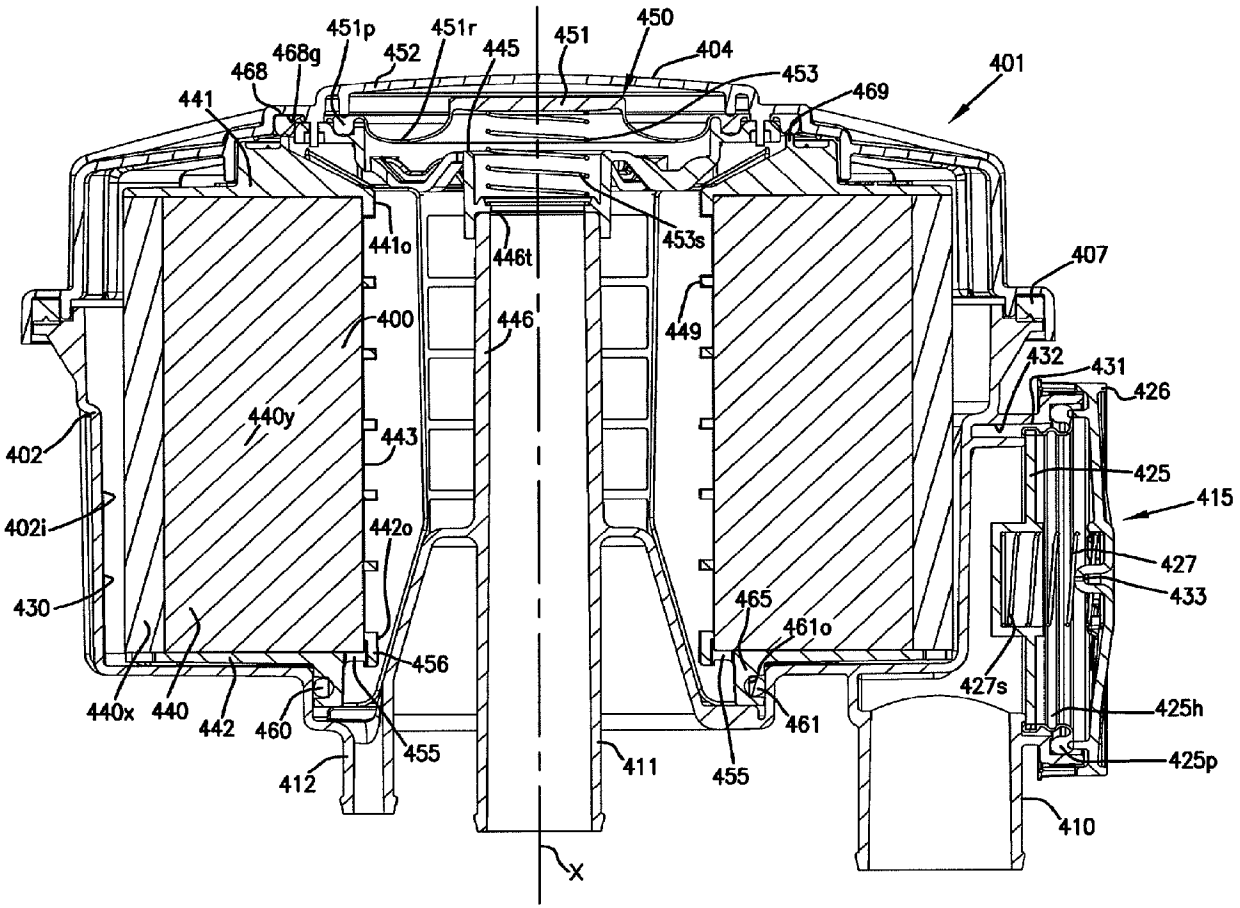
FIG. 27 is a schematic cross-sectional view taken generally along line 27-27, FIG. 26.
Figure 28:
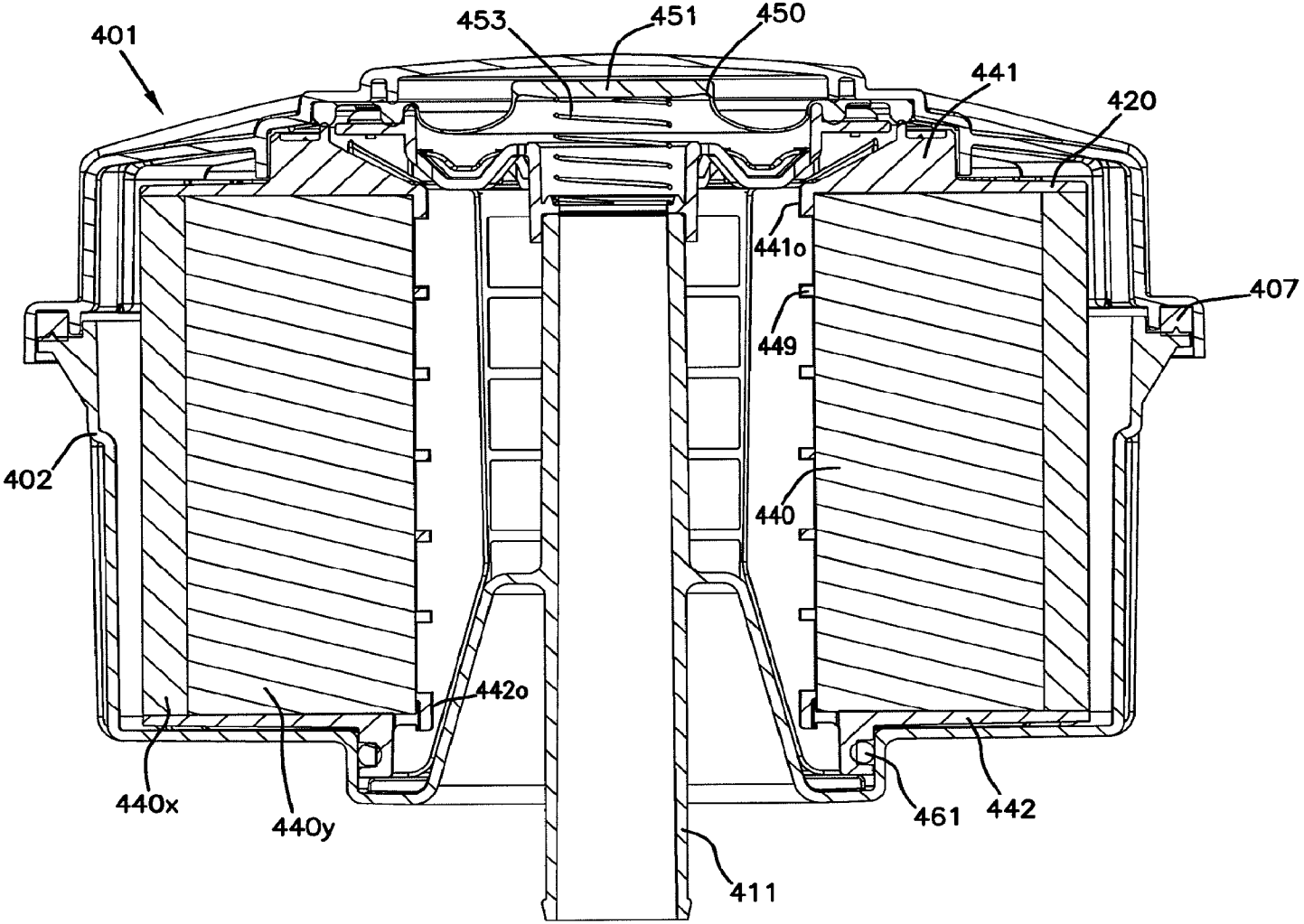
FIG. 28 is a schematic cross-sectional view taken generally along line 28-28, FIG. 26.

Referring first to FIG. 21 at 401, a crankcase ventilation filter assembly is depicted in accord with this embodiment. The crankcase ventilation filter assembly 401 generally comprises a housing 402. The housing 402 comprises a housing base or bottom 403 and removable service cover 404. For the particular example assembly 401 depicted, the service cover 404 is secured to the housing base 403 by latch arrangement 405 although alternative connection arrangements are possible, including for example threaded arrangements. In FIGS. 27 and 28, an optional gasket 407 is positioned between base 403 and cover 404.

Figure 22:
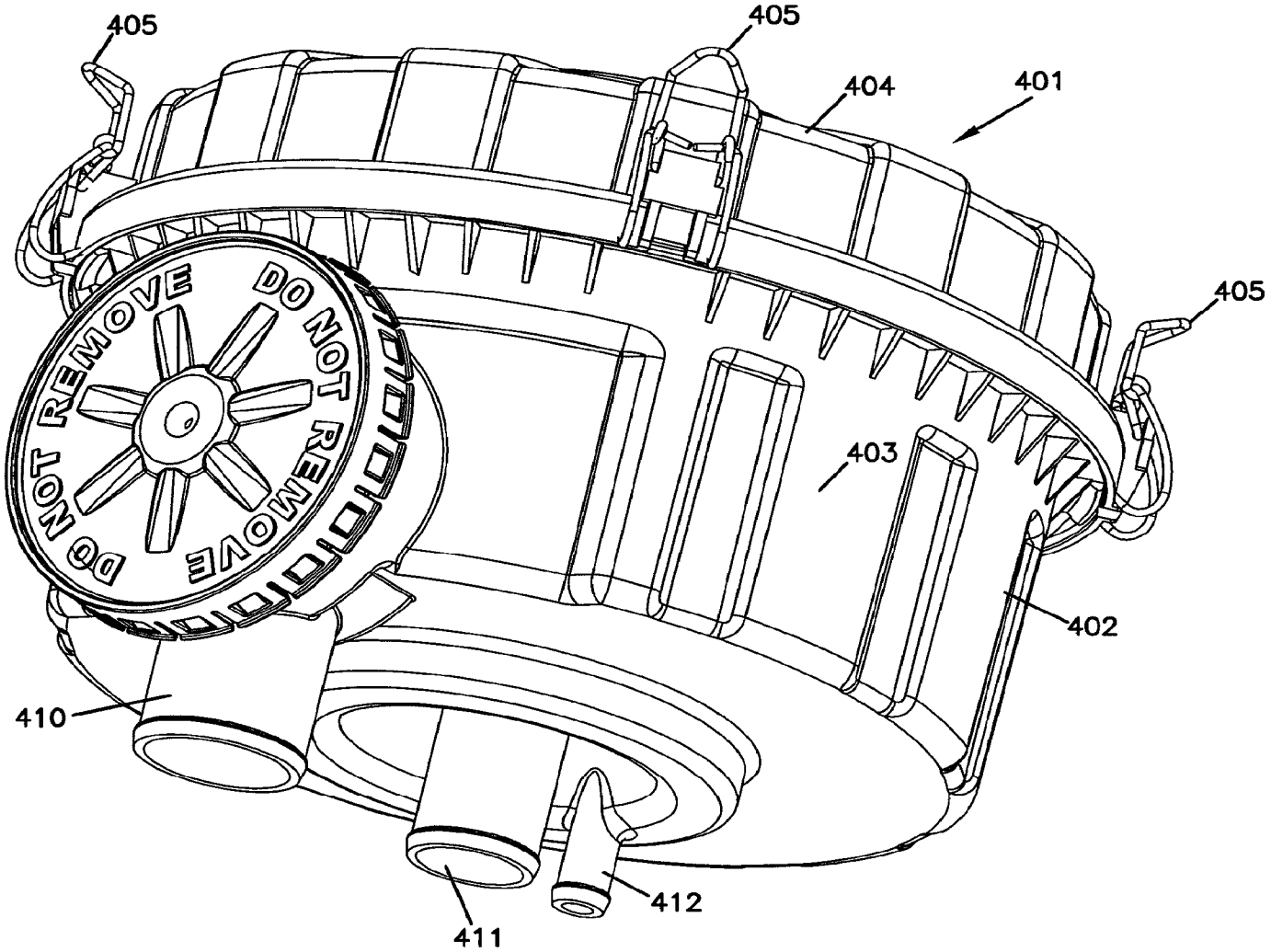
FIG. 22 is a bottom perspective view of a crankcase ventilation filter assembly depicted in FIG. 21.

Attention is now directed to FIG. 22, a bottom perspective view of the assembly 401. Referring to FIG. 22, crankcase ventilation filter assembly 401 includes: a gas flow inlet arrangement 410, a gas flow outlet arrangement 411 and a coalesced liquid outlet drain arrangement 412. It is noted that for the particular assembly 401 depicted: the gas flow inlet arrangement 410 is upwardly directed; the gas flow outlet arrangement 411 is downwardly directed; and, the liquid drain outlet arrangement 412 is downwardly directed. In typical variations, the liquid drain 412 will often be retained downwardly directed, as liquid drainage typically occurs via gravity, as described previously. However, in alternate applications, the gas flow inlet arrangement 410 and/or the gas flow outlet arrangement 411 can be alternately directed.

Figure 23:
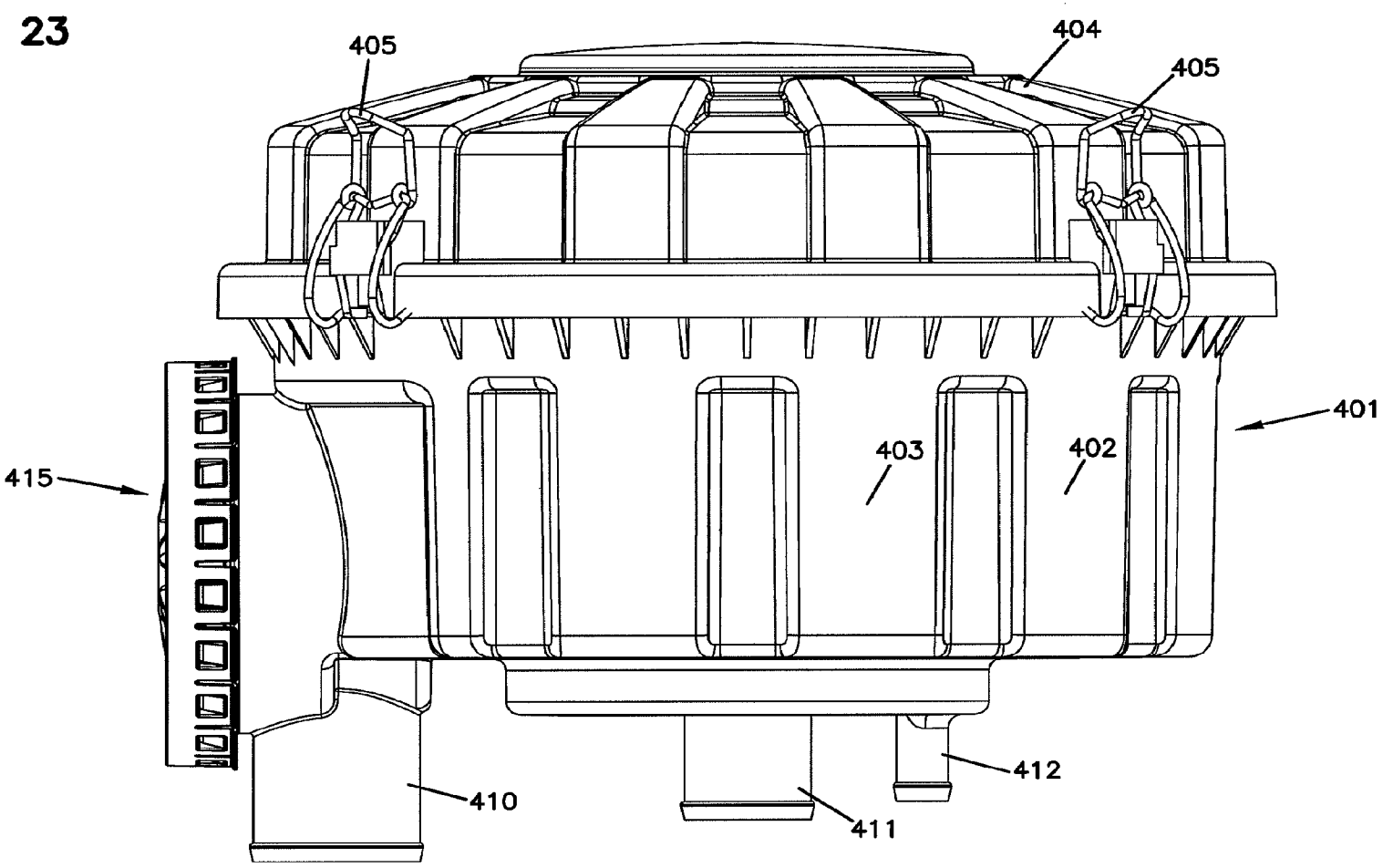
FIG. 23 is a first side elevational view of the crankcase ventilation filter assembly depicted in FIGS. 21 and 22.

Attention is now directed to FIG. 23, a side elevational view of the assembly 401. The assembly 401 includes features previously described as follows: housing 402 comprising base 403 and cover 404, the cover being secured in place by latches 405; and, gas flow inlet arrangement 410; gas flow outlet arrangement 411; and, liquid drain outlet arrangement 412.

Referring to FIG. 23, assembly 401 depicted includes a backpressure limiting regulation (regulator) valve arrangement 415 which regulates gas flow inwardly through housing 40 from gas flow inlet arrangement 410. In particular, the backpressure limiting regulation (regulator) valve arrangement 415 is configured and positioned in a gas flow path so that it will not allow gas flow from inlet 410 to pass through the housing 402, unless the pressure from engine crankcase is sufficient. Thus, the backpressure limiting regulation (regulator) valve arrangement 415 has a "normal closed" position and operates generally analogously to the backpressure limiting regulation (regulator) valve arrangement previously described for the embodiment of FIGS. 3-19. In general, they inhibit vacuum from being transferred from upstream location in the assembly 401 to the inlet 410 and thus to the engine crankcase.

Figure 24:
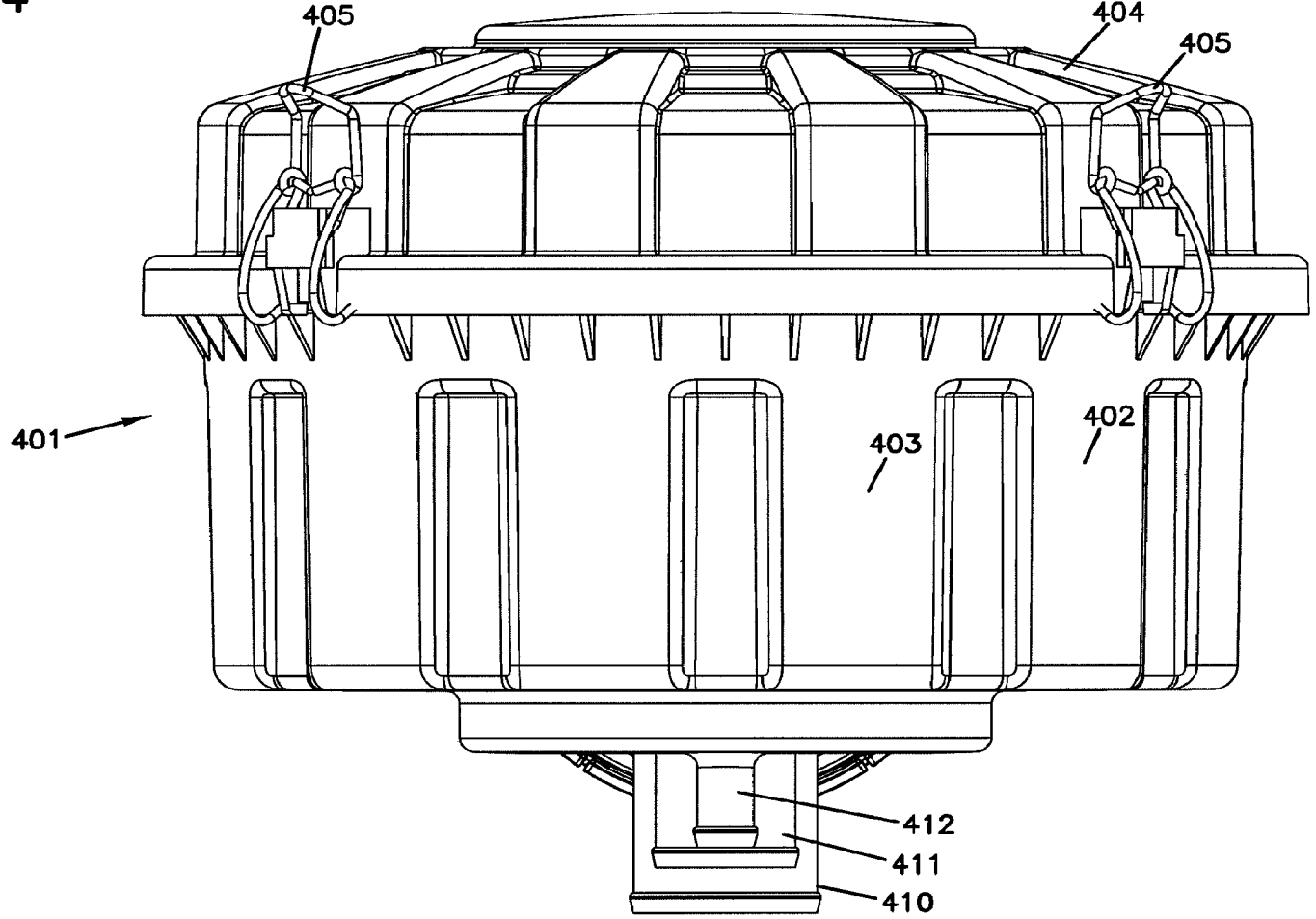
FIG. 24 is a second side elevational view of the assembly depicted in FIGS. 21 and 22; the view of FIG. 24 being taken from the right in FIG. 23.

In FIG. 24 a second side elevational view of the assembly 401 is depicted. The view of FIG. 24 is generally from the right of FIG. 23, toward a side of housing 402 directly opposite backpressure limiting valve arrangement 415.

Figure 25:
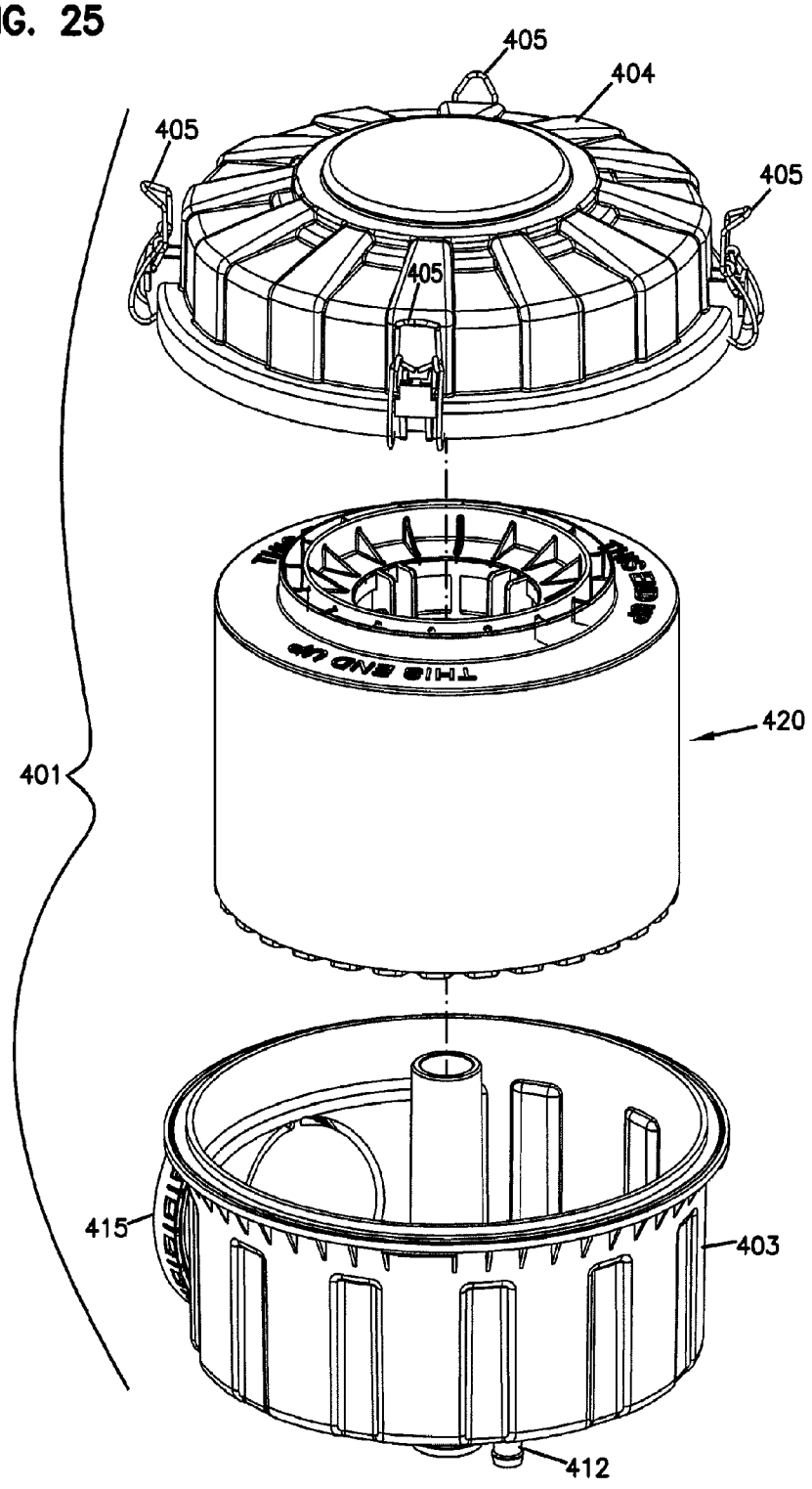
FIG. 25 is a schematic top perspective exploded view of a crankcase ventilation filter assembly depicted in FIGS. 21-24.

In FIG. 25 an exploded perspective view of assembly 401 is depicted. Thus, access cover 404 is shown removed from housing base 403. Filter cartridge 420 is also shown removed from the housing base 403 and the housing 402 generally. It is noted that housing cartridge 420 is generally a service component, and thus is removable from assembly 401 and is replaceable therein. From FIG. 25 it will be understood that the principles described in connection with the embodiment of crankcase ventilation filter assembly 401 uses a single serviceable cartridge, as opposed to multiple cartridges.

Figure 26:
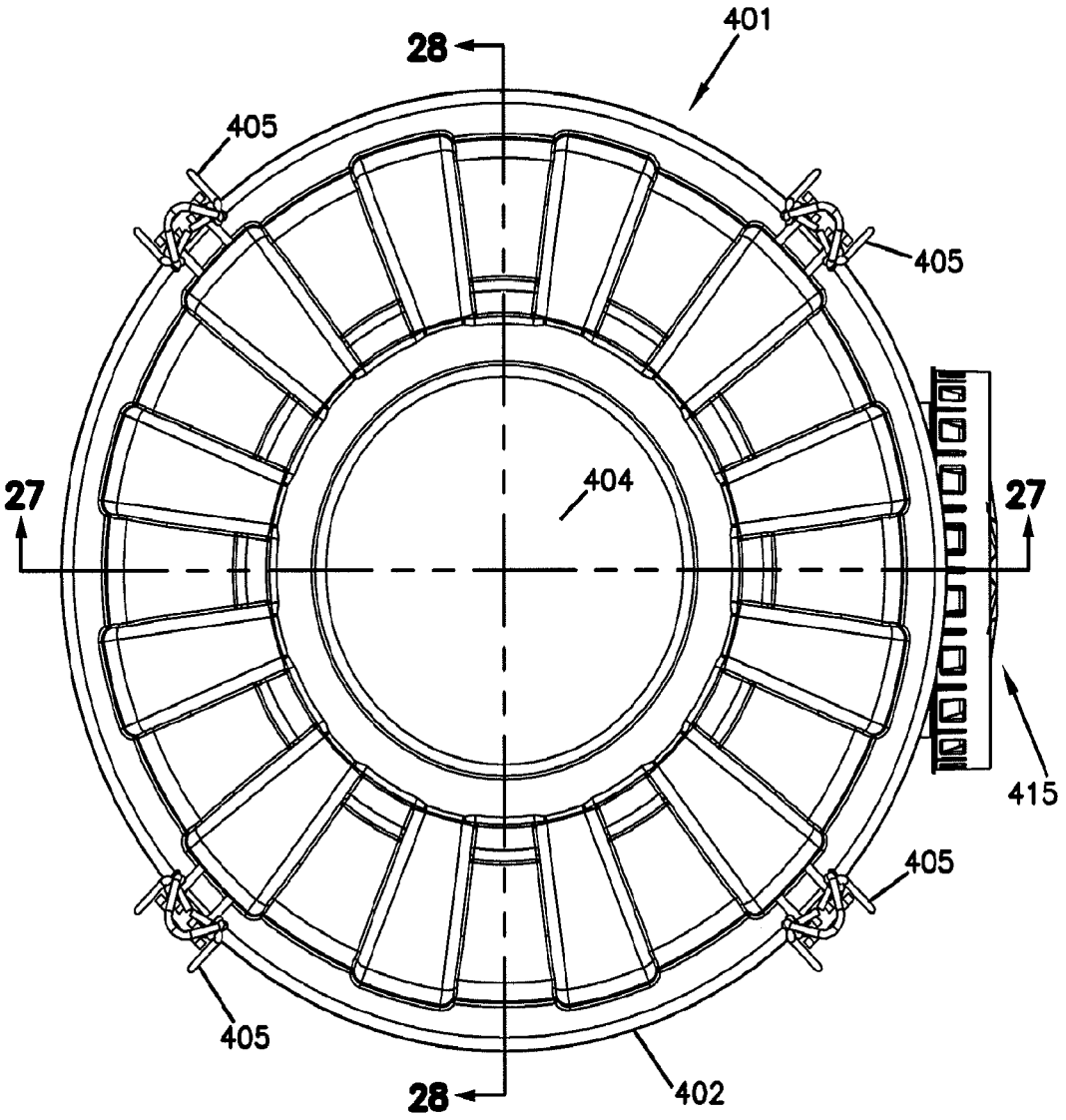
FIG. 26 is a schematic top plan view of the assembly depicted in FIG. 25.

In FIG. 26, a top plan view of assembly 401 is depicted. Features previously characterized briefly include: access cover 404; backpressure limiting regulator (regulation) valve arrangement 415 and latch arrangement 405.

Attention is now directed to FIG. 27, a cross-sectional view taken along line 27-27, FIG. 26. From FIG. 27, a general understanding of the assembly 401 and its operation will be understood.

Referring to FIG. 27, as previously indicated, crankcase ventilation filter gases, i.e. gases from engine blowby, enter assembly 401 through gas flow inlet arrangement 410. In the example depicted, the gas flow direction is upwardly during this entrance, but alternative configurations are possible. For example, the inlet arrangement can be directed downwardly, in application of some principles according to the present disclosure.

Gases entering gas flow inlet 410 are regulated by backpressure limiting regulation (regulator) valve arrangement 415 with respect to gas flow through the housing 402 and into crankcase ventilation filter cartridge 420. For the particular example 401 depicted, the backpressure limiting valve arrangement 415 comprises a diaphragm valve 425 secured in place by cover 426 with regulation being provided by biasing arrangement 427 in the example depicted, comprising spring 427*s*. To reach interior 402*i* of housing 402 and in particular to reach annulus 430 around cartridge 420 inlet gas must flow over rim 431 and enter region 432.

In order for the gases to pass over brim 431 and into region 432, valve diaphragm 425 needs to be biased away from 431. This would occur when the biasing pressure of biasing arrangement 427 is overcome by pressure within inlet 410 and the crankcase. It is noted that aperture 433 is provided through cover 426, to allow for ambient pressure on an opposite side of diaphragm 425 from inlet 410 and region 432. Also, the diaphragm 425 can be seen having a rolling hinge 425*h* secured in place by perimeter bead 425*p*, secured at 426.

In general terms, as with the previously described embodiment, the backpressure limiting regulation (regulator) valve arrangement 415 has a normal closed position. It will not be open unless the pressure in the crankcase and at inlet 410 is sufficient. This means that an under pressure condition within the housing 402, upstream from the backpressure limiting valve regulation (regulator) valve arrangement 415 cannot be transferred through to the crankcase.

Still referring to FIG. 27, once the gases enter region 431, they can reach annulus 430, and they can enter cartridge 420. Cartridge 420 generally comprises media 440. The media is positioned between end pieces 441, 442 (each having a central aperture, 441*o*, 442*o*, respectively therethrough) and surrounding an open filter interior 443. As the gases pass into the media 440, liquid is coalesced; selected particulates are collected within the media 440 and the gases flow through to the open filter interior 443.

It is noted that for the cartridge 420 depicted, gas flow through the media 440 is from out-to-in during filtering. For this reason, the media 440 is depicted with an upstream soot loading stage 440*x* positioned surrounding a downstream filtering/coalescing stage 440*y*. Of course, the media 440 is a matter of choice, and can be selected to have multiple phases or only one phase as desired. In FIGS. 27 and 28, the media 440 is depicted positioned around a porous, central, cartridge support 449.

The filtered gases at the open filter interior 443 are then directed upwardly over rim 445 and into an upper end 446*t* of gas flow tube 446. The gases can then pass downwardly through tube 446 to gas flow outlet arrangement 411.

Regulation of gas flow over rim 445 is provided by vacuum limiting regulation (regulator) valve arrangement 450. The vacuum limiting regulation (regulator) valve arrangement 450 generally comprises a valve diaphragm 451 secured in place under cover 452 with regulation provided by biasing arrangement 453, in this instance comprising a spring 453*s*.

Still referring to FIG. 27, as a vacuum at tube 411 increases, diaphragm 451 will tend to be drawn downwardly toward rim 45, inhibiting transfer of vacuum pressure through housing interior 402*i* into inlet 410. The diaphragm 451 for the example shown, is mounted by rolling hinge 451*r* secured in place by perimeter beam 451*p*.

In more general terms, and as described for the vacuum limiting regulation (regulator) valve assembly of the embodiment depicted in FIGS. 3-19, the vacuum limiting regulation (regulator) valve arrangement 450 is provided in a gas flow path through the assembly 401 with a normal open position. In use, should a vacuum condition occur downstream of the assembly 401, transferring vacuum into tube 411, the vacuum limiting regulation (regulator) valve arrangement 450 will inhibit transfer of that vacuum condition through the housing 402 to the backpressure limiting valve regulation arrangement 415 and elsewhere, to advantage.

Liquid coalesced within media 420 will build-up with a liquid head therein. The lower end piece 442 allows for direct drainage downwardly, through drain apertures 455, eventually liquid drain 412. In addition, any liquid which flows to open filter interior 443 can flow downwardly through central aperture 456 in end piece 442, to drain 412 and outwardly from assembly 401. Drain 412, for example, can be connected to duct work or tubing that directs the liquid to a sump or elsewhere. A valve arrangement can be included in the ducting to control liquid flow downwardly to the sump or elsewhere.

Still referring to FIG. 27, the cartridge 420 includes a housing seal arrangement 460 on end piece 442 by which the cartridge 420 is releasably sealed to housing 402, inhibiting bypass flow of gases to be filtered. The particular housing seal arrangement 460 depicted comprises a seal member 461 positioned on second or lower end piece 442. The particular seal arrangement 461 comprises an outwardly directed radial seal, i.e. a seal configured to engage a housing portion that surrounds the seal or alternately stated the seal, forces relative to the end piece 442 is directed radially outwardly with respect to a central axis X of the cartridge 420.

The particular seal member 461 depicted, comprises an o-ring 4610 positioned on an and around a projection 465 on end piece 442. Alternatives are possible, including molded-in-place seals.

It is noted that a variety of housing seal arrangements 460 can be used, the example depicted merely being usable possibility.

The assembly 401 includes a second seal 468 inhibiting gas flow from region 430 reaching tube 446 by flow across end piece 441. The seal arrangement 468 generally comprises a gasket 468*g* positioned in the service cover 404. The gasket 468 is biased against an upwardly directed seal ridge 469 on end piece 441, when the cartridge 420 is installed and the cover 404 is positioned in place. For the cartridge 420 depicted, upper end piece 441 has no housing seal member thereon.

In FIG. 28, a second cross-sectional view is depicted, in this instance, taken along line 28-28, FIG. 26.

Referring to FIGS. 27 and 28, it is noted that the media 440 for the cartridge 420, depicted is shown in multiple stages, comprising a first outer stage 440*x* and a second inner stage 440*y*. Of course, a variety of media types can be used including gradient media, or if desired, only a single media. The media 440 can be wrapped around a central support 470 as shown, or it can be alternately configured.

Figure 29:
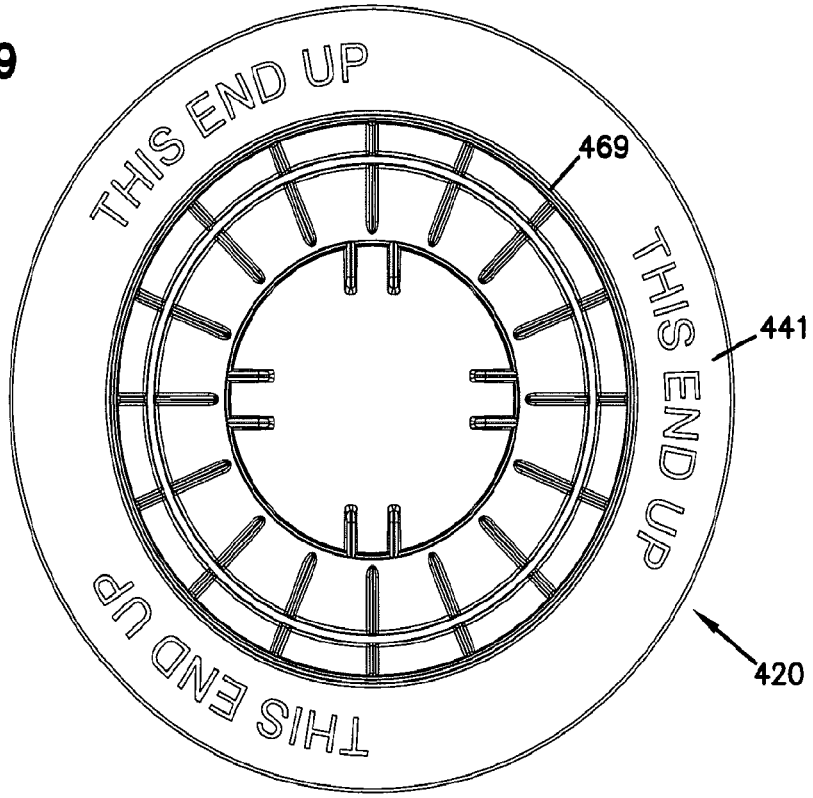
FIG. 29 is a top perspective view of a filter cartridge component of the assembly depicted in FIGS. 21-28.

In FIG. 29, a top plan view of the cartridge 420 is depicted. Seal rib 469 is viewable. It is again noted that the upper end piece 441 has no housing seal member thereon.

Figure 30:
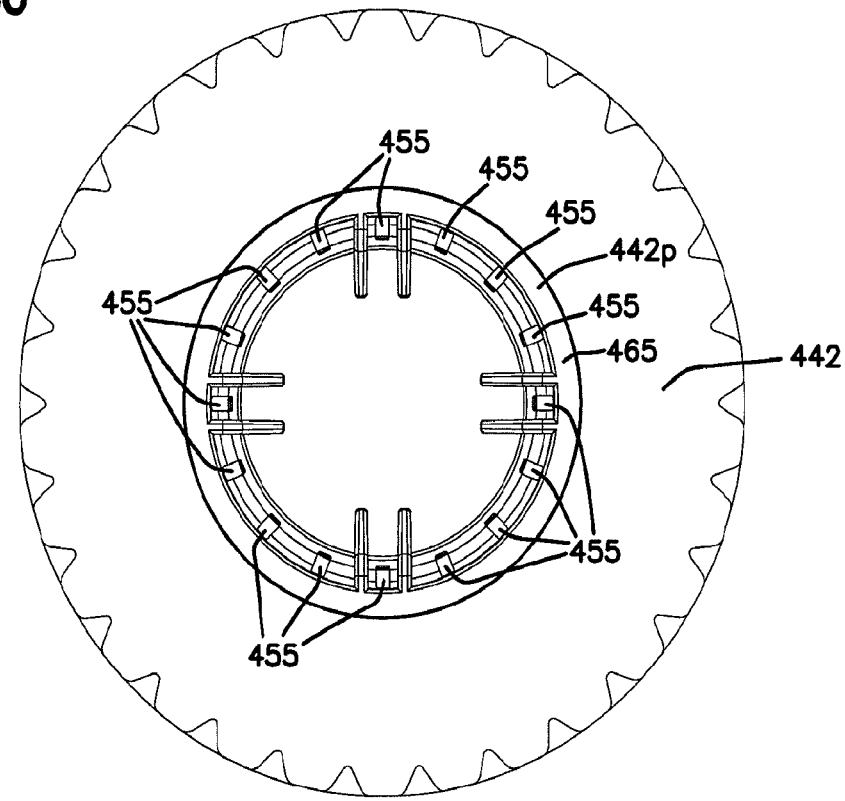
FIG. 30 is a schematic bottom perspective view of a cartridge component depicted in FIG. 29.

In FIG. 30, a bottom plan view of cartridge 420 is depicted. A projection 442*p* with seal member therearound is viewable. Also viewable are aperture 45 for draining liquid through the end piece.

Figure 31:
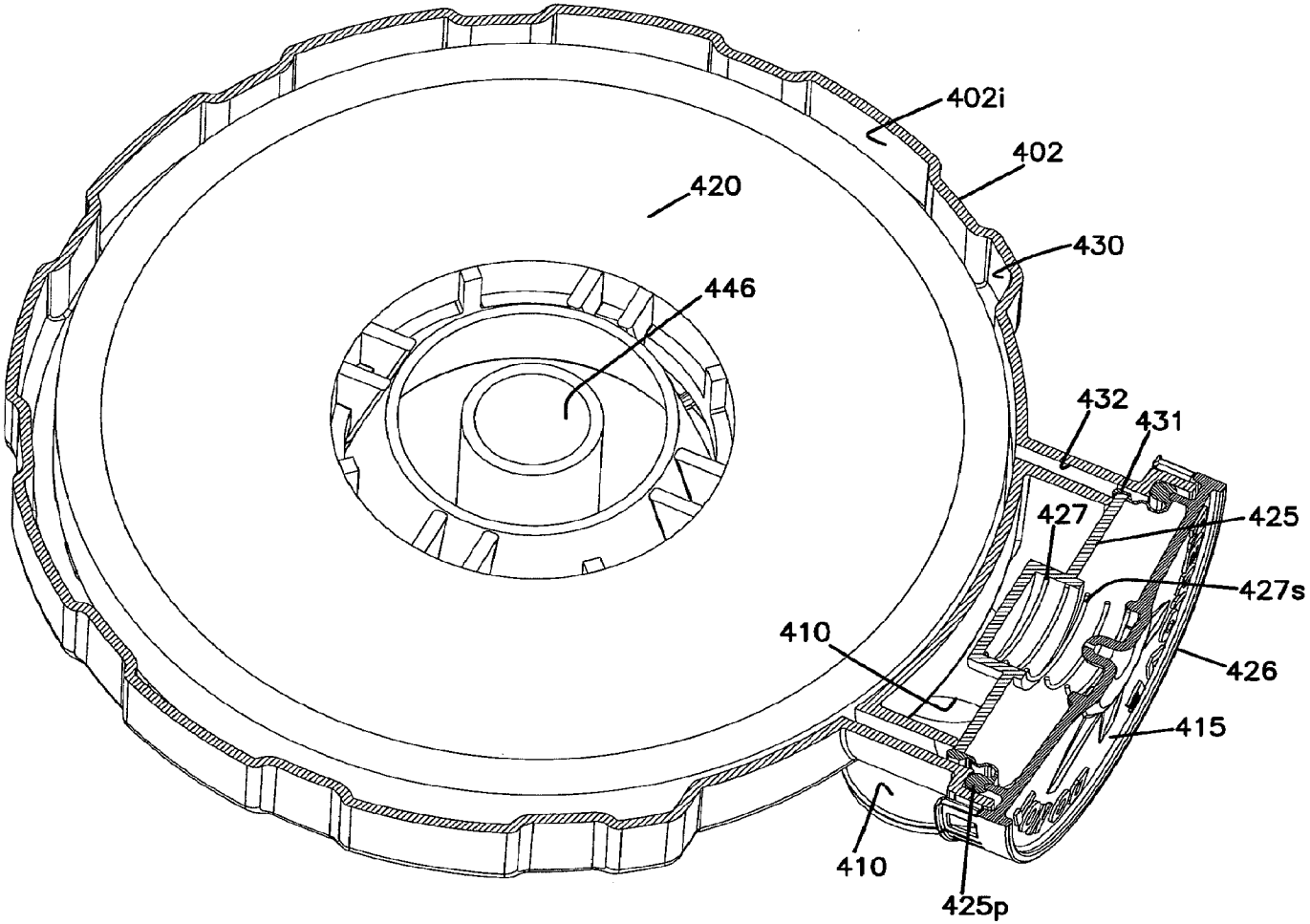
FIG. 31 is a schematic, fragmentary, cross-sectional view of a selected portion of the assembly of FIG. 21.

In FIG. 31, a fragmentary cross-sectional view is taken to provide more detailed understanding of gas flow through backpressure regulation (regulator) valve arrangement 415. It can be seen that for gas flow at inlet tube 410 to enter the housing annulus 430, it must pass over tip 431 and into region 432. To do this, valve member 425 must be biased away from tip 431. Thus, unless the pressure a inlet 410 (and further upstream at the crankcase) is sufficient, gas flow cannot enter interior 402*i* of housing 402.

It is noted that in the arrangement of FIGS. 21-31, gas flow during filtering through the cartridge 420 is "out-to-in". That is, the filtering direction of gas flow is from an exteriorly media pack through the media pack to an open interior. Many of the principles described can be applied when the gas flow during filtering is in a reverse direction, i.e. from an open filter interior through the media to an outer annulus. When this is the case, the vacuum backpressure limiting regulation (regulator) valve assembly would be a valve assembly positioned on a downstream side of the media; and, the backpressure limiting regulation (regulator) valve assembly would be a valve assembly positioned, again, on the upstream side of the media. Many of the general principles of operation, however, would remain the same.

V. Media Usable for Media 120 of Cartridge 115

Cartridge 115 generally serves as a polishing filter within the assembly 50, FIG. 8. Its function then will be to: collect and coalesce liquid dispersed in gases from cartridge 95; and, to comprise a final filter or collection unit for any particular select carried in those gases. It is anticipated that by using two cartridges 95, 115, along with other features described, the total efficiency of collection of liquid in particulate contained within crankcase ventilation gases entered into inlet 54, can be at least 85% and typically at least 90%. Indeed, it is expected that efficiencies of 93% or higher can be obtained, with the techniques described.

It is expected that typically cartridge 115 will not be serviced as often as cartridge 95, since it is not subject to as a high level of load, in particular soot load.

The media 120 of cartridge 115 can comprise a variety of materials. Typically it will be selected to be a material well suited for crankcase ventilation gas coalescing and filtering. Examples of such materials are described in WO 2008/115985 and WO 2006/084282, each of which is incorporated herein by reference.

A. Example General Characteristics of Media 120

The appropriate media, for the media 120, then, is selected for the conditions of use. Generally the media is selected to have appropriate properties with respect to: coalescing and drainage of liquid; and, filtering of gases passing therethrough with respect to particulates. Layers of media can be utilized for the media of the media pack. Example usable media described in U.S. Provisional Application Ser. No. 60/731,287, filed Oct. 28, 2005, PCT Application PCT/US2006/041738, filed Oct. 27, 2006, U.S. Provisional Application 60/656,806, filed Feb. 22, 2006; and, PCT Publication WO06/91594, published Aug. 31, 2006, and PCT Publication WO 2006/084282, published Oct. 19, 2006, each of which is incorporated herein by reference.

Typically the media will comprise a continuous, non-woven, fibrous media.

An example useable media as described in U.S. provisional application 60/656,806 filed Feb. 22, 2005, incorporated herein by reference. Another example media is described in PCT Publication WO 05/083,240, published Sep. 9, 2005, and incorporated herein by reference. A third example media is described in U.S. provisional application 60/650,051 filed Feb. 4, 2005, incorporated herein by reference. The following description is of example media from U.S. provisional application 60/650,051, filed Feb. 4, 2005.

The media is typically a wet laid media is formed in a sheet form using wet laid processing, and is then positioned on/in the filter cartridge. Typically the wet laid media sheet is at least used as a media stage stacked in multiple layers.

Multiple layers, forming a gradient can be provided in a media stage, by first applying one or more layers of wet laid media of first type and then applying one or more layers of a media (typically a wet laid media) of a different, second, type. Typically when a gradient is provided, the gradient involves use of two or more media types which are selected for at least differences in efficiency. It is anticipated that the media 120, in cartridge 115, will not be provided with a significant gradient.

Herein, it is important to distinguish between the definition of the media sheet used to form the media stage, and the definitions of the overall media stage itself. Herein the term "wet laid sheet," "media sheet" or variants thereof, is used to refer to the sheet material that is used to form the media extension of a filter, as opposed to the overall definition of the total media extension in the filter. This will be apparent from certain of the following descriptions.

Media extensions of the type of primary concern herein, are at least used for coalescing/drainage, although they typically also have particulate removal function and thus comprise a portion of an overall media stage that provides for both coalescing/drainage and desired removal efficiency of solid particulate removal.

Although alternatives are possible, an example media composition used to form a media extension in a CCV (crankcase ventilation) filter 115 for coalescing/drainage media 120 is typically as follows:

1. Although alternatives are possible for different applications, it is typically provided in a form having a calculated pore size (X-Y direction) of at least 10 micron, usually at least 12 micron. The pore size is typically no greater than 60 micron, for example within the range of 12-50 micron, typically 15-45 micron.
2. It is typically formulated to have a DOPE % efficiency (at 10.5 fpm for 0.3 micron particles), within the range of 3-18%, typically 5-15%.
3. It typically comprises at least 30% by weight, typically at least 40% by weight, often at least 45% by weight and usually within the range of 45-70% by weight, based on total weight of filter material within the sheet, bi-component (binder) fiber material in accord with the general description provided herein.
4. It typically comprises 30 to 70% (typically 30-55%), by weight, based on total weight of fiber material within the sheet, of secondary fiber material having average largest cross-sectional dimensions (average diameter if round) of at least 1 micron, for example within the range of 1 to 20 micron. In some instances it will be 8-15 micron. The average lengths are typically 1 to 20 mm, often 1-10 mm. This secondary fiber material can be a mix of fibers. Typically polyester and/or glass fibers are used, although alternatives are possible.
5. Typically and preferably the fiber sheet (and resulting media extension) includes no added binder other than the binder material contained within the bi-component fibers. If an added resin or binder is present, preferably it is present at no more than about 7% by weight of the total fiber weight, and more preferably no more than 3% by weight of the total fiber weight.

Media in accord with the general definitions provided herein, including a mix of bi-component (binder) fiber and other fiber, can be used as any (and in some instances all) layer(s) of a media stage in a crankcase ventilation filter as generally described above. When used in this manner, it will typically be placed in multiple layers, although alternatives are possible. The overall efficiency can be calculated based upon the number of layers and the efficiency of each layer. For example the efficiency at 10.5 feet per minute (3.2 m/min) for 0.3 micron DOPE particles for media stage comprising two layers of wet laid media each having an efficiency of 12% would be 22.6%, i.e., 12%+0.12×88.

Typically enough media sheets would be used in the final media stage to provide the media stage with overall efficiency of at least 85%, typically 90% or greater. In some instances it would be preferred to have the efficiency at 95% or more. In the context the term "final media stage" refers to a stage resulting from wraps or coils of the sheet(s) of the media.

B. The Preferred Calculated Pore Size.

The media extension performs two important functions:

1. It provides for some coalescing and drainage of oil particles carried in the crankcase ventilation gases being filtered; and
2. It provides for selected filtration of other particulates in the gas stream.

In general, if the pore size is too low:

a. Drainage of coalesced oil particles by gravity, downwardly through (and from) the media, can be difficult or slowed, which leads to an increase of re-entrainment of the oil into the gas stream; and b. Unacceptable levels of restriction are provided to the crankcase gas flow through the media.

In general, if the porosity is too high:

a. Oil particles are less likely to collect and coalesce; and b. A large number of layers, and thus media thickness, will be necessary to achieve an acceptable overall level of efficiency for the media pack.

It has been found that for crankcase ventilation filters, a calculated pore size for media used to form media extension within the range of 12 to 50 micron is generally useful. Typically the pore size is within the range of 15 to 45 micron.

The term X-Y pore size and variants thereof when used herein, is meant to refer to the theoretical distance between fibers in a filtration media. X-Y refers to the surface direction versus the Z direction which is the media thickness. The calculation assumes that all the fibers in the media are lined parallel to the surface of the media, equally spaced, and ordered as a square when viewed in cross-section perpendicular to the length of the fibers. The X-Y pore size is a distance between the fiber surfaces on the opposite corners of the square. If the media is composed of fibers of various diameters, the $d^2$ mean of the fiber is used as the diameter. The $d^2$ mean is the square root of the average of the diameters squared.

It has been found, in some instances, that it is useful to have calculated pore sizes on the higher end of the preferred range, typically 30 to 50 micron, when the media stage at issue has a total vertical height, in the crankcase ventilation filter of less than 7 inches (178 mm); and, pore sizes on the smaller end, about 15 to 30 micron, are sometimes useful when the filter cartridge has a height on the larger end, typically 7-12 inches (178-305 mm). A reason for this is that taller filter stages provide for a higher liquid head, during coalescing, which can force coalesced liquid flow, under gravity, downwardly through smaller pores, during drainage. The smaller pores, of course, allow for higher efficiency and fewer layers.

Of course in a typical operation in which the same media stage is being constructed for use in a variety of filter sizes, typically for at least a portion of the wet laid media used for the coalescing/drainage in initial separation, an average pore size of about 30-50 microns will be useful.

C. Solidity

Solidity is the volume fraction of media occupied by the fibers. It is the ratio of the fibers volume per unit mass divided by the media's volume per unit mass.

Typical materials preferred for use in media extension according to the present disclosure, have a percent solidity at 0.125 psi (8.6 milliards) of fewer than 10%, and typically fewer than 8%, for example 6-7%.

D. Preferred DOPE Efficiency at 10.5 Ft/Minute for 0.3 Micron Particles.

The preferred efficiency stated, is desirable for layers or sheets of media to be used to generate crankcase ventilation filters. This requirement indicates that a number of layers of the wet laid media will typically be required, in order to generate an overall desirable efficiency for the media stage of typically at least 85% or often 90% or greater, in some instances 95% or greater.

The reason a relatively low efficiency is provided in any given layer, is that it facilitates coalescing and drainage and overall function.

In general, DOPE efficiency is a fractional efficiency of a 0.3 micron DOPE particle (dactyl phthalate) challenging the media at 10 fpm. A TSAR model 3160 Bench (TSAR Incorporated, St. Paul, Minn.) can be used to evaluate this property. Model dispersed particles of DOPE are sized and neutralized prior to challenging the media.

E. The Media Composition.

1. The Bi-Component Fiber Constituent.

As indicated above, it is preferred that the fiber composition of the media include 30 to 70%, by weight, of bi-component (binder) fiber material. A major advantage of using bi-component fibers in the media, is effective utilization of fiber size while maintaining a relatively low solidity. With the bi-component fibers, this can be achieved while still accomplishing a sufficiently high strength media for handling installation in crankcase ventilation filters. Also, the bi-component fibers are binder fibers.

The bi-component fibers generally comprise two polymeric components formed together, as the fiber. Various combinations of polymers for the bi-component fiber may be useful, but it is important that the first polymer component melt at a temperature lower than the melting temperature of the second polymer component and typically below 205° C. Further, the bi-component fibers are integrally mixed and evenly dispersed with the other fibers, in forming the wet laid media. Melting of the first polymer component of the bi-component fiber is necessary to allow the bi-component fibers to form a tacky skeletal structure, which upon cooling, captures and binds many of the other fibers, as well as other bi-component fibers.

Although alternatives are possible, typically the bi-component fibers will be formed in a sheath core form, with a sheath comprising the lower melting point polymer and the core forming the higher melting point.

In the sheath-core structure, the low melting point (e.g., about 80 to 205° C.) thermoplastic is typically extruded around a fiber of the higher melting point material (e.g., about 120 to 260° C.). In use, the bi-component fibers typically have a average largest cross-sectional dimension (average fiber diameter if round) of about 5 to 50 micrometer often about 10 to 20 micrometer and typically in a fiber form generally have an average length of at least 1 mm, and not greater than 30 mm, usually no more than 20 mm, typically 1-10 mm. By "largest" in this context, reference is meant to the thickest cross-section dimension of the fibers.

Such fibers can be made from a variety of thermoplastic materials including polyolefin's (such as polyethylene's, polypropylenes), polyesters (such as polyethylene terephthalate, polybutylene terephthalate, PCT), nylons including nylon 6, nylon 6, 6, nylon 6, 12, etc. Any thermoplastic that can have an appropriate melting point can be used in the low melting component of the bi-component fiber while higher melting polymers can be used in the higher melting "core" portion of the fiber. The cross-sectional structure of such fibers can be a "side-by-side" or "sheath-core" structure or other structures that provide the same thermal bonding function. One could also use lobed fibers where the tips have lower melting point polymer. The value of the bi-component fiber is that the relatively low molecular weight resin can melt under sheet, media, or filter forming conditions to act to bind the bi-component fiber, and other fibers present in the sheet, media, or filter making material into a mechanically stable sheet, media, or filter.

Typically, the polymers of the bi-component (core/shell or sheath and side-by-side) fibers are made up of different thermoplastic materials, such as for example, polyolefin/polyester (sheath/core) bi-component fibers whereby the polyolefin, e.g. polyethylene sheath, melts at a temperature lower than the core, e.g. polyester. Typical thermoplastic polymers include polyolefins, e.g. polyethylene, polypropylene, polybutylene, and copolymers thereof, polytetrafluoroethylene, polyesters, e.g. polyethylene terephthalate, polyvinyl acetate, polyvinyl chloride acetate, polyvinyl butyral, acrylic resins, e.g. polyacrylate, and polymethylacrylate, polymethylmethacrylate, polyamides, namely nylon, polyvinyl chloride, polyvinylidene chloride, polystyrene, polyvinyl alcohol, polyurethanes, cellulosic resins, namely cellulosic nitrate, cellulosic acetate, cellulosic acetate butyrate, ethyl cellulose, etc., copolymers of any of the above materials, e.g. ethylene-vinyl acetate copolymers, ethylene-acrylic acid copolymers, styrene-butadiene block copolymers, Kraton rubbers and the like. Particularly preferred in the present invention is a bi-component fiber known as 271P available from DuPont. Others fibers include FIT 201, Kuraray N720 and the Nichimen 4080 and similar materials. All of these demonstrate the characteristics of cross-linking the sheath polymer upon completion of first melt. This is important for liquid applications where the application temperature is typically above the sheath melt temperature. If the sheath does not fully crystallize then the sheath polymer will remelt in application and coat or damage downstream equipment and components.

An example of a useable bi-component (binder) fiber for forming wet laid media sheets for use in CCV media is Dupont polyester bi-component 271P, typically cut to a length of about 6 mm.

2. The Secondary Fiber Materials.

The bi-component fibers provide a matrix for the crankcase ventilation filter media. The additional fibers or secondary fibers, sufficiently fill the matrix to provide the desirable properties for coalescing and efficiency.

The secondary fibers can be polymeric fibers, glass fibers, metal fibers, ceramic fibers or a mixture of any of these. Typically glass fibers, polymeric fibers or a mixture are used.

Glass fibers useable in filter media of the present invention include glass types known by the designations: A, C, D, E, Zero Boron E, ECR, AR, R, S, S-2, N, and the like, and generally, any glass that can be made into fibers either by drawing processes used for making reinforcement fibers or spinning processes used for making thermal insulation fibers.

Non-woven media of the invention can contain secondary fibers made from a number of both hydrophilic, hydrophobic, oleophilic, and oleophobic fibers. These fibers cooperate with the glass fiber and the bi-component fiber to form a mechanically stable, but strong, permeable filtration media that can withstand the mechanical stress of the passage of fluid materials and can maintain the loading of particulate during use. Secondary fibers are typically monocomponent fibers with average largest cross-sectional dimension (diameters if round) that can range from about 0.1 on up, typically 1 micron or greater, often 8-15 microns and can be made from a variety of materials including naturally occurring cotton, linen, wool, various cellulosic and proteinaceous natural fibers, synthetic fibers including rayon, acrylic, aramide, nylon, polyolefin, polyester fibers. One type of secondary fiber is a binder fiber that cooperates with other components to bind the materials into a sheet. Another type of secondary fiber is a structural fiber that cooperates with other components to increase the tensile and burst strength the materials in dry and wet conditions. Additionally, the binder fiber can include fibers made from such polymers as polyvinyl chloride, polyvinyl alcohol. Secondary fibers can also include inorganic fibers such as carbon/graphite fiber, metal fiber, ceramic fiber and combinations thereof.

The secondary thermoplastic fibers include, but are not limited to, polyester fibers, polyamide fibers, polypropylene fibers, copolyetherester fibers, polyethylene terephthalate fibers, polybutylene terephthalate fibers, polyetherketoneketone (PEKK) fibers, polyetheretherketone (PEEK) fibers, liquid crystalline polymer (LCP) fibers, and mixtures thereof. Polyamide fibers include, but are not limited to, nylon 6, 66, 11, 12, 612, and high temperature "nylons" (such as nylon 46) including cellulosic fibers, polyvinyl acetate, polyvinyl alcohol fibers (including various hydrolysis of polyvinyl alcohol such as 88% hydrolyzed, 95% hydrolyzed, 98% hydrolyzed and 99.5% hydrolyzed polymers), cotton, viscose rayon, thermoplastic such as polyester, polypropylene, polyethylene, etc., polyvinyl acetate, polylactic acid, and other common fiber types.

Mixtures of the fibers can be used, to obtain certain desired efficiencies and other parameters.

The sheet media of the invention are typically made using papermaking processes. Such wet laid processes are particularly useful and many of the fiber components are designed for aqueous dispersion processing. However, the media of the invention can be made by air laid processes that use similar components adapted for air laid processing. The machines used in wet laid sheet making include hand laid sheet equipment, Fourdrinier papermaking machines, cylindrical papermaking machines, inclined papermaking machines, combination papermaking machines and other machines that can take a properly mixed paper, form a layer or layers of the furnish components, remove the fluid aqueous components to form a wet sheet. A fiber slurry containing the materials is typically mixed to form a relatively uniform fiber slurry. The fiber slurry is then subjected to a wet laid papermaking process. Once the slurry is formed into a wet laid sheet, the wet laid sheet can then be dried, cured or otherwise processed to form a dry permeable, but real sheet, media, or filter. For a commercial scale process, the bi-component mats of the invention are generally processed through the use of papermaking-type machines such as commercially available Fourdrinier, wire cylinder, Stevens Former, Roto Former, Inver Former, Venti Former, and inclined Delta Former machines. Preferably, an inclined Delta Former machine is utilized. A bi-component mat of the invention can be prepared by forming pulp and glass fiber slurries and combining the slurries in mixing tanks, for example. The amount of water used in the process may vary depending upon the size of the equipment used. The furnish may be passed into a conventional head box where it is dewatered and deposited onto a moving wire screen where it is dewatered by suction or vacuum to form a non-woven bi-component web.

The binder in the bi-component fibers is activated by passing the matt through a heating step. The resulting material can then be collected in a large roll if desired.

3. Surface Treatments of the Fibers.

Modification of the surface characters of the fibers, increase in the contact angle, can enhance drainage capability of filtration media and thus the formed elements of the filter (with respect to pressure drop and mass efficiency). A method of modifying the surface of the fibers is to apply a surface treatment such as a flourochemical or silicone containing material, typically up to 5% by weight of the media.

The surface treatment agent can be applied during manufacture of the fibers, during manufacture of the media or after manufacture of the media post-treatment, or after provision of the media pack. Numerous treatment materials are available such as flourochemicals or silicone containing chemicals that increase contact angle. An example is the DuPont Zonyl™ flourochemicals, such as #7040 or #8195.

VI. Media of the Filter Cartridge 95; 420

The filter cartridges 95 (and 420) as described herein above, serve the function of being a primary source for collection of material such as soot; and, as a (first) drainage stage media, in the embodiment of FIG. 3, (downstream from the breather 90). As such, the particular cartridge 95 depicted in FIG. 19, includes two media phases or stages 370 and 371.

1. The Soot Collection Stage 370; 440*x*.

The soot collection stage 370 (440*x*) will generally be upstream and more porous than the stage 371 (440*x*). That is typically it will have a higher permeability.

The material for media stage 370 (440*x*) will typically be chosen for its soot collection and load properties, and not for liquid coalescing and drainage properties, although some coalescing is expected to occur within the media. It will typically comprise a material sufficiently robust to withstand the circumstances of the expected environment of use. It will be sufficiently sized so that not plug prematurely with soot, before an intended service life. Polyester fibers can be used.

An example useable materials are commercially available from TWE Bocholt GmbH (Germany) as, a Tangerding non-woven media. Again, its particular properties will be chosen for soot loading. It may be desirable to obtain a similar material, but with a more robust fiber, for some applications. For cartridge 370, the media can be selected, and then be wrapped multiple times around support 170, before media 371 is added. For cartridge 420, the media 440*x* can be wrapped several around media 440*y*.

2. Media Stage 371, 440*y*

The media stage 371 of cartridge 95 (and stage 440*y* of cartridge 420) will generally comprise a media similar to that used in the media pack 120 of cartridge 115. Indeed it can be the same media. However, it will typically be a media having a somewhat higher porosity by comparison to the media 120. Advantages from this relate to having media 371 (440*y*) provide for a sufficiently long life. In the assembly of FIGS. 3-19, again, media 120 operates as a polishing filter.

Typically, the total volume occupied by the soot collecting media 370, 440*x* relative to the coalescing-drain media 371, 440*y* (in the same cartridge) will be such that the coalescing stage 371, 440*y* is downstream and has at least the same volume as soot collecting stage 370, 440*x*, typically at least 1.5 times the volume and often 2 times the volume or more.

Typically the total volume of the media 371 is substantially smaller than the total volume occupied by media 120 in cartridge 115, when present. Typically, media 120 occupies at least 2 times the volume of media 371 and often 2.5 times the volume or more.

VII. Packing of the Breather 90

The packing 92 from breather 90, FIG. 7, can be a standard packing used in the past for breather filters, such as an aluminum foil packing. An example would be used to an aluminum foil of 0.08 mm thick, in accord with ASTM B-476, with a total weight of 74 grams for the particular system depicted, i.e. with a height of 71.2 mm and a diameter (horizontal dimension) of about 91 mm.

VIII. Media for the Media Pack 440, FIGS. 21-31

Again, the media pack 440 can be configured with media as previously described herein above in section VI. When multiple media stages are contained within the same cartridge, such as shown for example in FIG. 28 at 440*x*, 440*y*, the various stages can also be as characterized above in section VI. The media selection is a matter of choice for the particular application, and the general principles described herein with respect to configuration gas flow, direction and regulator valve assembly are not dependent on the particular media choice.

IX. Additional Observations

The described crankcase ventilation filter systems are particularly advantageous for use in closed crankcase ventilation but have the flexibility to be used in an open ventilation system as well.

Typically, the inlet of the system will be in communication with the crankcase, while the outlet will be in the communication with the air in-take system. Again, the outlet can be communication with a location between the air intake filter and turbo charger.

Each of the systems described comprises a housing having a gas flow inlet arrangement, a gas flow outlet arrangement and a liquid drain outlet arrangement. Further, optionally and advantageously, each uses a backpressure limiting regulation (regulator) valve arrangement; and, a separate vacuum limiting regulation (regulator) valve arrangement. Preferably neither is a vent valve that vents to the atmosphere. The backpressure limiting regulation (regulator) valve assembly is ordinarily positioned on the housing in a closed orientation, unless the crankcase pressure upstream of the assembly is sufficient to push the backpressure limiting regulation (regulator) valve assembly sufficiently for gas flow through the housing. The vacuum limiting regulation (regulator) valve assembly is ordinarily positioned on the housing in an open position, and tends toward a closed position if a vacuum condition upstream from the crankcase ventilation valve assembly is sufficient to raise issue with proper assembly operation and/or crankcase condition. Thus, typically, the backpressure limiting regulation (regulator) valve assembly is in a gas flow path upstream of the vacuum limiting regulation (regulator) valve assembly. Variations are described: (1) in which the two are positioned in an assembly having a two phase separation; and, (2) in which an assembly is depicted with a single filter cartridge (single phase) present.

Again an example system described uses an integrated breather stage described generally at 90. Its purpose is to minimize oil splashes, and large oil droplets are managed before they can reach the cartridge 95.

The breather 90 can be configured to mimic those used in some systems, independently of (i.e. outside of) a crankcase ventilation filter system. When such an integrated breather inside of a housing 51 is used, one can discontinue use of the stand alone breather. However, a stand alone breather can, in addition, be used.

It is expected that the two phase assembly (FIGS. 3-19) will typically be configured for the first cartridge 95 to provide 30%-50% efficiency for the particle size distribution of interest. The cartridge 115 can be configured to provide a remaining efficiency desired for the particles of interest, with an overall efficiency of 85% or greater, indeed 90% or greater, (for particles of interest) being achievable.

The vacuum limiting valve arrangements serve the function of leveraging the benefit of a turbo charger vacuum to lower the pressure upstream of the crankcase ventilation filter assembly, and extend the allowable pressure range, while limiting the negative consequences of too much turbo charger vacuum on the drain height requirement (i.e. drain height needed to drain oil through a check valve and into a sump). Different engine families allow different maximum crankcase pressures. The vacuum limiting valve regulator arrangement is such that is starts regulating at different turbo charger vacuums, depending on the engine family. This can be accomplished by selecting different springs in the same system.

The backpressure limiting valve arrangement allows the system to ensure very minimal or no negative crankcase pressure. Some engines have specifications that do not allow for below zero (inch $H_2O$) crankcase pressure, others allow small negative pressures (for example down to about −1 inch $H_2O$.

The unique design of the backpressure limiting valve allows the proposed crankcase ventilation filter system to spike despite the possibility of having a high negative pressure inside the housing due to a dirty loaded air filter on the intake system (more turbo vacuum of the housing) and clean filter (less restriction across the system). The design significantly lowers the impact of the turbo charger vacuum on the crankcase pressure.

It is noted that the overall system 50, FIG. 3 has a relatively low profile. An engine valve cover can be configured to accommodate the inlet and outlet and oil drain ports, providing for even less total vertical height.

The particular system 50 depicted, is shown configured for a horizontal layout. Alternate applications of the techniques can be provided, to allow for vertical orientation.

It is noted that the configuration as depicted, can be serviced without the need to separate hoses or their fittings, but simply by removing access cover 71 and thus accessing cartridges 95, 115. Typically cartridge 115 will not need to serviced as often as cartridge 95.

In the example assembly of FIGS. 3-19 depicted, the media in each cartridge has a height of about 100 mm. Typically, in operation, a lower portion of the coalescing-drainage media will fully saturate with liquid, up to a upper, liquid head, height. Typically, the coalescing-drainage media in media region 131, and also in media 120, will be selected so that a maximum saturation liquid height (i.e. wet line) will not be more than about 30% of the total media height. For media 131, it will typically not be more than 15% of the total media height and usually not higher than 12 mm. For media 120, it may significantly higher, for example up to about 25 mm, in some instances.

In general, with coalescing-drainage media, above the wet line or saturation level, gases will flow through the media pack. It is generally desirable to the provide the media such that a relatively high volume is provided for gas flow, to allow efficient, effective operation. However, a sufficiently high wet line or saturation level is needed, to generate drainage from the media downwardly.

X. Summary; Observations and Characterizations

According to the present disclosure, features, components and methods relating to crankcase ventilation filter assemblies are described. Also described are methods of assembly and use. There is no specific requirement that an assembly, method, component, technique or use, involve all of the features characterized herein.

According to an aspect of the present disclosure, crankcase ventilation filter assemblies are provided which include a housing arrangement having: a gas flow inlet arrangement, gas flow outlet arrangement; and, a liquid drain arrangement. For an example arrangement depicted in FIGS. 3-19: the gas flow inlet arrangement comprises a single inlet tube; the gas flow outlet arrangement comprises a single outlet tube; and, the liquid drain arrangement comprises first and second spaced, liquid drains. In an example arrangement depicted in FIGS. 21-31, the gas flow inlet arrangement comprises a single inlet tube; a gas flow outlet arrangement comprises a single outlet tube; and, the liquid drain arrangement comprises a single liquid drain.

In each of two depicted embodiments, a backpressure limiting regulation (regulator) valve assembly; and a vacuum limiting regulation (regulator) valve assembly are provided on/in the housing. The two valve assemblies are separate from one another and provide different effects. The backpressure limiting regulation (regulator) valve assembly is typically provided in a gas flow path with a normal closed position, and prevents gas flow from a crankcase flowing trough the system, unless the pressure is adequate. The vacuum limiting regulation valve assembly is positioned in a gas flow path to prevent a vacuum condition downstream from the crankcase ventilation filter assembly, from passing through the housing and into the crankcase. The backpressure limiting regulation valve arrangement is configured with a normal closed position, and the vacuum limiting regulation (regulator) valve arrangement is positioned with a normal open configuration. Several examples are provided, one in each of the embodiments.

Typically, the backpressure limiting regulation (regulator) valve assembly is positioned downstream of gas flow inlet to the assembly, and upstream from both the gas flow outlet and the vacuum limiting regulation valve assembly. Typically, the vacuum limiting regulation valve assembly is positioned in a gas flow path downstream from the backpressure limiting regulation valve assembly; and, upstream from a gas flow outlet from the assembly.

An example crankcase ventilation filter assembly depicted includes a multi-phase separation system having (i.e. including): (1) a first separation phase configured for coalescing of at least a portion of liquid in gases directed into gas flow inlet arrangement and direction of those coalesced liquids to the first liquid drain; and (2) a second separator phase configured for coalescing at least a portion of liquid in gases received from the first separation phase, and direction of at that coalesced liquid to the second drain. Typically, the first and second drains are isolated in the system, within the housing arrangement, such that liquid flow communication directly between the two is not possible. By this, it is meant that filter members, and seals thereof, isolate the two drains from one another, so that liquid cannot flow directly between the two.

Typically, the crankcase ventilation filter assembly includes, as the first separation phase, a first serviceable filter cartridge comprising a first media pack surrounding a first open filter interior and positioned to receive gases directed to the first open filter interior before direction through the first media pack. That is, the first serviceable filter cartridge is configured to be used with a filtering flow through a media pack thereof, of gases from in-to-out.

Also, typically the second separation phase includes a second serviceable filter cartridge comprising a second media pack surrounding an second open filter interior and positioned for gas flow through the second media pack and into the second open filter interior, during filtering. That is, it is generally configured for out-to-in gas flow, during filtering.

By "serviceable" in connection with the characterization of the first filter cartridge and the second filter cartridge, it is meant that the cartridges can be removed from the assembly, for example to be replaced. Typically, the first and second serviceable filter cartridges are separate from one another, and can be separately serviced.

In an example system depicted, a backpressure limiting valve regulator arrangement is positioned upstream of the media on the first serviceable filter cartridge and downstream from the gas flow inlet arrangement. That is, gases flowing through the housing from the gas flow inlet arrangement to the media pack of the first serviceable filter cartridge, must pass a backpressure valve regulator arrangement, configured to close, if desired, to inhibit an undesirable vacuum condition within the housing, from being transferred through the gas flow inlet to a crankcase in use. Typically, the backpressure limiting vale regulator valve arrangement is configured to have a "normal closed" orientation, i.e. to be closed when the system and engine are completely shut-off and to only bias open, to allow gas flow to reach the first filter cartridge, when the engine is on an operating properly.

In a typical example system described, the crankcase ventilation filter assembly also includes the vacuum limiting regulation valve arrangement positioned in a gas flow path downstream of the media pack of the second serviceable filter cartridge and upstream of the gas flow outlet arrangement. Such a vacuum limiting regulator valve arrangement is typically configured to inhibit an undesirable vacuum condition, downstream from the housing, from being transferred through the gas flow outlet to equipment within the housing. The vacuum limiting regulation valve arrangement is typically configured to have a "normal open" configuration, i.e. it is an open valve that tends to close as the vacuum condition downstream (with respect to gas flow) of the assembly increases.

An inertial impaction arrangement is described. In embodiments depicted, it is positioned over (or across) the gas flow inlet arrangement. In examples depicted, the inertial impaction arrangement typically comprises an impermeable plate positioned over an upwardly directed inlet aperture and spaced therefrom by an open support (side gas flow) arrangement. The open support arrangement is typically a framework that allows gases to pass therethrough, as they enter the housing from the gas flow inlet. The inertial impaction arrangement provides that selected liquid within gases passing into the housing, will impact the plate, and drain. Typically, the inertial impaction plate will be spaced from the inlet aperture by a distance of 15 mm-30 mm, inclusive, although alternatives are possible. The inertial impaction arrangement, comprising the impermeable plate and the support arrangement can be formed integral with adjacent portions of the housing.

In more general terms, according to the present disclosure, an inertial impaction arrangement and principles relating thereto, for use in a crankcase ventilation filter assembly, is provided. In general, the assembly includes a inlet tube that is directed into a housing, to a location surrounded by media of a cartridge, i.e. into an open filter interior. The inlet tube has a closed end, closed by inertial impaction plate, and adjacent the inertial impaction plate is provided a side gas flow opening arrangement or open support arrangement. As gases enter the housing through the inlet tube, they are directed toward the inertial impaction plate, at which some coalescing occurs. The gases pass through the open support arrangement (side gas flow passageway arrangement) and then enter the cartridge involved. The tube can be upwardly directed or downwardly directed, depending on the system. An example is depicted in which the tube is upwardly directed.

The housing of example arrangements depicted, each comprise a base member and a removable access cover arrangement, in the examples depicted comprising a single access cover. Each can comprise molded plastic.

An example crankcase ventilation filter assembly is depicted which includes, positioned within the housing, an optional breather, positioned in the first separation phase at a location in a gas flow path: through the first separation phase; and, downstream from the inertial impaction arrangement and upstream from the media pack at the first serviceable filter cartridge. The breather is typically configured not to be serviceable, i.e. not to ordinarily be removed from the assembly for servicing. A particular breather packing is described, which includes a high surface area packing, such as a metal foil packing, configured in a housing. The housing of an example depicted is configured with an outer cylindrical impermeable sidewall, and permeable top and bottom sections, with the packing positioned between the permeable top and bottom sections. In an example assembly depicted, a cross-sectional dimension of the housing is larger than a cross-sectional dimension of the inertial impaction plate. An example coalescer pack is depicted, configured for generally vertical direction of gas flow therethrough, from bottom to a top, in use, with liquid collected therein draining downwardly to a region of the housing immediately surrounding the gas flow inlet, to eventually drain through the inlet back into the crankcase.

In an example assembly depicted, the backpressure limiting regulation valve arrangement is positioned in gas flow path from the coalescer pack to the first media pack of the first serviceable filter cartridge. In the example, the backpressure limiting valve regulator comprises spring-loaded valve diaphragm positioned above the breather and having a central ridge valve portion surrounded by a flexible rolling hinge portion.

In an example assembly depicted, the vacuum limiting regulation valve arrangement comprises a spring-loaded a diaphragm positioned above the second serviceable filter cartridge, over an inlet end of an exit tube around which the second serviceable filter cartridge is positioned.

In example systems described, the first serviceable filter cartridge comprises a first media pack positioned around a central media support, at a location between first and second end pieces. An assembly is described in which the central media support and first and second end pieces are formed integral with one another, for example from plastic. The media pack for the first serviceable filter cartridge can comprise a multi-stage media pack having an upstream soot collection stage and a downstream coalescing/drain stage of media. When the cartridge is configured for in-to-out flow during filtering, the soot stage would typically be surrounded by the coalescing/drain stage. When the cartridge is configured for out-to-in flow during filtering, the soot stage would typically surround the coalescing/drain stage. Examples of each are depicted. Example materials are described. Typically, the soot collection stage would be configured to have a high porosity (lower solidity) than the coalescer/drain stage.

With such a cartridge, the second end piece may include a liquid drain arrangement therethrough underneath, in axial overlap with, media (for example the coalescing-drain stage) and positioned in axial overlap with the media at a location not in axial overlap with the soot collection stage of media (if present). An example assembly is depicted, in which this liquid drain arrangement comprises spaces positioned adjacent an outer periphery of the media pack of the first cartridge. In another example depicted, the liquid drain arrangement comprises spaces or apertures spaced adjacent the inner periphery of the media pack of the cartridge.

In an example depicted, the first cartridge includes, in the first end piece, a central aperture; and, an upper housing seal arrangement. The upper housing seal arrangement for an example depicted, includes a support directed from the first end piece in a direction away from the second end piece, having a seal member mounted thereon, the seal member being oriented to form a radial seal. In an example described, the radial seal is oriented to be directed radially outwardly during sealing, and can comprise a variety of sealing materials, an o-ring being an example.

In an example first cartridge depicted, the second end piece includes a central aperture therethrough, the lower housing seal arrangement thereon comprising a seal support directed axially from the second end piece in a direction away from the first end piece of the media. The support is configured to support a housing seal member thereon, typically configured to form a radially directed seal. In an example depicted, the seal member is supported to form a radially inwardly directed seal. An example housing seal arrangement would be an o-ring, although alternatives can be used.

In the example arrangement depicted, the second serviceable filter cartridge also comprises a media pack positioned around a central media support, at a location between first and second end pieces. An example is depicted, which has first and second end pieces and a central support, the portions, are integral pieces of a single plastic component. The second serviceable filter cartridge includes, on the first end piece, projecting in a direction away from the second end piece and the media, a housing seal arrangement comprising a seal support having a seal member thereon. In an example depicted, the seal member is configured to form a radially directed seal, an example being an outwardly directed radial seal. An example seal member depicted is an o-ring.

In the example second cartridge depicted, a seal arrangement is also positioned on the second end piece; in the example shown comprising a seal support directed from the second end piece in a direction away from the first end piece of them media. The second support includes a housing seal member thereon, for example an o-ring, configured to form a radial seal. In an example depicted, the radial seal on the second end piece is configured to form an outwardly directed radial seal.

Seal(s) can be mounted on housing part(s), rather than cartridge parts, if desired.

In an example assembly depicted, the media pack of the first cartridge is a two-stage media, having soot collecting media stage upstream and a more dense coalescing/drainage stage. In such a cartridge, typically the soot media stage has a volume no more than an often substantially smaller than, the coalescing/drainage stage. Typically, any lower drain arrangement from the first cartridge is positioned underneath the coalescing/drain stage and not the soot collation stage.

In an assembly depicted, a cartridge (for example a second cartridge) only comprises coalescing/drainage stage. When two cartridges are present, typically, the media of the second cartridge is typically of a material similar to the coalescing/drainage stage of the first cartridge. Typically substantially more media is included in the coalescing/drainage stage of the second cartridge, than the coalescing/drain stage of the first cartridge, to provide for higher efficiency.

The second end piece of the second cartridge depicted includes a liquid drain arrangement underneath, in axial overlap with the media of the second cartridge at a location positioned spaced radially inwardly from overlap with the center of the media. This liquid drain arrangement, for example, can comprise apertures positioned around an inner perimeter of the second end piece, in axial overlap with the media.

Also according to the present disclosure, a crankcase ventilation filter cartridge, depicted in the arrangement of FIGS. 21-31, is provided which comprises first and second end pieces each having a central aperture therethrough, and media surrounding an open filter interior and positioned between first and second end pieces. The first end cap includes an upper seal ridge comprising a projection extending away from the media, the first end cap having no seal member thereon. The second end cap includes an outer surface with a seal support thereon projecting in a direction generally away from the media. The housing seal member is positioned on the seal support. In an example depicted, the housing seal member is positioned surrounding the seal support, to form an outwardly directed radial seal. An example is described in which the housing seal member is an o-ring. A cartridge is depicted in which the second end piece includes a liquid drain arrangement therethrough, underneath, and in axial overlap with, the media. An example cartridge depicted in which the media comprises a soot loading media surrounding a coalesced/drainage stage of media; and, the liquid drain arrangement provides an axial overlap with the coalescing/drain stage of the media not for soot collecting stage of media.

Methods and techniques are also described, generally involving use of the components described. Further, methods of assembly are described, which involve creating selected portions of the assembly and installing them as described. Also, methods of service are described.

There is no specific requirement that an assembly, component, feature, technique or method include all of the features depicted characterized herein, in order to obtain some benefit according to the present disclosure.

What is claimed:

1. A crankcase ventilation filter assembly comprising:

(a) a housing arrangement including:
  (i) a gas flow inlet arrangement;
  (ii) a gas flow outlet arrangement; and,
  (iii) a liquid drain outlet arrangement;

(b) a filter cartridge positioned within the housing arrangement;

(c) a backpressure limiting regulation valve arrangement mounted on the housing arrangement; and, (d) a vacuum limiting regulation valve arrangement mounted on the housing arrangement;
  (i) the backpressure limiting regulation valve arrangement being positioned in a gas flow path between the gas flow inlet arrangement and the vacuum limiting regulation valve arrangement and being constructed to inhibit gas flow, from the gas flow inlet, into and through the housing arrangement unless pressure from the engine crankcase is above a selected value; and,
  (ii) the vacuum limiting regulation valve arrangement being positioned in a gas flow path between the gas flow outlet arrangement and the backpressure limiting regulation valve arrangement and being constructed to inhibit an under pressure condition at the gas flow outlet from being transferred to the filter cartridge in the housing arrangement and,
  (iii) the backpressure limiting regulation valve arrangement comprising a separate valve member from the vacuum limiting valve arrangement.

2. A crankcase ventilation filter assembly according to claim 1 wherein:

(a) the filter cartridge includes media positioned in a gas flow path through the housing arrangement with the media located: upstream form the vacuum limiting regulation valve arrangement and downstream from the backpressure limiting regulation valve arrangement.

3. A crankcase ventilation filter assembly according to claim 1 wherein:

(a) the filter cartridge comprises a serviceable filter cartridge including a first media pack positioned around a central media support, at a location between first and second end pieces.

4. A crankcase ventilation filter assembly according to claim 3 wherein:

(a) the first end piece of the first cartridge includes: a central aperture therethrough; and, an upper housing seal arrangement thereon; and, (b) the second end piece of the first cartridge includes: a central aperture therethrough; and, a lower housing seal arrangement thereon.

5. A crankcase ventilation filter assembly according to claim 2 wherein:

(a) the media pack of the filter cartridge comprises an upstream soot collection stage of media and a downstream coalescing/drainage stage of media;

(i) the soot collection stage of media having a higher permeability than the coalescer/drainage stage.

6. A crankcase ventilation filter assembly according to claim 1 including:

(a) a filter cartridge comprising media surrounding an open cartridge interior;

(i) the filter cartridge being positioned over a gas flow tube projecting through the open cartridge interior; and, (ii) the vacuum limiting regulation valve arrangement being positioned to regulate gas flow from the open cartridge interior into an upper end of the gas flow tube.

7. A crankcase ventilation filter assembly according to claim 1 wherein:

(a) the liquid drain outlet arrangement includes first and second, spaced, liquid drains; and, (b) the assembly is a multi-phase separation system including:

(i) a first separation phase configured for coalescing of at least a portion of liquid in gases directed into the gas flow inlet arrangement and direction of that coalesced liquid to the first liquid drain; and, (ii) a second separation phase configured for coalescing of at least a portion of liquid in gases received from the first separation phase and direction of that coalesced liquid to the second drain.

8. A crankcase ventilation filter assembly according to claim 7 wherein:

(a) the first separation phase includes a first serviceable filter cartridge comprising a first media pack surrounding a first open filter interior and positioned to receive gases directed into the first open filter interior before direction through the first media pack.

9. A crankcase ventilation filter assembly according to claim 8 wherein:

(a) the second separation phase includes a second serviceable filter cartridge comprising a second media pack surrounding a second open filter interior and positioned to receive gases directed through the second media pack and into the second open filter interior, during filtering.

10. A crankcase ventilation filter assembly according to claim 9 wherein:

(a) the second serviceable filter cartridge comprises a second media pack positioned around a central media support, at a location between first and second end pieces.

11. A crankcase ventilation filter assembly according to claim 9 wherein:

(a) the first and second cartridges are, separately, removable from the housing.

12. A crankcase ventilation filter assembly according to claim 9 wherein:

(a) the backpressure limiting regulation valve arrangement is positioned in a gas flow path upstream of the media pack of the first serviceable filter cartridge and downstream from the gas flow inlet arrangement.

13. A crankcase ventilation filter assembly according to claim 12 wherein:

(a) the vacuum limiting regulation valve arrangement is positioned in a gas flow path downstream of the media pack of the second serviceable filter cartridge and upstream of the gas flow outlet arrangement.

14. A crankcase ventilation filter according to claim 13 wherein:

(a) the vacuum limiting regulation valve arrangement comprises a spring-loaded diaphragm positioned above the second serviceable filter cartridge.

15. A crankcase ventilation filter assembly according to claim 14 wherein:

(a) the second serviceable filter cartridge is positioned with the second media pack thereof surrounding, and spaced from, a gas flow exit tube having an open top end; and, (b) the spring-loaded diaphragm comprises a central diaphragm member positioned over the open top end of the gas flow exit tube.

16. A crankcase ventilation filter assembly according to claim 1 wherein:

(a) the gas flow inlet arrangement is an upwardly directed inlet aperture in the housing.

17. A crankcase ventilation filter assembly according to claim 1 including:

(a) a multi-phase separation system including:

(i) a first removable and replaceable filter cartridge comprising media positioned around a central cartridge interior; and, (ii) a second removable and replaceable filter cartridge comprising media positioned around a central cartridge interior;

(iii) the first cartridge and the second cartridge being: separate from one another; positioned side-by-side; positioned so that gas flow passes in series from the first cartridge to the second cartridge, in passing from the gas flow inlet arrangement to the gas flow outlet arrangement; and, positioned so that gases flow from in-to-out in passing through one of the cartridges; and, from out-to-in in passing through another of the cartridges.

18. A crankcase ventilation filter assembly according to claim 1 including therein a filter cartridge, the filter cartridge comprising:

(a) first and second end pieces; and, (b) media surrounding an open filter;

(i) the media comprises upstream soot collection stage of media and a downstream coalescing/drain stage of media;

(ii) the soot collection stage of media having a higher permeability than the coalescer/drainage stage.

19. A crankcase ventilation filter assembly according claim 18 wherein:

(a) the soot collection stage of media occupies less volume than the coalescer/drainage stage of media.

20. A crankcase ventilation filter assembly according to claim 19 wherein:

(a) the media pack of filter cartridge comprises the soot collection stage of media surrounded by the coalescing/drainage stage of media.

* * * * *